United States Patent [19]

Ferrand

[11] Patent Number: 5,023,967

[45] Date of Patent: Jun. 18, 1991

[54] PATIENT SUPPORT SYSTEM

[75] Inventor: Robert Ferrand, Burlingame, Calif.

[73] Assignee: American Life Support Technology, Burlingame, Calif.

[21] Appl. No.: 511,842

[22] Filed: Apr. 20, 1990

Related U.S. Application Data

[63] Continuation of Ser. No. 172,264, Mar. 23, 1988, abandoned.

[51] Int. Cl.[5] ..... A61G 7/06

[52] U.S. Cl. ..... 5/62; 5/63; 5/66; 5/185; 5/430; 5/453; 5/455; 5/503; 5/505

[58] Field of Search ..... 5/62, 63, 66–69; 269/323–325

[56] References Cited

U.S. PATENT DOCUMENTS

| | | | |
|---|---|---|---|
| 2,217,783 | 10/1940 | Bell | 269/325 |
| 2,707,137 | 4/1955 | Hollstein | 5/63 X |
| 3,220,020 | 11/1965 | Nelson . | |
| 3,220,024 | 11/1965 | Nelson . | |
| 3,434,165 | 3/1969 | Keane . | |
| 3,462,772 | 8/1969 | Morrison . | |
| 3,608,102 | 7/1971 | Goodman . | |
| 3,611,452 | 10/1971 | Turko et al. . | |
| 3,611,453 | 10/1971 | Lukken . | |
| 3,644,945 | 2/1972 | Goodman et al. . | |
| 3,678,519 | 7/1972 | Szucs . | |
| 3,724,003 | 4/1973 | Ellwanger et al. . | |
| 3,724,004 | 4/1973 | Behrens . | |
| 3,733,623 | 5/1973 | Croxton . | |
| 3,754,749 | 8/1973 | Lyon et al. | 269/325 |
| 3,868,103 | 2/1975 | Pageot et al. | 5/66 X |
| 3,893,193 | 7/1975 | Blair . | |
| 3,900,906 | 8/1975 | Berthelsen . | |
| 3,997,926 | 12/1976 | England . | |
| 4,025,972 | 5/1977 | Adams et al. . | |
| 4,099,276 | 7/1978 | Hunt et al. . | |
| 4,193,149 | 3/1980 | Welch | 5/447 |
| 4,224,706 | 9/1980 | Young et al. . | |
| 4,225,989 | 10/1980 | Pertchik . | |
| 4,255,824 | 3/1981 | Corbett et al. . | |
| 4,356,577 | 11/1982 | Taylor et al. . | |
| 4,371,996 | 2/1983 | Nahum . | |

(List continued on next page.)

FOREIGN PATENT DOCUMENTS 523334 7/1940 United Kingdom ..... 5/68

OTHER PUBLICATIONS

Daly et al., "the Effect of Pressure Loading on the Blood Flow Rate in Human Skin" pp. 69–76, Bedsore Biomechanics, Aug. 1975.

(List continued on next page.)

*Primary Examiner*—Michael F. Trettel

*Attorney, Agent, or Firm*—Flehr, Hohbach, Test, Albritton & Herbert

[57] ABSTRACT

A system providing universal support for patients includes an articulated platform supported by a universal joint supported by a pair of hydraulic support arms, and by a pair of lesser hydraulic arms spaced from the universal joint. The platform is comprised of a plurality of relatively hinged panels which are also hydraulically driven. Thus, the platform is capatle of assuming a large number of configurations, including full sitting and standing positions. A patient cushion system includes a large plurality of cushions which are individually or severally controlled throgh a valve and manifold system which is computer controlled for cycling cushion pressures between high and low pressures. The sides of the bed platform have restraining members which may be lowered and hinged in toward the patient to provide access to the patient. These restraining members also provide for supplemental support of such things as a canopy or tension weight. Further, a pendulum arm is attachable to the side restraint member for supporting auxiliary equipemnt in an upright position regardless of the orientation of the bed. A sanitary system is incorporated in the cushion system to provide cleansing and removal of bodily wastes. Finally, an extraordinary restraint system, also operable by the cushion system may be provided over the top of the patient to further restrain a patient.

28 Claims, 36 Drawing Sheets

U.S. PATENT DOCUMENTS

| | | | |
|---|---|---|---|
| 4,371,997 | 2/1983 | Mattson . | |
| 4,494,260 | 1/1985 | Olds et al. | 5/446 |
| 4,525,885 | 7/1985 | Hunt et al. . | |
| 4,534,078 | 8/1985 | Viesturs et al. . | |
| 4,572,493 | 2/1986 | Hubert | 269/325 |
| 4,685,159 | 8/1987 | Oetiker | 5/62 X |

OTHER PUBLICATIONS

Danzer et al., "Determination of the Capillary Blood Pressure in Man with the Micro-Capillary Tonometer" pp. 164, 165, American Journal of Physiology vol. 52, No. 1.

Landis, "Micro-Injection Studies of Capillary Blood Pressure in Human Skin" publication & date unknown.

"Bye-Bye Decubiti" advertisement for pneumatic cushions and mattresses.

Support Systems International, Clinitron Air Fluidized Therapy, Flexicair Low Air Loss Therapy, advertisements.

Le et al., "An In-Depth Look at Pressure Sores Using Monolithic Silicon Pressure Sensors", Plastic Reconstructive Surgery Dec. 1984, pp. 745-754.

Husain, "An Experimental Study of Some Pressure Effects on Tissues with Reference to the Bed Sore Problem", J. Path. Bact. vol. 66, 1953, pp. 347-358.

Kosiak, "Etiology and Pathology of Ischemic Ulcers", Archives of Physical Medicine Rehabilitation, Feb. 1959, pp. 62-69.

Kosiak, "The Etiology of Decubitus Ulcers", Archives of Physical Medicine Rehabilitation, Jan. 1961 pp. 19-28.

Scales, "Air Support Systems for the Prevention of Bed Sores" pp. 259-267.

"The Effectiveness of Air Flotation Beds", Care Science and Practice, Nov. 1984 2 pages.

Exton-Smith et al., "Use of the Air Wave System to Prevent Pressure Sores in Hospital", The Lancet, Jun. 5, 1982 pp. 1288-1290.

Agris et al., "Pressure Ulcers & Prevention and Treatment" Clinical Symposia, CIBA, vol. 31, No. 5, 1979, pp. 2-9.

Meer, "The Tissue Therapist's Guide to Understanding Skin Destruction", Hospitals & Healthcare Intl., Sep./Oct. '83, 2 pages.

Guyton, M. D. "The Body Fluids and Kidneys", Textbook of Medical Physiology, 7th Edition, W. B. Saunders Co., p. 354, 1986.

Stewart, "Why 32!", Pressure Ulcer Forum, vol. 2, No. 2 Spring 1987 Gaymar Ind. pp. 1-2.

Hargest, "Problems of Patient Support: The Air Fluidized Bed as a Solution", pp. 269-275.

PATIENT SUPPORT SYSTEM

This is a continuation of application Ser. No. 07/172,264 filed 03/23/88, now abandoned which is incorporated herein by reference.

FIELD OF THE INVENTION

This invention relates to beds, and more particularly, to beds providing adjustment of the position and support of a person recumbent on the bed.

BACKGROUND OF THE INVENTION

Healthy people typically spend approximately one third of their time sleeping. People of what may be considered less than optimum health spend greater amounts of time reclining. Beds of various forms have been developed in order to provide comfort to the user. This is particularly true of patients in hospitals and health care facilities, as well as those in homes who, for various reasons, are bed ridden.

Once one is in bed for extended periods of time in a situation or condition which does not allow movement in order to maintain comfort, complications may develop. This is typically in the form of what are generally referred to as bed or pressure sores, or more specifically referred to as decubitus ulcers.

When a person is lying in a fixed position, the weight of the person as carried by the person's skeleton presses against the underlying tissue. If this pressure is great enough, the flow of blood to and from the tissue may be cut off. The arterial capillary pressure is generally understood as being about 30 to 35 mm Hg. The venous capillary pressure is about 10 mm Hg.

It has generally been understood that if the maximum pressure on the skin, sometimes referred to as the interstitial skin pressure, is reduced below the arterial capillary pressure the tissue will receive adequate blood flow and bed sores will be prevented. See for instance, Meer, "The Tissue Therapist's Guide to Understanding Skin Destruction", *Hospitals & Healthcare International,* September/October 1983, two pages; "The Body Fluids and Kidneys", *Textbook of Medical Physiology,* Seventh Ed., Edited by Guyton, W. B. Saunders Co., 1986, p. 354; Stewart, "Why 32?", *Pressure Ulcer Forum,* Vol. 2, No. 2, Spring 1987, Gaymar Industries, Inc., pp. 1–2; and Agris et al., "Pressure Ulcers: Prevention and Treatment", *Clinical Symposia,* CIBA, Vol. 31, No. 5, 1979, pp. 2–9.

It will be seen in reviewing these articles that it is widely accepted that bed sores originate at the skin surface and then spread inwardly. This is based on a corresponding understanding that the pressure is at its greatest at the skin surface.

As a result of this general understanding many forms of patient support systems have been developed. This development has taken two general directions. The first is in the area of the framework and platform which supports a cushion or mattress. The other is the form of the cushion positioned on the platform on which the patient is directly supported.

A bed frame which can be moved into various orientations and configurations can alleviate some of the pressure problems discussed above. For instance, a bed which tilts from side to side or from head to toe can be used to change the general skin surface area on which the patient is supported. Other beds variously control the position of the lower legs, upper legs and torso of the patient.

Incorporated with these concepts are the needs of patient-caring personnel, such as nurses, who must be able to gain access to the patient as well as manipulate the patient for entry onto and exit from the bed or for treatment while in the bed.

Examples of known beds which provide a framework or support which permits manipulation of the bed platforms include the following U.S. Pat. Nos.: 3,220,020 to Nelson for "Adjustable Height Bed"; 3,434,165 to Keane for "Hospital Bed"; 3,462,772 to Morrison for "Center-Pivoting Bed"; 3,611,452 to Turko et al. for "Invalid Bed Construction"; 3,611,453 to Lokken for "Invalid Bed and Tilt Actuating Mechanism"; 3,644,945 to Goodman et al. for "Adjustable Beds"; 3,678,519 to Szucs for "Hospital Bed"; 3,724,004 to Behrens for "Adjustable Bed"; 3,733,623 to Croxton for "Hospital Beds"; 3,900,906 to Berthelsen for "Adjustable Bed"; 3,997,926 to England for "Bed with Automatic Tilting Occupant Support"; 4,025,972 to Adams et al. for "Elevating and Trendelenburg Mechanism for an Adjustable Bed"; 4,099,276 to Hunt et al. for "Support Appliances Having Articulated Sections"; 4,356,577 to Taylor et al. for "Multipositional Medical Bed"; and 4,371,996 to Nahum for "Articulated Bed".

A review of these references discloses generally complex mechanical structures used to provide the desired functions. This mechanical structure prevents the bed from being sufficiently manipulatable to achieve all orientations desired. A more versatile design is disclosed by Berthelsen in the '906 patent. In this patent, the bed platform is described as being supported centrally on a universal joint having a multilegged support. Four hydraulic arms spaced from the universal joint provide pivoting about two axes intersecting at the universal joint. Suggestion is also made that the central frame supporting the universal joint could be built on an intermediate frame, the elevation of which is adjustable.

This device thus provides a simplified design. However, movement is limited to pivoting about two axes to vary the pitch and roll of the platform, as well as height adjustment. However, a platform cannot be positioned in all desired orientations. For instance, the bed requires a fixed platform frame. Thus, variations of the platform itself, such as is disclosed by Behrans, are not possible. Further, the platform cannot be positioned in a near vertical orientation, as substantially provided by Keane, England and Taylor et al.

Some of these references also disclose apparatus associated with the bed to restrain a patient while accommodating patient care. A specific example is the guard rail design disclosed by Nelson in U.S. Pat. No. 3,220,024 for "Bed Site Guard Rail". Such guard rails typically consist of a metal tube loop positioned vertically on the side of the bed and structured to swing down when a lock is released. Such devices do not facilitate the attachment of patient treatment apparatus. Separate support stands or specially designed beds must then be used. Such rails also do not permit the patient attendant to approach the patient any more closely than the side of the bed, thereby requiring the attendant to bend over the bed to reach the patient, putting a strain on the back of the attendant.

Regarding cushioning systems, the main focus of commercial or other known conventional beds has been to provide either a uniform low pressure surface or an alternating pressure system. A uniform system is provided by what is referred to as an air fluidized bed such as are sold commercially under the names Clinitron by Support Systems International, Inc. of Charleston, S.C. and Skytron of Grand Rapids, Mich. These systems are described by Hargest in "Problems of Patient Support: The Air Fluidized Bed as a Solution", pp. 269–275.

A substantially uniform system is provided by what are referred to as high or low air loss bed systems. See for instance the article by Scales entitled "Air Support Systems for the Prevention of Bed Sores", pp. 259–267. Such beds are sold under the name Mediscus Products Limited of Wareham, England and are described further in U.S. Pat. No. 4,525,885 for "Support Appliance for Mounting on a Standard Hospital Bed". Other similar commercial products are sold under the name Flexicair by Support Systems International, and by Kinetic Concepts, Inc. under the name KinAir and recently, a company called Airplus. These beds typically have a plurality of sets of air sacs, each set corresponding to a longitudinal section of a patient's body. The air is pumped through a pressure-compensating valve into the sacs to achieve a desired pressure. On some units the air bleeds through the fabric of the sacs to keep the patient's skin dry. This system is also described in U.S. Pat. No. 4,525,885 issued to Hunt et al. for "Support Appliance for Mounting on a Standard Hospital Bed", assigned to Mediscus Products Limited.

A test and comparison of the fluidized bed support system and the low air loss bed system is presented in "The Effectiveness of Air Flotation Beds", *Care Science and Practice,* November 1984, two pages. This study shows that both systems provide a range of pressures between 15 and 32 mm Hg. Thus, an overall, uniform low pressure is maintained.

A third common type of system which has recently been developed is what is referred to as an alternating pressure system. This system generally consists of two layers of air cells which typically extend the length or width of the bed. In such a system referred to as a large cell ripple mattress, the lower layer is maintained at a constant pressure with alternate cells in the upper layer being inflated. Periodically, the other set of alternate cells are inflated and the original set deflated.

A more recent variety provides an intermediate form of cycling in that the cells are pressurized to varying degrees, with the pressure of inflation shifting periodically down the length of the bed one cell at a time. Thus, an air wave of very low frequency is produced. This air wave is produced in both upper and lower layers of cells with vertically aligned cells being inflated a like amount. This system is described in U.S. Pat. No. 4,225,989 issued to Corbett et al. for "Beds and Mattresses", and is compared to the alternating pressure large cell ripple mattress in Exton-Smith et al., "Use of the 'Air Wave System' to Prevent Pressure Sores in Hospital", *The Lancet,* June 5, 1982, pp. 1288–1290. This study was qualitative in nature and found the air wave system more effective, but one which did not eliminate the development of bed sores once they had started.

There are four companies producing vinyl overlay mattresses which variously provide alternating pressure with two alternating circuits of pressure cells. Grant of Stamford, Conn. uses longitudinal cells the length of the mattress. NOVA Health Systems, Inc. of South Easton, Mass. uses lateral cells. Gaymar of Orchard Park, N.Y. and Huntleigh Technology of Manalapan, N.J. use lateral sets of oval cells. Each circuit of pressure cells has the same pressure throughout at any given time.

A simplified air wave system is described in U.S. Pat. No. 4,225,989 issued to Corbett et al. for "Inflatable Supports". The mattress disclosed in this design has a rippling effect produced in the upper layer, with the lower layer a single uniform cell.

Other representative proposed systems are disclosed in the following U.S. Pat. Nos.: 3,893,198 to Blair for "Mattress for Preventing Bedsores"; 4,224,706 to Young et al. for "Pneumatic Bed"; 4,255,824 to Pertchik for "Cushion for Decubitus Ulcers"; 4,371,997 to Mattson for "Adjustable Firmness Cushion with Multiple Layered Foam-Filled Compartments": 4,494,260 to Olds et al. for "Body Support": and 4,534,078 to Viesturs et al. for "Body Supporting Mattress". These systems disclose generally uniform support surfaces, pressure isolating cell design, or mechanical pressure cycling.

All of the above patient support systems provide generally uniform support over an entire mattress or at least over broad sections. These systems relieve pressure locally on the skin and fatty tissue but do not relieve pressure deep into the muscle tissue adjacent the bony structures. Further, there is no disclosure of applying pressure at more than the accepted maximum capillary blood pressure of about 32 mm Hg. Even the air wave systems provide general support to areas supported by minimum or maximum inflated air cells. In none of these systems then is there a system that effectively removes the weight from selected body areas that are subject to high pressure or that claims to apply a pressure at the skin surface greater than the maximum capillary blood pressure level.

While the prevailing commercial understanding of tissue trauma does assume that the pressure at the skin surface represents pressures throughout the tissues and that long term even pressure is preferred, clinical research proves the opposite.

In 1953 Husain ("An Experimental Study of Some Pressure Effects on Tissues, with Reference to the Bed-Sore Problem", J. Path. Bact., Vol. 66, 1953, pp. 347-358) established "[s]upport for the modern theory that associates bed sores with initial deep lesions within muscles close to a bony surface or projection is based on two main sources of evidence: (1) pathological studies which have demonstrated muscular lesions long before superficial bed sores appear, or have shown that muscles lesions, recent or old, very often accompany bed sores; (2) experimental investigations into the mode of action of pressure, which have shown the susceptibility of muscle to physical disturbance as contrasted with the relative resistance to skin and to a lesser extent of fat . . . " (pp. 353,356)

Husain concluded:

1. "Pressure evenly distributed over a wide area of the body is much less damaging to the tissues than localized or point pressure." (p. 356)

2. "Low pressure maintained for long periods of time produces more tissue damage than high pressure for short periods." (p. 356)

3. "The time factor is thus more important than pressure intensity." (p. 356)

4. "Histological evidence of muscle damage can be demonstrated in the tissues deep to human bed sores. This appears to be the result of prolonged pressure rather than infection and almost certainly precedes the bed sores." (p. 357)

In 1960 Kosiak ("The Etiology of Decubitus Ulcers", *Archives of Physical Medicine & Rehabilitation,* January, 1961, pp. 19–28) experimented and determined:

1. "The application of alternating pressures, whereby the tissue was completely free of pressure for five minute intervals, showed consistently less change or no change when compared with tissue subjected to an equivalent amount of constant pressure. This was true even at pressures as high as 240 mm Hg. for three hours." (p. 28)

2. "Even when excessive pressures are applied for a sufficient period of time to result in early degenerative changes, it would appear that complete relief of pressure may often permit restoration of circulation and cellular metabolism without ulceration." (p. 28)

3. "Skeletal muscle from both normal and paraplegic rats exhibited a high degree of susceptibility to low constant pressure for relatively short periods of time." (p. 28)

4. "Microscopic pathologic changes in muscle were absent or less prominent following the application of equal amounts of alternating pressures in both normal and paraplegic rats." (p. 28)

During a study conducted at the Stanford University Medical Center, Stanford, Calif. the pressure inside of living tissue between the skin and bony protuberances of subjects was measured, apparently for the first time in history. This study and the conclusions reached are described by Le et al. in "An In-Depth Look at Pressure Sores Using Monolithic Silicon Pressure Sensors", *Plastic and Reconstructive Surgery,* December 1984, pp. 745–754.

"The most significant result from this investigation is that although the surface pressure may stay below the capillary pressure (25–35 mm Hg) the internal pressure may be several (three to five) times greater, which is theoretically large enough to cause pressure sores if unrelieved."

The conclusion of the Stanford study was that the highest pressures observed were adjacent the bone and that the pressure decreased with distance from the bone. Thus, the pressure on the skin was not the highest pressure observed. This is a result similar to the application of a force by a plate having a large surface area (analogous to the skin surface) to one side of the sponge (analogous to body tissue). Another plate with a small surface area (analogous to a bony protuberance) placed against the other side of the sponge resists the application of force. With equal forces on both plates, the pressure per unit area is much higher on the smaller plate. As a result, it was concluded that pressure sores originate near the bone and progress outwardly, eventually reaching the skin. This is contrary to conventional knowledge as described in the article entitled "Decubitus: A Persistent Problem" mentioned above, and does not appear to have received acceptance in the field and is not applied in commercial devices.

On page 753 of the article the authors concluded: "An important inference from this result is that the prevention of pressure sores must entail the removal of the load from the weight-bearing bony prominence rather than merely relief of local pressure at the skin underlying the prominence." The authors further project as an example of the application of their conclusions, that large-scale load removal could be accomplished by periodically dropping either side of a wheel chair seat from under the buttock on that side.

This proposed solution would result in the individual sitting in the wheel chair getting thrown against the arm of the wheel chair on the side from which pressure is removed. Thus, a practical solution of how to actually prevent pressure sores in a commercially viable product has not been designed or conceived. Further, how the application of such a theory would be applied to the much more prevalent bed support system has not heretofore been conceived.

Thus over the past three decades independent research teams have supported the following conclusions relating to bed sores.

1. Pressure within the tissues is not uniform.
2. Pressure is three to five times higher within the tissues than at the skin surface.
3. Muscle tissue which surrounds the bone structure is far more susceptible to damage than fat or skin.
4. Damage deep within the muscle tissue does precede a visible pressure sore at the skin.
5. Low pressure maintained for long periods of time produces more tissue damage than high pressure for short periods.
6. The time factor is thus more important than pressure intensity.

SUMMARY OF THE INVENTION

The present invention overcomes the above limitations of known bed support systems. In an aspect of the present invention, a bed support system is provided which supports a patient while moving the patient in a wide variety of orientations, including sitting and standing positions. Further, the present invention provides access to and restraint of patients, and provides support for treatment apparatus.

The present invention also provides, in addition to the above patient orientations, a set of platform panels which provide both articulation and support in a simplified and easily operated design.

These features are provided by a patient support system comprising a base frame supportable relative to a floor; a platform extending along a longitudinal axis and relative to a platform plane generally parallel to the plane of the torso of a patient disposed in a supine or prone position relative to the platform along the longitudinal axis; means for supporting the platform relative to the base comprising means for rotating the platform about three axes, characterized in that none of the three axes are perpendicular to the platform plane, at least two of the axes are nonparallel, and the point on a first of the axes which is closest to a second of the other axes is at a spaced location from the point on the first axis which is closest to the third axis. This arrangement of axes enables manipulation of the pitch, roll and distance of the platform relative to the floor with simplified structure. Thus, full patient positioning is provided.

A universal joint is supported by two hydraulic arms, and two direct support hydraulic arms extend between the base and platform in the preferred embodiment. This arrangement establishes the three axes of pivoting of the platform relative to the base mentioned previously: a first axis defined by the connection of the direct support arms to the platform, and second and third axes defined by the U-joint and respective ends of the direct support arms connected to the platform.

Rotation of the platform about the first axis results in movement of the longitudinal axis in a plane, thereby providing pitch control. By having the other two axes intersect at the U-joint and therefore at the plane of longitudinal axis movement, roll is controlled by selective control of the first axis and one or both of the second axes. Elevation control is provided by pivoting about all three axes.

The ends of the direct support arms associated with the base define yet a fourth axis of pivoting which gives even greater amounts of pitch control. By making the direct support arms adjustable in length by hydraulic control, a simple means is provided for providing independent rotation about the second and third axes.

The platform is preferably formed of a series connection of individual panels which are hingedly joined. Each panel is movable relative to an adjacent panel by short hydraulic arms connected at spaced locations below and between each adjacent panel pair to provide leveraged manipulation. This allows each platform panel pair to be manipulated in both a concave and convex orientation as viewed from above. Thus, the platform can be configured into different forms for the convenience and treatment of the patient. In combination with the simple platform support, end panels are thus cantilevered to provide support relative to the base. This results in an even further simplified structure which permits movement of the platform into very diverse positions. This is enhanced by having the U-joint attached to a different panel than the panel to which the direct support arms are attached.

The preferred embodiment also provides the U-joint supported by two upwardly directed, opposing indirect support hydraulic arms which pivot relative to the base about two spaced and parallel axes. These axes provide movement of the U-joint, and therefore the platform, in a plane. When the axes are horizontal, the plane is vertical; when the plane contains the longitudinal axis of the platform, pitch and elevation control are provided. The two pivoting indirect support arms thus add to the elegant simplicity of the present invention.

It will also be seen that the present invention provides a simple support apparatus effectively formed by three support contact points wherein the supports are all length-adjustable arms. This is the minimum number of supports which can provide both lateral and longitudinal stability as well as pitch, roll and elevation adjustment.

A patient lateral retainer system is also provided by the invention to retain patients and supporting cushioning on the supporting platform. Associated with this are means for changing the platform surface laterally. In the preferred embodiment, these are provided by a retainer or guard member mounted vertically at the side or edge of the platform and an extension of the platform hingedly attached to the main platform. The retainer member is attached to the distal edge of the extension. When the extension is unlatched, it drops down pulling the member downwardly and inwardly toward the patient. An associated side cushion is concurrently deflated, thereby allowing an attendant to step in closer to a patient. Further, the retainer member may be slid down to a position in which its top edge is flush with the platform, removing it completely below the level of the cushions. Thus, simple means are provided for reducing the width of the bed to provide access to patients by attendants. The bed is then simply extended again to provide a broad platform for supporting a patient in a manner providing ample space plus cushioned restraint. Lowering of the guard member permits access to the patient without side rails to get over.

Further, means are provided for attaching an apparatus support member for accessory equipment, such as I.V. bottles, patient canopy or traction bar. The support member is pivotable to provide positioning in different orientations relative to the retainer member. The support arm may be in the form of a pendulum arm whereby the attached accessory is maintained in an upright position regardless of the position of the associated retainer member. Also, the support member may be fixable in relative position to provide rigid supports at desired orientations. Support members on opposite sides of the platform may be joined to form a bridge for supporting traction equipment or a canopy.

A cushion inflation system and method are also provided which provide selective control of support pressures over well defined areas or parts of the body, and cycling of the pressures over a range which varies from a value substantially greater than accepted capillary pressure values to a value that is minimized to the lowest possible pressure to assure effective removal of pressure on each critical support surface area of the body.

In the preferred embodiment, a plurality of cushion cells having surface areas inversely proportional to the expected patient support pressure are disposed as an upper layer. A lower layer of general support cushions are also provided on each platform support panel.

Positive and negative air pressures, relative to the ambient pressure, are applied cyclically to the cushion cells in a manner to provide alternating periods of very high pressure and very low pressure at the body parts normally subjected to high pressures. The use of a negative pressure source provides an expedient way to deflate positively inflated bladders. The effective removal of pressure for selected periods of time allows blood flow to take place at each body part. A dual duct system provides selective connection of each cushion to either the positive or negative air supply. A valve having a core rotatable relative to a sleeve, each with alignable bores or holes to provide coupling between the supply and the selected chamber or chambers provides a simple means for controlling air pressure in a plurality of sets of bladders with a single valve.

In a preferred embodiment, four apertures exist in the core to provide elective communication between the positive and negative pressure sources and two sets of bladders. Simple rotation of the core to align the apertures with openings in a surrounding sleeve results in the desired communication. Variations in bladder set controls are also simply provided by making the core and sleeve of each valve replaceable with a core and sleeve providing different communication, such as to two sets simultaneously.

Channels preferably extend through the platform for coupling bladder sets in the mattress with each associated valve. This reduces the need for separate hoses to make the same connections. The platform is preferably formed of panels, each having the same channels so that the platforms are interchangeable, thereby facilitating manufacture and maintenance.

The valves are also preferably mounted in series along the platform so that a single feed from each of the pressurized air sources serves the entire mattress. Air passageway junctions allow for the placement of valves laterally of the serial set of valves, thereby increasing the density of valves on the platform.

The preferred form of platform support panel includes integral closed channels with exits on the surface associatable with selected cushion cells. Inlets to the channels are directly couplable to the valves for coupling with the air supplies.

The present invention also provides a built-in sanitary disposal facility which provides for ease of use by the patient, ease of cleaning and simplified disposal of the affected facility. In the preferred form, this includes a liner which extends through a mattress passageway having an outlet coupled to a drain hole in the platform support panel and is itself supported by inflated cushion bladders. The liner includes conduits for conducting warm air and water supplies for washing and drying the affected areas of the patient and sanitary liner. As a particular feature of the apparatus, an inflatable arm in the form of a water tube is extendable in the region of the passageway to position the water nozzle in the desired area during use.

A waste receptacle is also provided which allows a urine sample to be taken simply as part of the sanitation disposal process. This is preferably provided by a small tube mounted on the side of the liner with an opening directed upwardly. The small tube leads to a separate waste compartment of the general waste receptacle.

Further, the present invention takes advantage of the resident controlled inflation system to provide a patient restraint system which holds the patient securely in a desired position without the use of abrasive and circulation impeding straps. Such a system in its preferred embodiment uses selectively inflatable air cells or cushions securely attachable to the bed platform frame and which are formed to cover selected regions of the patient. These cushions are anchored by straps which are attached for quick release to side guard members. They are also preferably supported on side restraint cushions to provide the patient with unrestricted mattress support. The amount of restraint is controllable by the amount of air pressure applied to the cushions. Further, layers of cushions may be applied to conform to specific positions of the patient.

It can be seen that such a system provides a universal patient care and support facility which provides for moving a patient into substantially any generally recumbent position for treatment and patient comfort. A specific alternating high and low pressure cushioning system prevents and aids in the cure of bed sores. Supplemental features of easily applied patient restraint and accessory support, as well as convenient sanitary cleansing and disposal make the patient support system generally universally applicable to a large variety of patient care situations.

These and other features and advantages of the present invention will become apparent from a review of the accompanying drawings and the following detailed description of the preferred embodiment.

DETAILED DESCRIPTION OF THE PREFERRED EMBODIMENT

General Description

Figure 1:
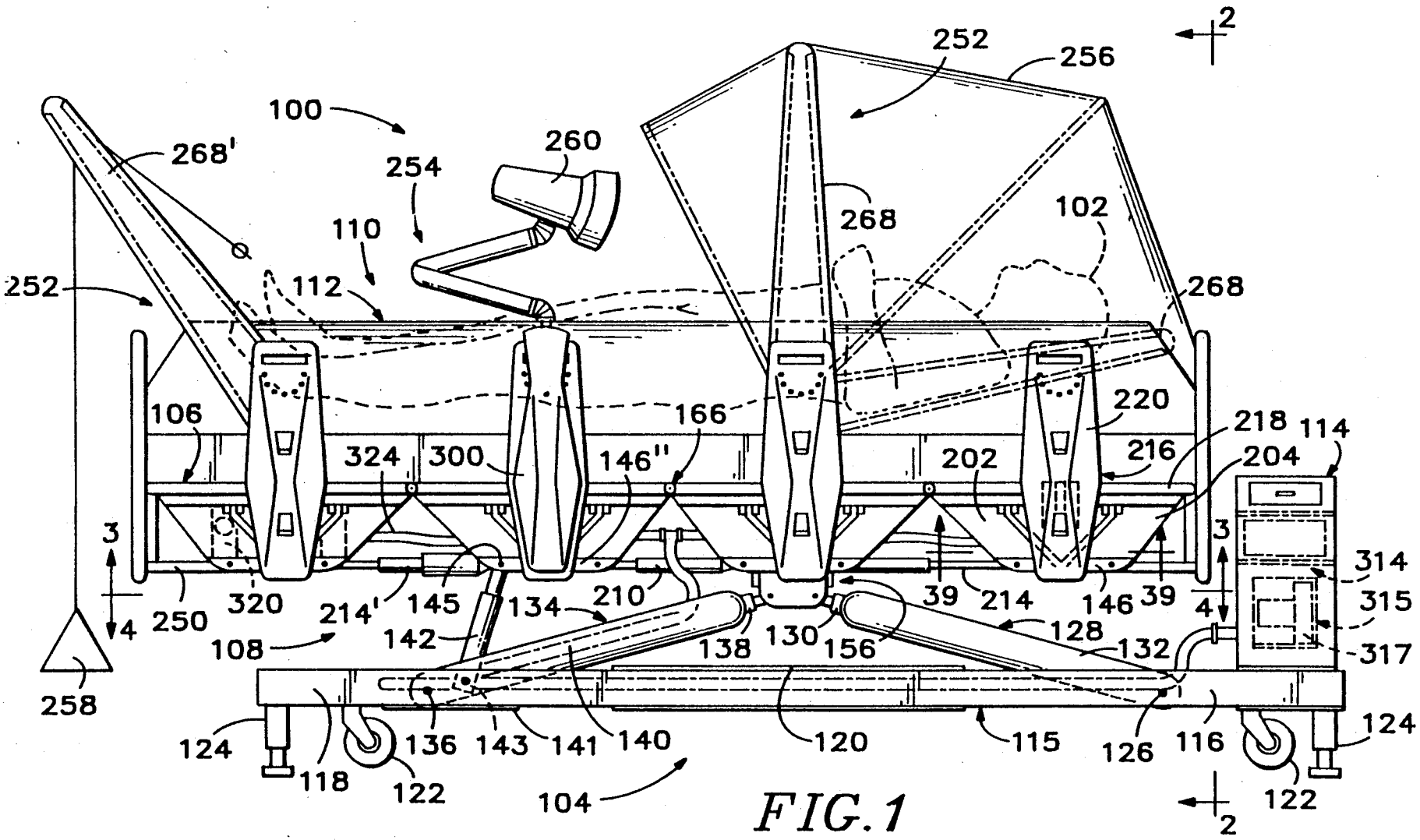
FIG. 1 is a side view showing a patient support system made according to the present invention.

Referring initially to FIGS. 1–5, a patient support system made according to the present invention is shown generally at 100. A reclining patient 102 is shown in phantom to provide perspective to FIG. 1.

System 100 includes a base frame 104, a patient-supporting platform 106 supported above frame 104 by supporting apparatus 108. A patient-cushioning system 110, to be described subsequently in further detail, comprises an inflatable mattress 112. An equipment housing 114 is mounted on an end of frame 104. Supporting equipment and control apparatus for system 100 is mounted in this housing. In the following discussion, some items of identical construction are given the same reference number but distinguished by the use of the prime symbol: '.

Articulated Bed

Frame 104 comprises a generally X-shaped frame 115 having four legs 116, 117, 118 and 119 extending radially from a central brace plate 120. A cross plate 141 extends between legs 118 and 119, as shown. Mounted under the distal ends of the legs are wheels 122 for allowing system 100 to be rolled around on a floor. When the system is in a desired position, an adjustable-length foot 124 located adjacent each wheel is extended to raise the frame and wheels off of the floor to prevent further movement of the system. During movement of the system, these feet are retracted.

Supporting apparatus 108 is shown in the detail of the preferred embodiment in FIGS. 1–4. It is also shown in simplified form in FIG. 5 as a perspective view to make the structural relationships and operation of the key features easier to understand.

A first hydraulic support 128 is mounted on heavy duty bearing mountings, such as mounting 125, for pivoting about an axis 126 extending intermediately through associated legs 116 and 117, adjacent control station 112 (referred to as the head end of the system). An arm 130 extends upwardly out of a covering 132 for enclosing the base structure associated with arm 130. As will be seen, the arm is adjustable in length to different lengths relative to axis 126.

A similar second hydraulic support 134 is mounted between the two legs 118 and 119 at the foot end of the system for pivoting about an axis 136 parallel with axis 126. Axes 126 and 136 are also referred to as first and second parallel axes. Support 134 also includes a length-adjustable arm 138 and a covering 140.

Extending through covering 140 are two spaced and smaller hydraulically operable arms 142 and 144 mounted at their lower ends to support 134 for pivoting about an axis 143, parallel with axes 126 and 136. Each of these three axes is also referred to as a fourth axis parallel to a first axis. These arms may also be mounted directly to plate 141 extending between frame legs 118 and 119. The upper ends of arms 142 and 144 are mounted for rotation with universal mountings to a support plate 146 mounted on the underside of platform 106. The upper ends of arms 142 and 144 thus define an axis 145 of rotation of platform 106 when the lengths of these arms are held fixed. Axis 145 is also referred to as a first of three axes about which the platform is pivoted relative to the frame. Channels 148 and 150 extend in covering 140 to accommodate arms 142 and 144 during manipulation of platform 106, as is illustrated in FIGS. 12–17, discussed below.

Figure 13:
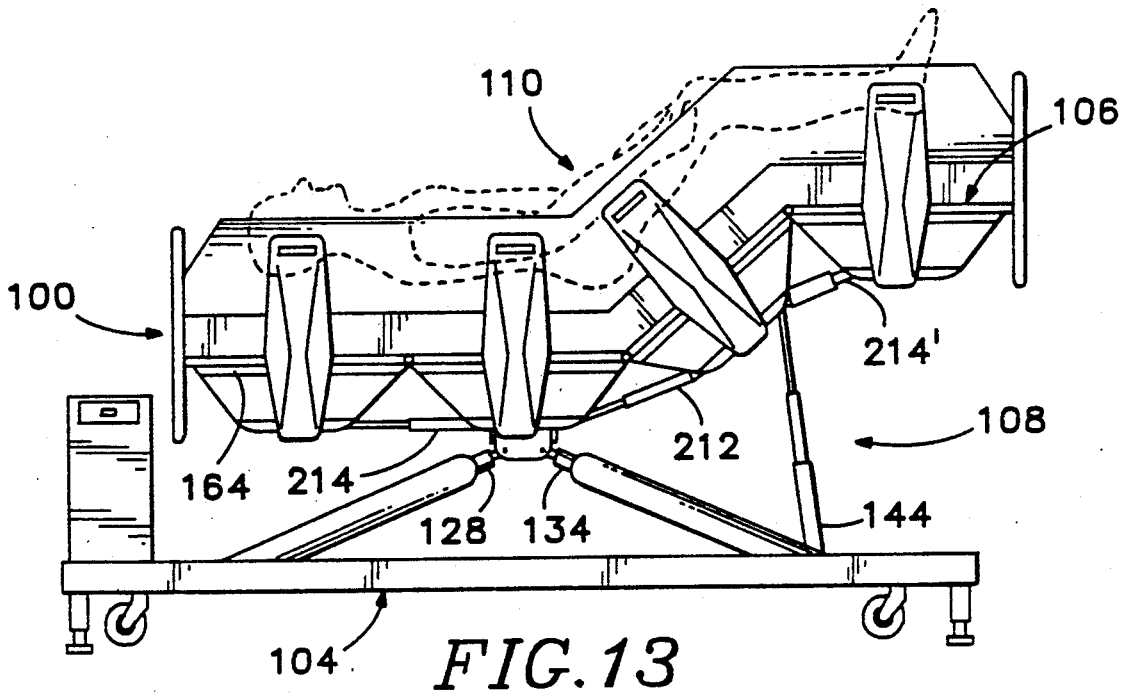
Figure 14:
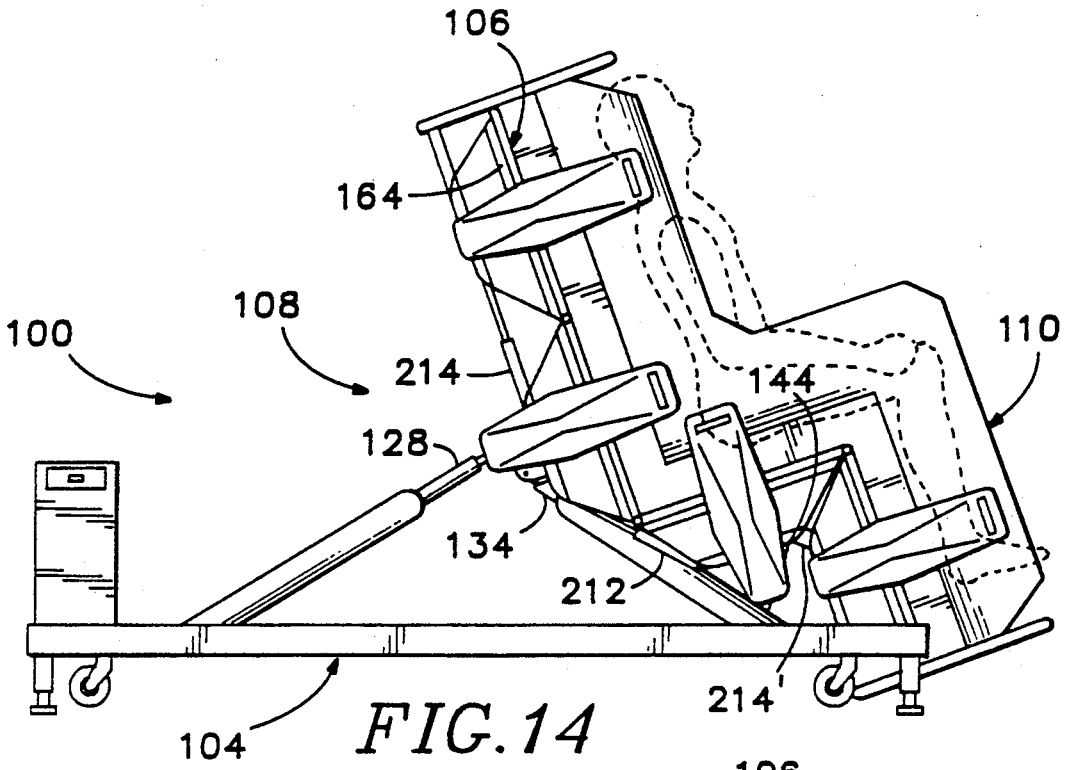
Figure 16:
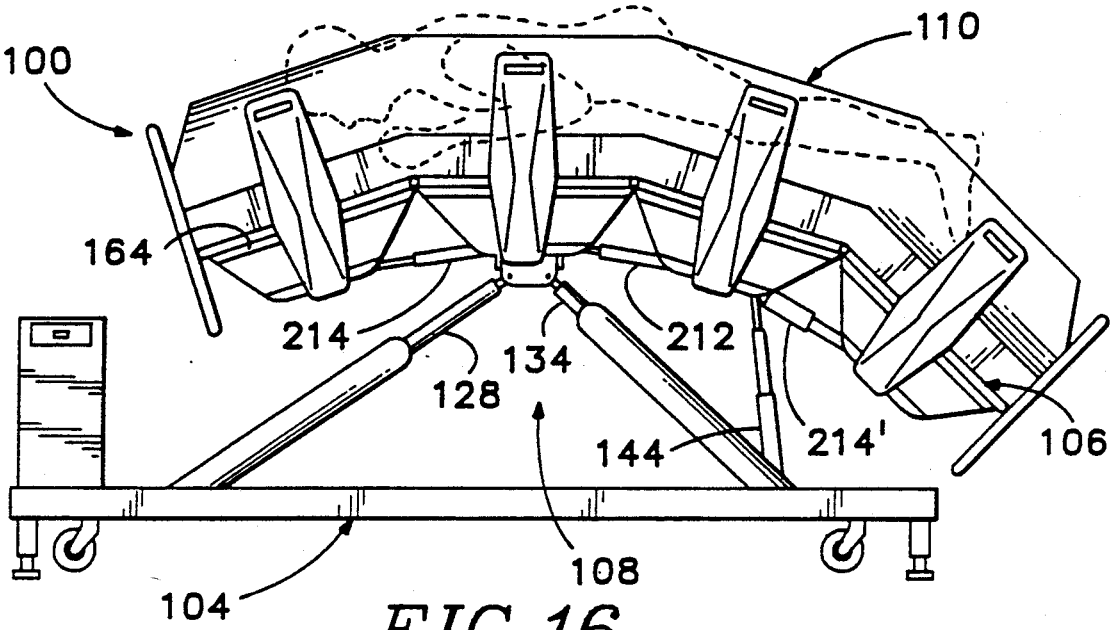

In FIGS. 1–4 the entire platform is planar and generally parallel to the plane of the torso of a person lying in a supine or prone position on the platform. In a general sense, the plane of the platform is considered herein to extend generally along the platform, contain the longitudinal axis of the platform, and be generally parallel to the torso of a person disposed in a supine or prone position on the platform. Thus, in FIG. 5, platform 106 also represents the plane of the platform in this simplified view. When the platform is in nonplanar configurations as shown in FIGS. 13, 14 and 16, the plane of the platform is considered to be the plane of the panel adjacent the torso of the person supported thereon.

Figure 6:
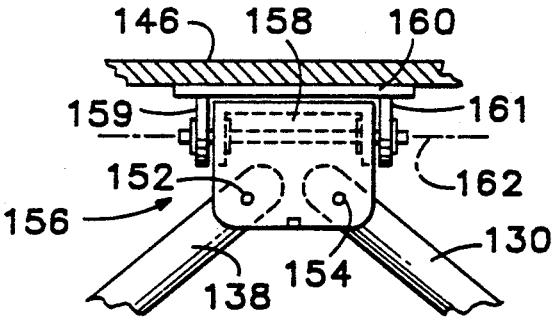
FIG. 6 is an enlarged fragmentary view of the universal support joint of FIG. 1.
Figure 7:
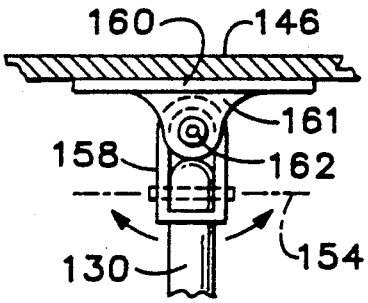
FIG. 7 is a view of the joint of FIG. 6 taken from the right side of that figure.
Figure 8:
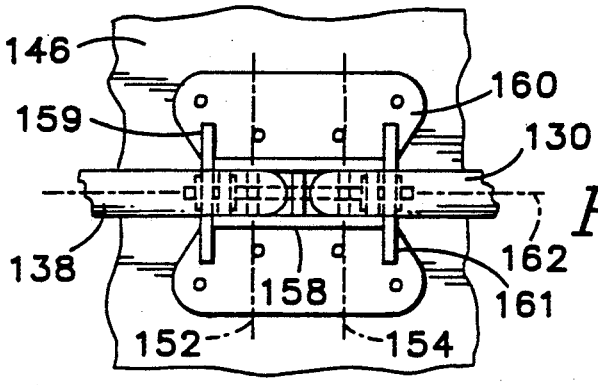
FIG. 8 is a view of the joint of FIG. 6 taken from the bottom of that figure.

The upper ends of arms 130 and 138 are pivotally connected for pivoting about parallel axes 152 and 154 at a universal joint 156, shown particularly in FIGS. 6–8. Axes 152 and 154 extent laterally of system 100. A housing 158 carries the joints for forming the universal joint which also includes a base plate 160 mounted to a support plate 146. A pair of end plates 159 and 161 are mounted to plate 160 as shown for pivoting of housing 158 about an axis 162 orthogonal to axes 152 and 154 when viewed in a horizontal plane with the platform disposed horizontally, as shown in FIGS. 6–8. As used in this application, two axes, such as axes 162 and 152 or 154, are considered to intersect if the closest distance between them is substantially less than an object being moved about them, such as platform 106.

It will be seen that by holding arms 130, 138 and 142 fixed in length, and changing the length of arm, 144, the platform is caused to rotate about an axis 165 defined by U-joint 156 and the upper end of arm 142. Similarly, an axis 167 is defined by the upper end of arm 144 and U-joint 156. These axes intersect axis 145 defined by the upper mountings of arms 142 and 144. Axes 165 and 167 are also referred to as second and third axes associated with first axis 145 about which the platform is pivoted relative to the frame.

It will be appreciated that the various hydraulic arms and pivot joints can be provided by other structures. For instance, the arms can be replaced with mechanical linkages, lever arms, worm gears and the like. Axis pivoting can also be provided by motor drives, hinges, rollers and similar devices.

Figure 3:
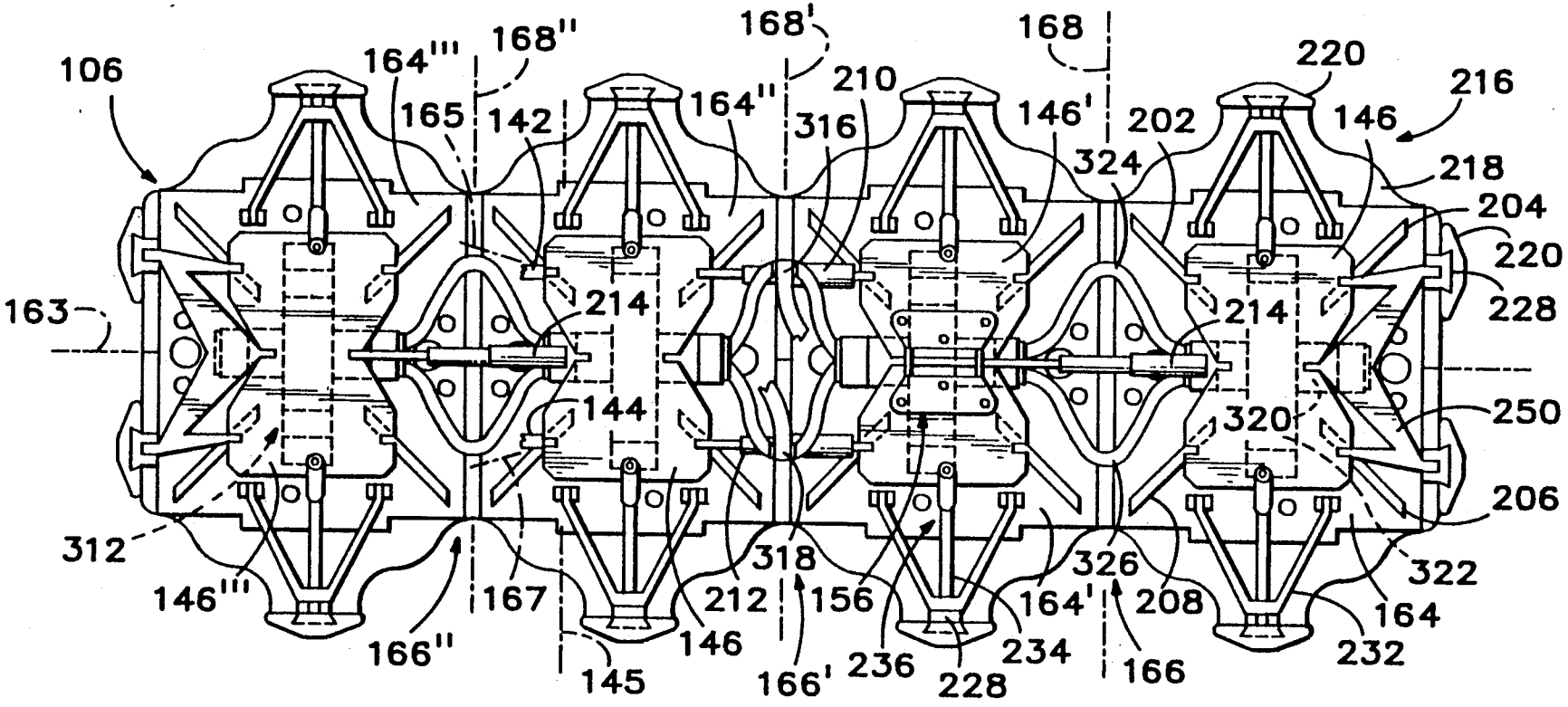
FIG. 3 is a bottom view taken along line 3—3 of FIG. 1.
Figure 4:
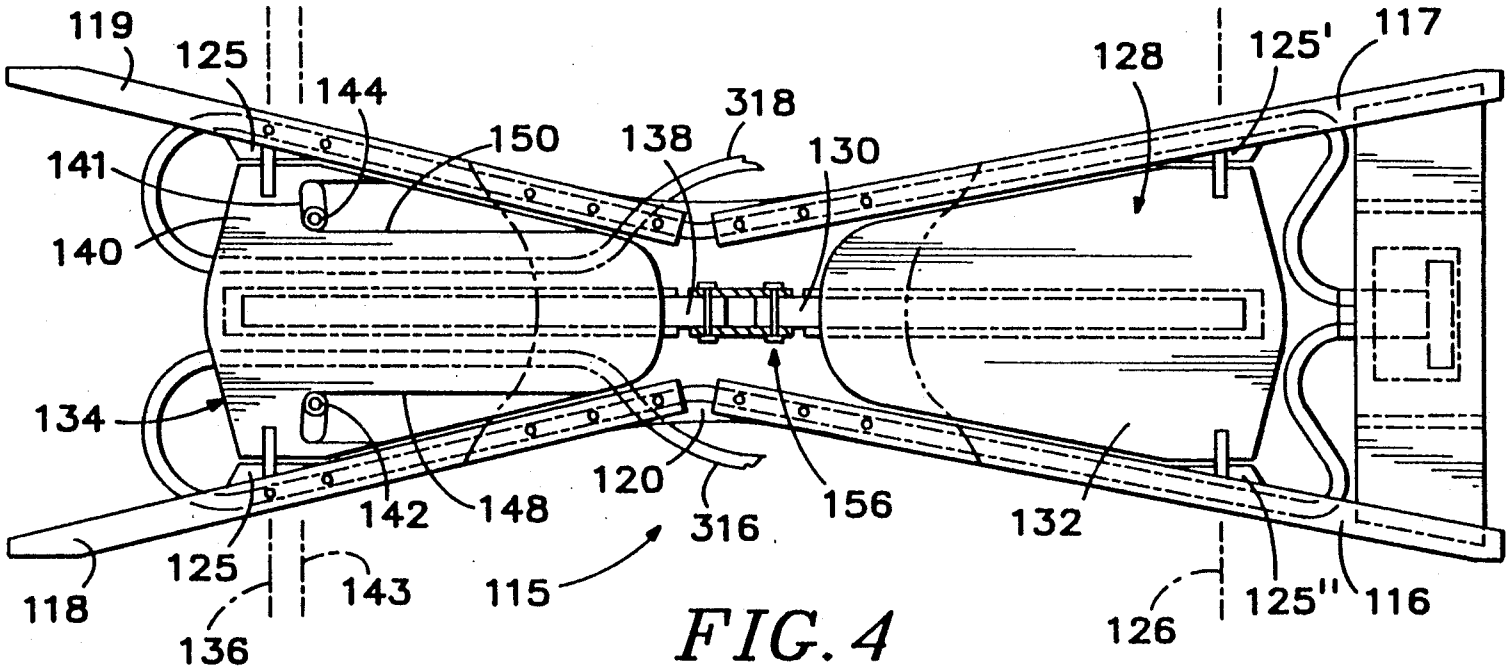
FIG. 4 is a top view of the base frame of FIG. 1 taken along line 4—4 in that figure.
Figure 5:
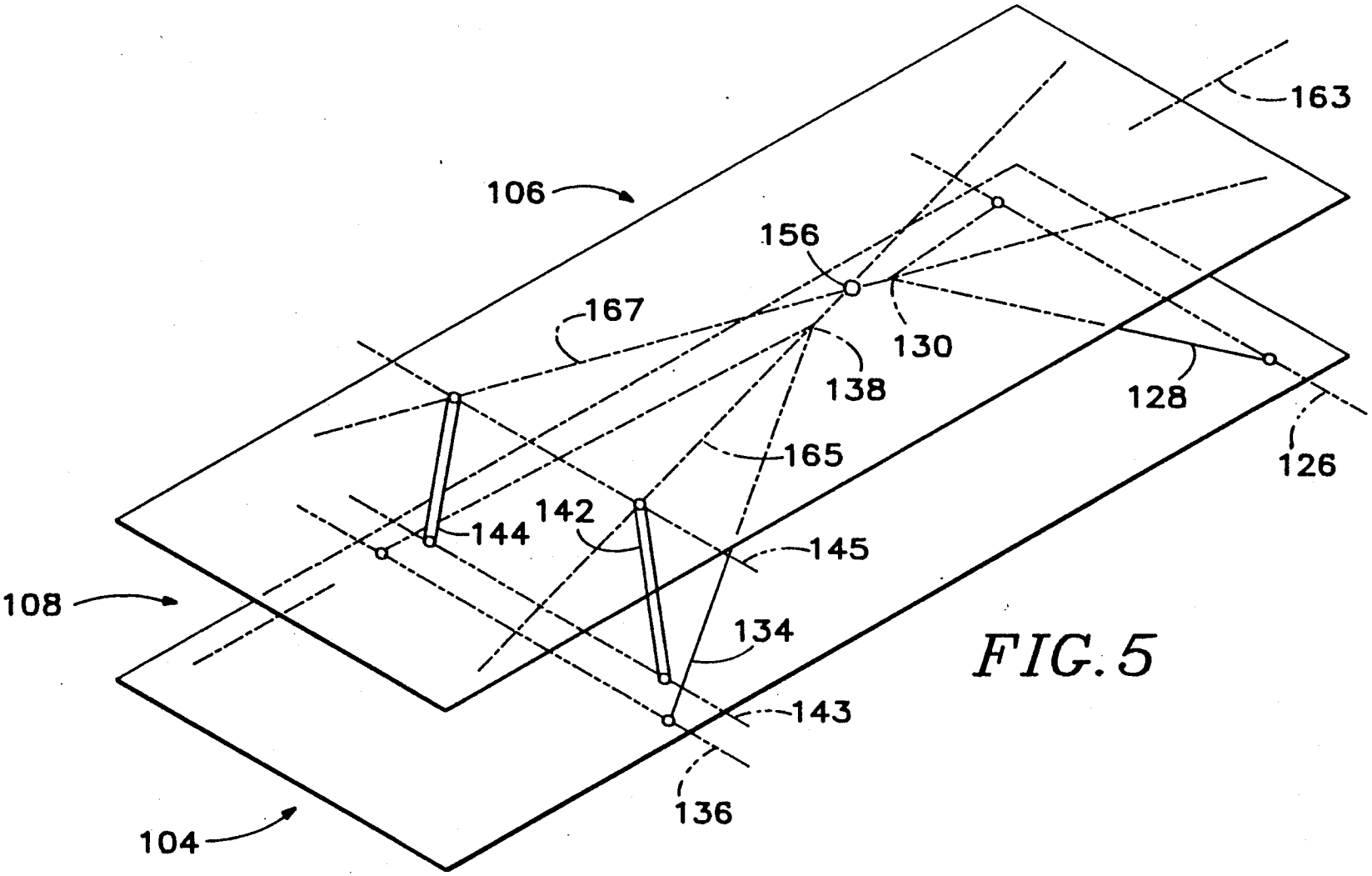
FIG. 5 is a simplified structural schematic illustrating operation of the supporting apparatus of the system of FIGS. 1-4.

Referring in particular to FIG. 3, platform 106 is disposed along what may be considered its longitudinal axis 163 and includes a plurality of planar support panels 164 joined in series. These panels are preferably made of a strong rigid material such as a suitable metal, plastic or wood. Although they are shown as being planar, they can be made in any desirable form and considered to be disposed in a plane. A joint 166 disposed between each pair of adjacent panels allows the joined panels to pivot about axes 168 which are parallel to the panels.

Figure 9:
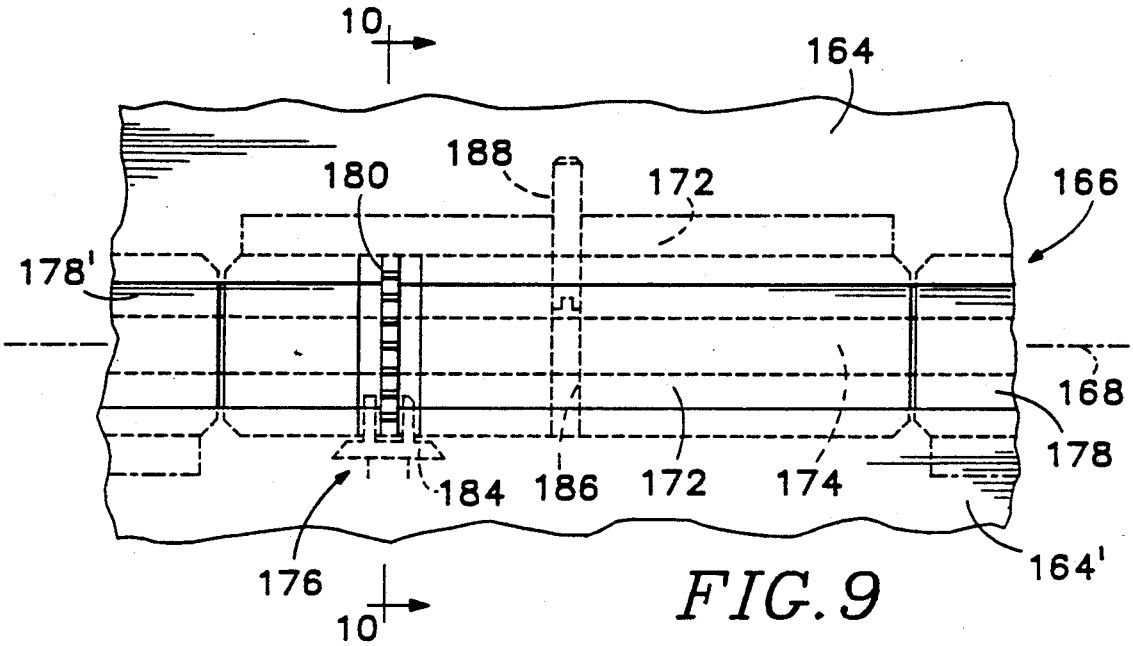
FIG. 9 is an enlarged fragmentary view of a joint between platform support panels of FIG. 1.
Figure 10:
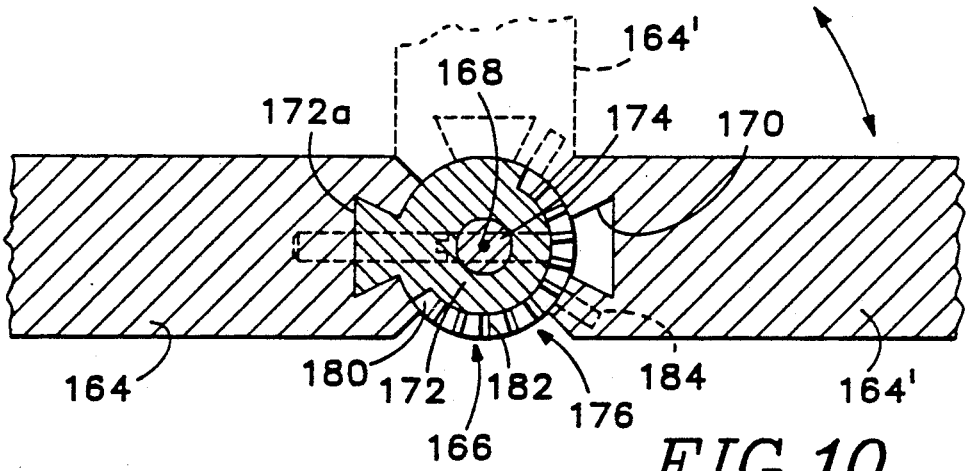
FIG. 10 is a view taken along line 10—10 of FIG. 9.

FIGS. 9 and 10 illustrate in more detail the construction of joints 166. The edge of each panel 164 has a dovetail slot 170 extending along its length. A joint sleeve 172 is generally cylindrical, extends one fourth the length of the panel edge, and has a dovetail insert **172*a* sized to be slidingly received within slot 70. Sleeve 172 rides on a central pin 174 extending the length of the panel edge. Four sleeves are positioned on pin 174 for each joint, with alternate sleeves having inserts, such as insert 172*a***, disposed in slots of opposite panels.

Sleeve 172 has a position-defining apparatus 176 associated with it. The other sleeves, such as sleeve 178 and 178' do not have this apparatus, but are otherwise the same. Cut into the cylindrical portion of sleeve 172 is a partial disk 180 having slits 182 extending radially into it. A photo sensor 184 which is electrically coupled to the controls within equipment housing 114 has a light emitting diode and photo diode. The light path between these diodes extends through disk 180. As one panel 164 is moved relative to another panel 164', the panel movement causes disk 180 to move relative to the adjacent panel 164', and therefore relative to photo sensor 184. Relative movement between the two panels is derived by counting the number of times light passes through successive slits 182. Thus, apparatus 176 provides feedback to the control system for defining, at any given point in time, the approximate angular orientation of adjacent panels. Accuracy of position sensing is proportional to the number of slits 182 in disk 180.

Disposed centrally in each sleeve 172 or 178 is an aperture 186 in which is threadedly mounted a screw 188. This screw is also threaded into associated panel 164 to secure the sleeve relative to the panel. It is noted that the screw must be recessed within aperture 186 sufficiently to allow pin 174 to extend past its end, as shown.

Figure 11:
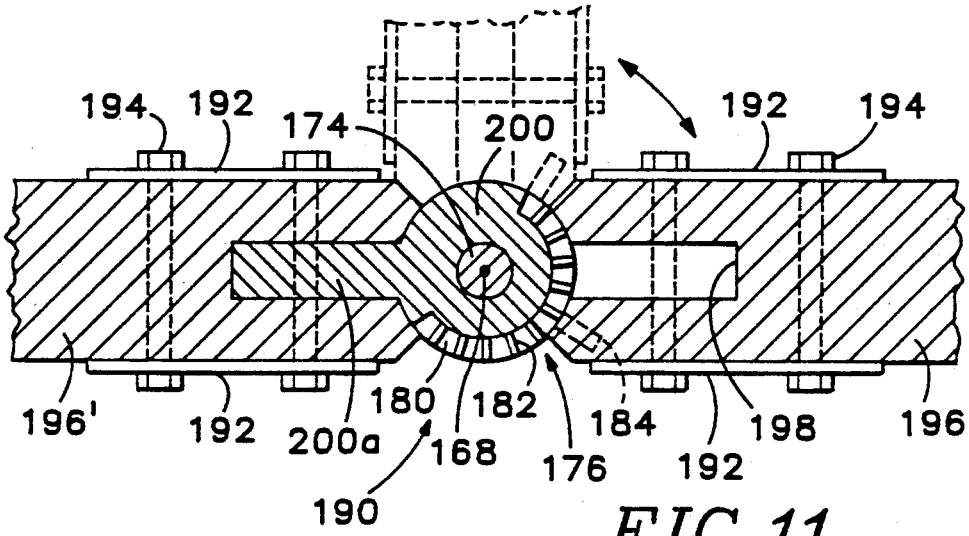
FIG. 11 is a view similar to FIG. 10 of an alternative embodiment of the joint of that figure.

FIG. 11 is a view, similar to the view of FIG. 10, of a second embodiment of a panel joint construction. In this embodiment the panels may be made of a wood or plastic material, which is not as strong as the metal used for the embodiment of FIG. 10. In order to reinforce the joints 190 metal reinforcement plates 192 are mounted by appropriate bolts 194 or other mounting means to the marginal edges of panels 196 and 196'. Plates 192 preferably extend along the length of the associated marginal edges of the panels.

Each panel 196 has a groove or slit 198 extending along the length of its joint edge, as shown. Correspondingly, each sleeve 200 has an extended projection **200*a* which is slidingly received within the corresponding slit 198, in a fashion similar to that described for the embodiment of FIG. 10** and the dovetail connections associated with it. It will be appreciated that other forms of joints may also be made.

Referring again primarily to FIGS. 1 and 3, each panel has mounted to and extending downwardly perpendicularly from it four brace members, such as members 202, 204, 206 and 208. A support plate 146 is mounted on the lower surface of the inside ends of these brace members of each panel. As can be seen support plates 146 all have what may be referred to as a pinched or hourglass-type shape, as shown in FIG. 3.

The two central panels 164' and 164'' are drivingly connected by a pair of hydraulic arms 210 and 212. Support plates 146 are rigidly mounted through corresponding brace members 202, 204, 206 and 208 to associated panel 164. Thus, the two panels are pivoted about axis 168' by uniform lengthening and shortening of arms 210 and 212.

The two external joints associated with axes 168 and 168'', have the associated support plates 146 interconnected by a single hydraulic arm 214 and 214', respectively.

Although hydraulic arms attached at locations spaced from the panels are used to control and move the panels, other structures producing the same result may be used. Any mechanical linkage which provides the same or similar leverage, or even gearing and motors may be used. Further, the panels could be physically separate but caused to move as though hinged to produce the same function or result.

Referring now to FIGS. 12–17, exemplary illustrations are shown of various orientations and positions that platform 106 can take by controlling supporting apparatus 108. That is, the lengths of first and second hydraulic supports 128 and 134 and short support arms 142 and 144 can be varied to control tilting and longitudinal relative orientation of the platform relative to base frame 104. Further, and in coordination therewith, hydraulic arms 210, 212, 214 and 214' are varied to achieve a desired relative orientation between respective panels 164.

Figure 12:
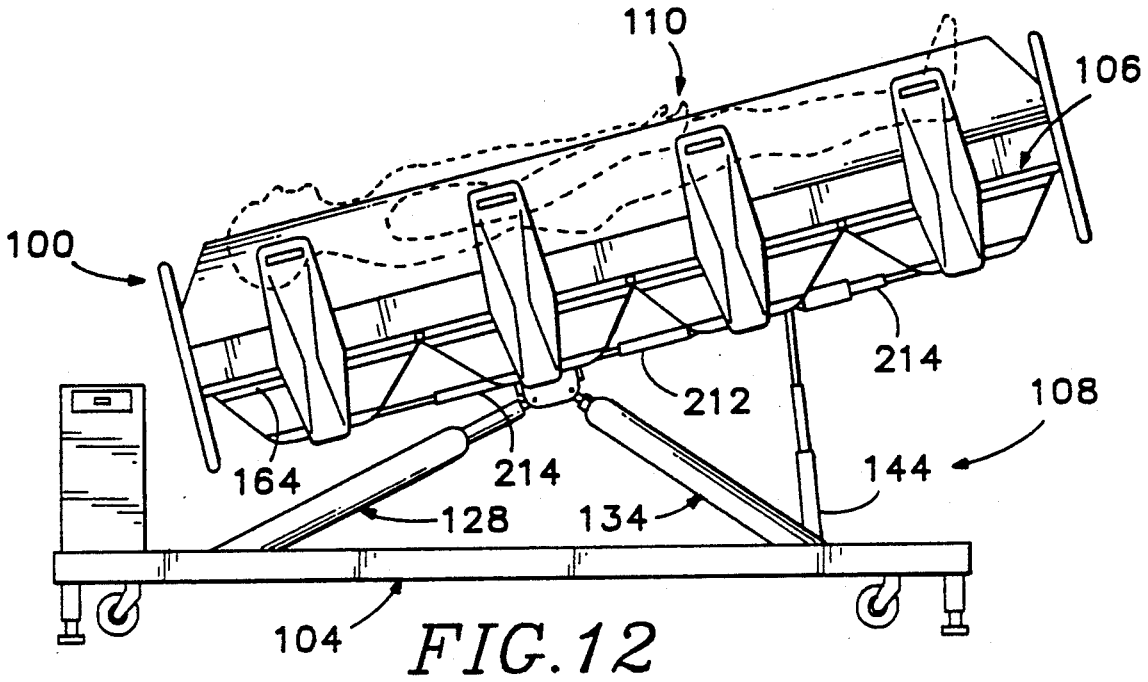
FIGS. 12-17 are reduced views of the system of FIG. 1 showing various platform positions.

In FIG. 12 support arms 142 and 144 have been extended while maintaining the other hydraulic arms in their positions shown in FIG. 1. This results in the foot of platform 106 being raised. In FIG. 13 nearly the same lengths of arms are used for hydraulic supports 128 and 134 and support arms 142 and 144 as in FIG. 12. However, the middle platform joint is flexed to raise the hips and the joint associated with the knees is turned down the opposite direction to compensate for the raise in the panel associated with the thighs. In order to achieve this, hydraulic arms 210 and 212 are lengthened and foot hydraulic arm 214' is shortened.

FIG. 14 shows a configuration which results if the length of support arms 142 and 144 are reduced dramatically, the length of hydraulic support 128 increased slightly and full 90 degree bends at the middle or hip joint and the foot or knee joint, as shown. In this position, hydraulic arm 214' is substantially shortened or, if necessary, one end is disengaged. This position is appropriate for positioning a patient for stepping into or out of the bed from a seated position, or to simply support the patient in that position for comfort and convenience. A full upright sitting position is achieved by extending support 128 further.

Figure 15:
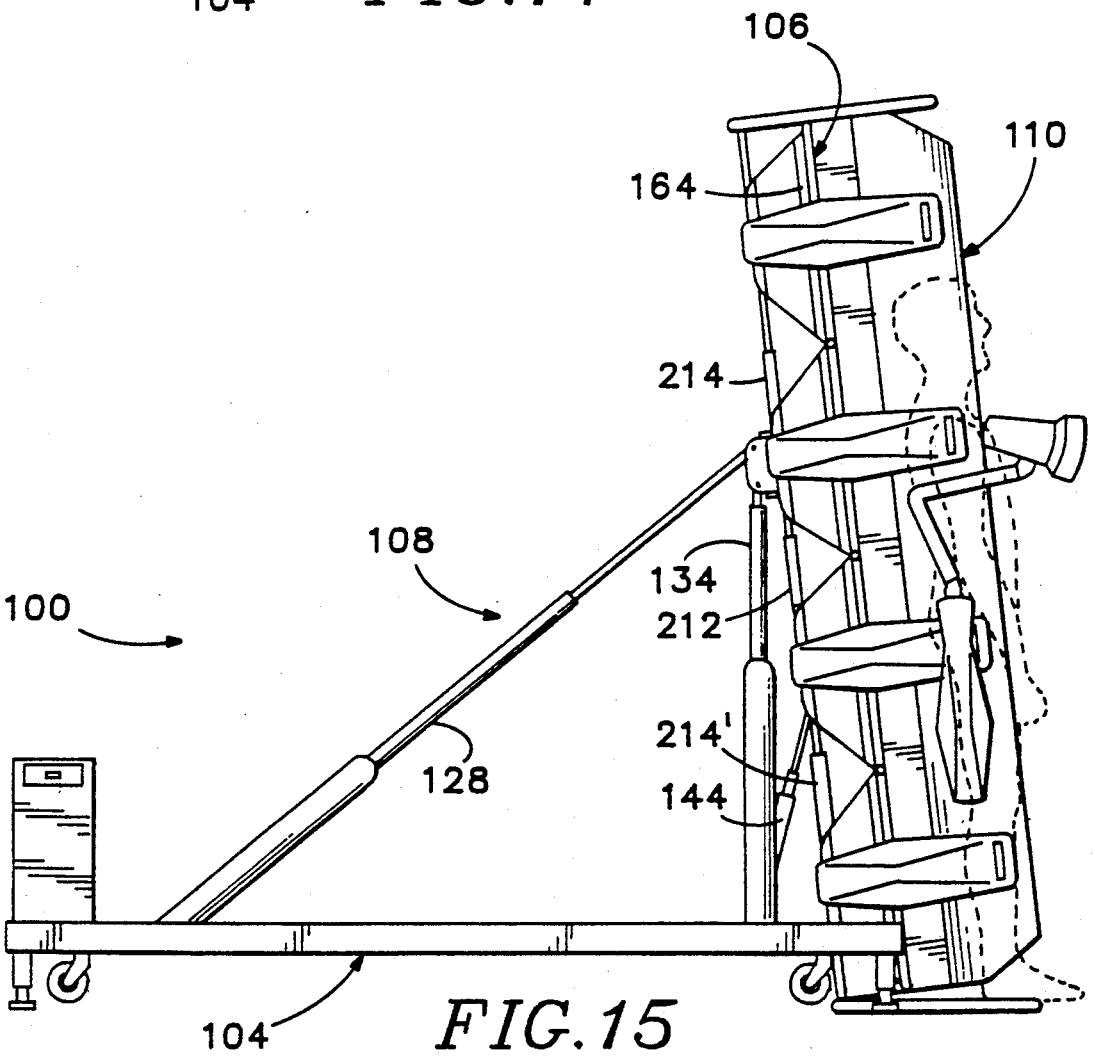

In FIG. 15, platform 106 is maintained in a planar orientation, with the head associated hydraulic support 128 fully extended and the foot or second hydraulic support 134 extended so that the platform achieves a near vertical position. In this position, the patient can simply stand in a relaxed position leaning against the cushion support system 110 provided by the system 100 such as would be useful for a patient who is immobilized, or providing positioning of the patient for access to and from the bed from a standing position.

FIG. 16 illustrates an arched orientation to platform 106 achieved by slightly decreasing the length of each of the hydraulic arms 210, 212, 214 and 214', while increasing slightly the length of hydraulic 128 and 134.

Figure 17:
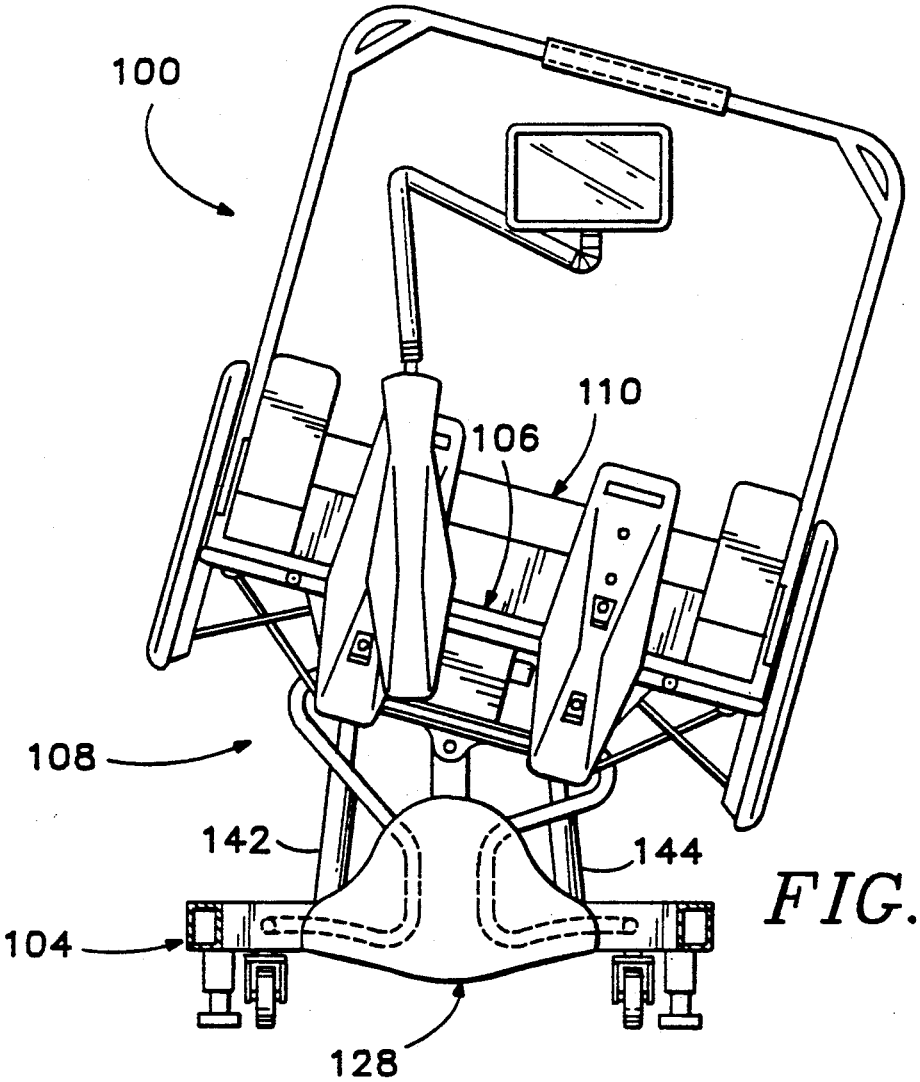

Finally, FIG. 17 illustrates a simple tilting orientation achieved by maintaining hydraulic supports 128 and 134 in any given position, and varying the relative lengths of support arms 142 and 144. This tilting operation could also be used in any of the positions shown in the previous four figures or in any other orientation in which it is desired. This position is useful for changing the body surface which supports the body from one side to the other. Further, it can provide an attendant with easier access to the patient.

General Patient Restraint and Access

Disposed on the lateral edges of each of panels 164 is a restraint apparatus 216 comprising in part a hinged panel extension 218 on the distal edge of which is vertically mounted a side restraint member 220. This is shown more clearly in FIGS. 18–24. Extension 218 hinges relative to panel 164 about an axis 222. Further, restraint member 220 is pivotable about an axis 224 relative to extension 218. A dovetail groove 226 exists in the inside surface of member 220. Groove 226 extends in approximately the lower two-thirds of that surface.

Hinged panel extension 218 provides means for extending the platform surface. This could also be accomplished in other ways, such as by making extension 218 telescope out of the associated panel, to slide under it, or even to be completely removable.

Figure 21:
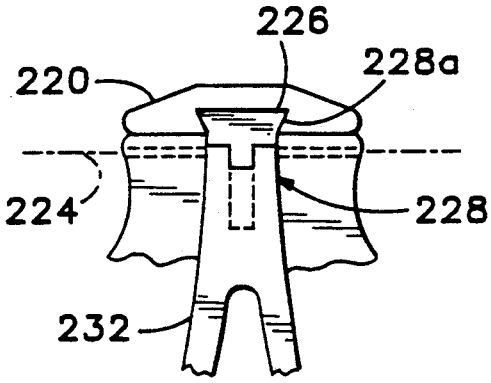
FIG. 21 is a cross-section taken along line 21—21 in FIG. 18.

A guide member 228 approximately one-third the length of member 220 has an extension **228*a* which matingly and slidingly is received in groove 226. Restraint member 220 and guide member 228 are fixed in their respective positions by a pin 230 which extends through the restraint member and into the guide member. A support member 232 is pivotally attached at one end to the lower surface of panel 164 and also pivotally attached at its opposite end to a lower portion of guide member 228. It will be noted in FIG. 3 that support member 232 extends into a channel in guide member 228 for pivoting about a pin. As an alternative embodiment of this connection, FIG. 21 shows guide member 228** with an extension which is inserted in a corresponding slot in the end of the support member.

A cross-support member 234 is pivotally mounted to the lower surface and outer region of panel extension 218. At its other end, it is captured in a latch 236 which is pivotally attached to support plate 146.

Figure 18:
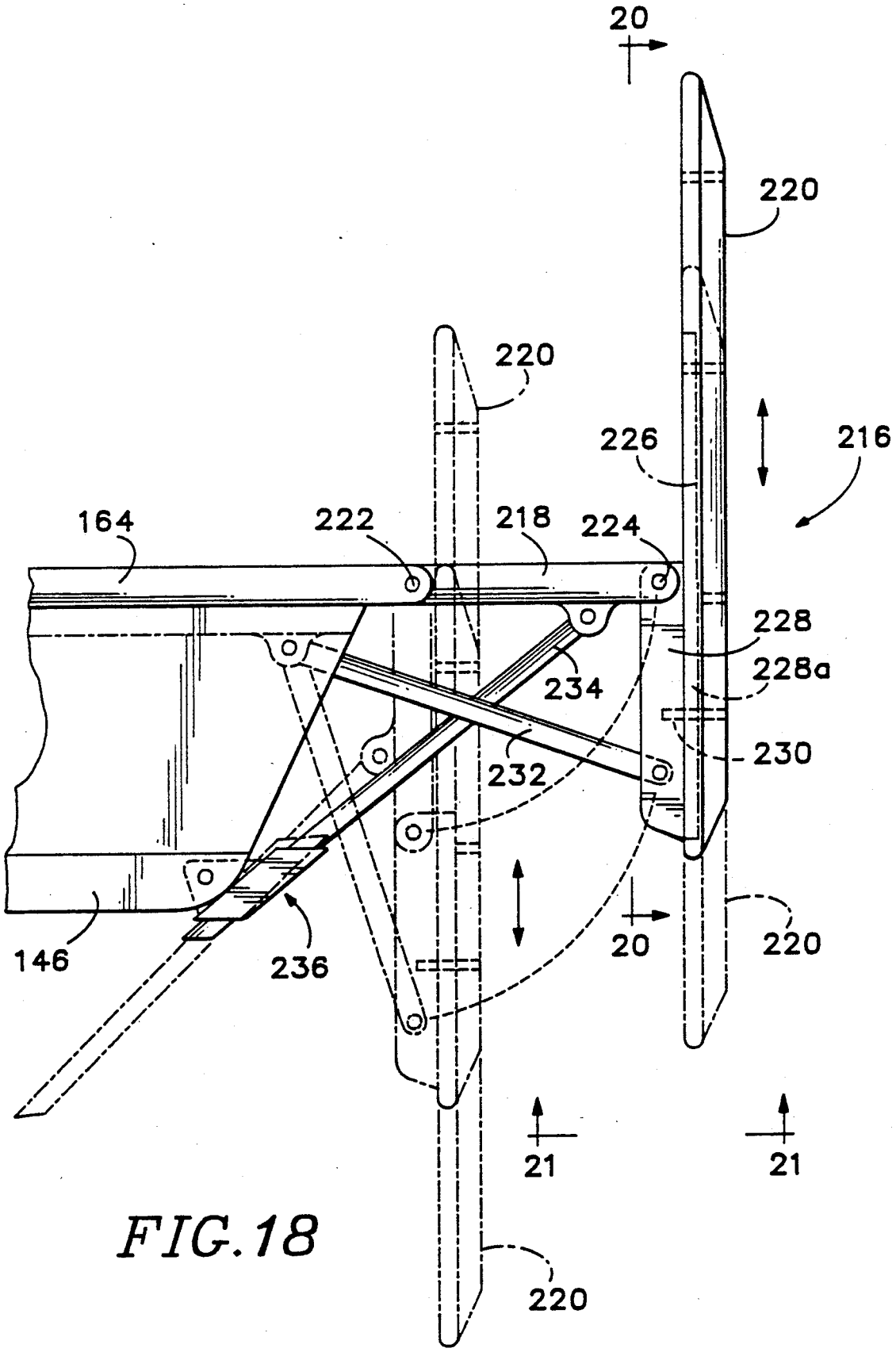
FIG. 18 is a side enlarged view of a side restraint panel of FIG. 1.
Figure 19:
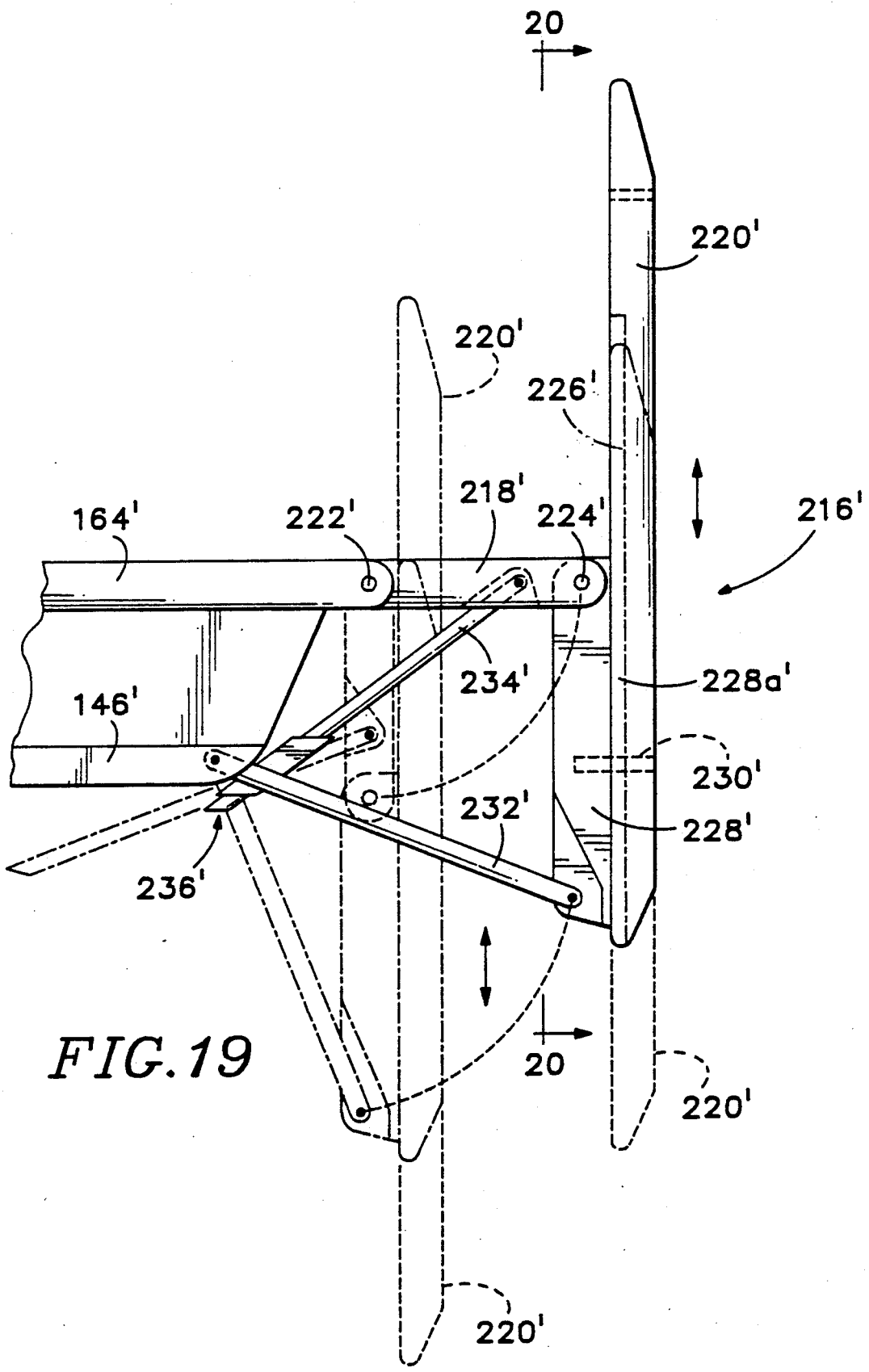
FIG. 19 is a view similar to FIG. 18 showing an alternative side restraint panel structure.
Figure 20:
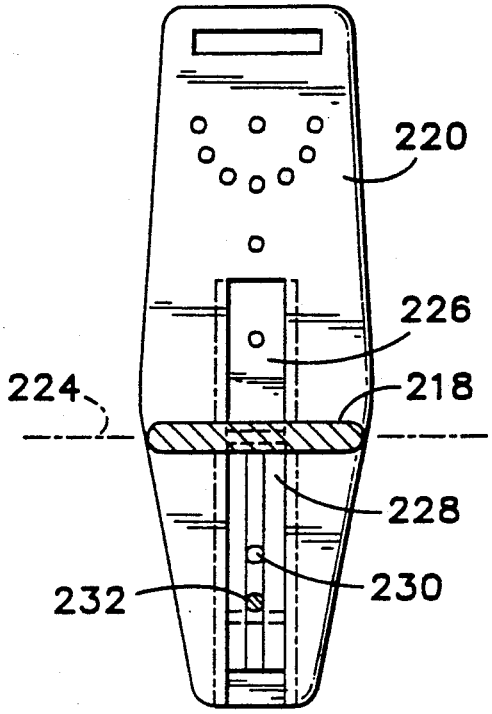
FIG. 20 is a cross-section taken along line 20—20 of FIG. 18.

FIG. 19 is a view similar to FIG. 18 showing an alternative embodiment of the articulated guard or restraint member and platform extension or wing. As applied to this drawing only, the same reference numbers are used as shown in FIG. 18 for similarly functioning parts except that a prime (') is appended to them. This is done to facilitate an understanding and to limit the required description.

In FIG. 19, the structure supporting extension 218' and restraint member 220' is the same except that one end of support member 232' extends from support plate 146' rather than from adjacent platform 164'. Because of the geometry of the extension, guide member, support member, and cross-support member in the embodiment of FIG. 18, extension 218 can only have a limited width which is appropriate for some applications. However, in order to provide the option of a wider extension, the structure shown in FIG. 19 must be provided.

Figure 22:
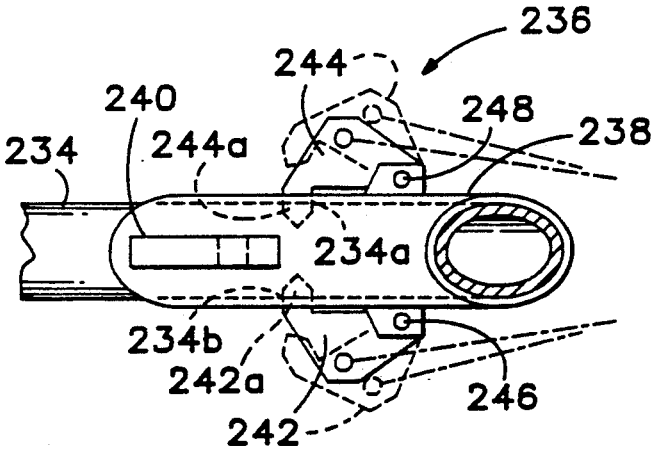
FIG. 22 is a side view of a latch used in the side restraint panel support shown in FIG. 18.
Figure 23:
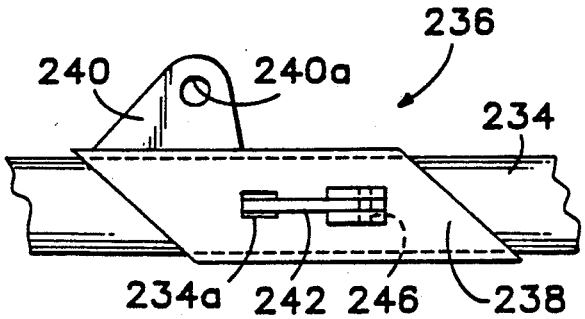
FIG. 23 is a side view of the support latch of FIG. 22 with the latch rotated ninety degrees.
Figure 24:
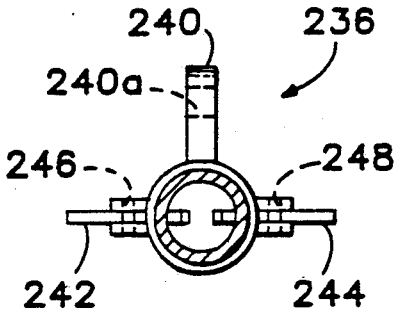
FIG. 24 is an end view taken from the right in FIG. 23.
Figure 27:
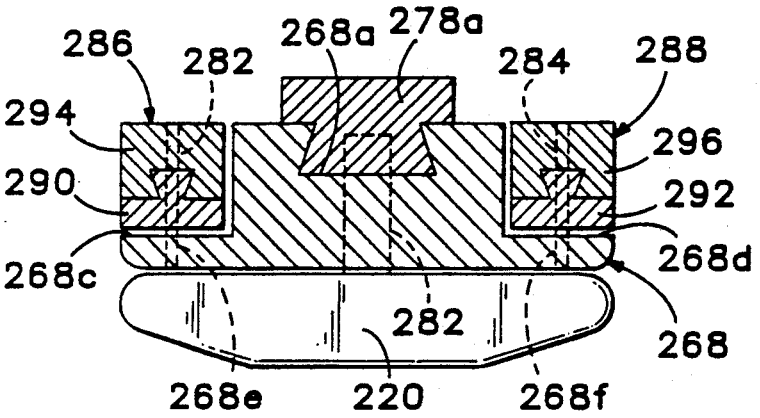
FIG. 27 is a cross-section taken along line 27—27 in FIG. 25.
Figure 25:
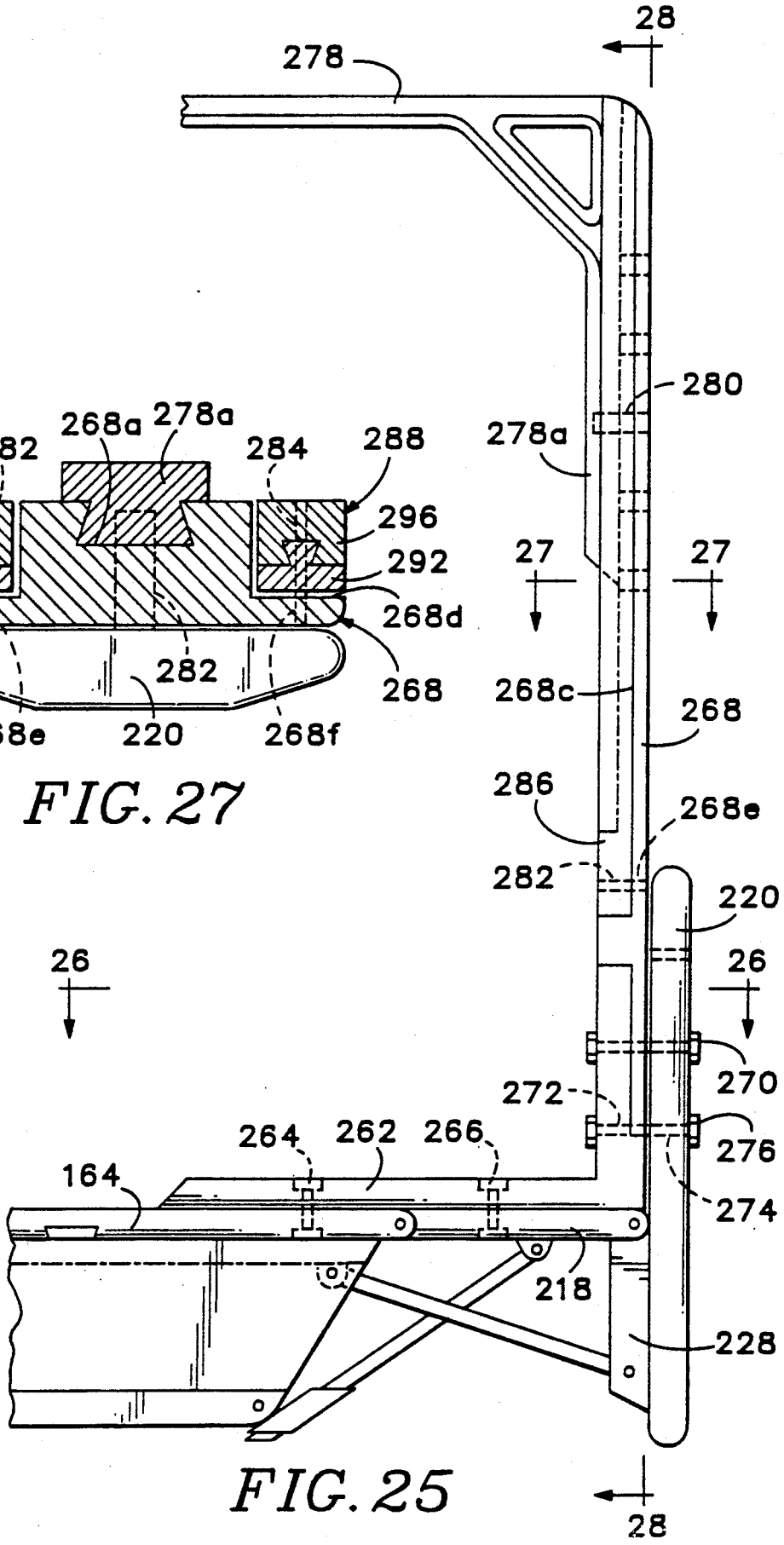
FIG. 25 is an end view of a canopy support of the system of FIG. 1.

Latch 236 is shown in more detail in FIGS. 22–24. Included is a latch sleeve 238 through which support member 234 extends. Sleeve 238 is hingedly attached to support plate 146 by a mounting portion 240 which is hingedly attached by a pin not shown extending through an aperture **240*a*. Cross support member 234 has a pair of coaxial opposing 234*a* and 234*b*. A pair of catch members 242 and 244 are positioned on opposite sides of latch sleeve 238 for pivotable mounting about respective pins 246 and 248. Each catch member has a tongue, respectively, 242*a* and 244*a* which extends into apertures 234*a* and 234*b***.

The catch members are preferably spring biased to urge tongues **242*a* and 244*a* into the apertures. However, they may be pulled outwardly as shown by the dashed or phantom lines in FIG. 22 to release support member 234 allowing it to slide within sleeve 238. When this is done panel extension 218 pivots about axis 222 until it assumes a vertical downward position. Correspondingly, panel extension 218 pivots with respect to guide member 228, with the result being the position of these elements as shown in dash-dot lines in FIG. 18. It can be seen that the height of restraint member 220 when in this lowered position is reduced by approximately one-third and it is in position adjacent the edge of panel 164**.

Side restraint member 220 can further be lowered by removing pin 230 from between restraint member 220 and guide member 228. This allows the restraint member to slide down in groove 226 until the top end of the groove seats against the top of guide member 228. This lowers restraint member 220 approximately an additional one-third of its length. In the fully collapsed and lowered position shown in FIG. 18, the upper tip of restraint member 220 is flush or lower than the top surface of panel 164. This thus removes the restraint member completely from obstructing access to panel 164, and thereby, the patient. This same lowering of the restraint member relative to the guide member can be done when panel extension 218 is in the upright position shown in solid lines in FIG. 18. This is sufficient to retain any mattress or cushion on panel 164 while providing easier access to the patient.

In order to return the panel extension and restraint to the original position, it is simply necessary to reverse the procedure described previously. In swinging panel extension 218 into its upright position it is of course necessary to be assured that the tongues of catch members 242 and 244 of latch 236 are seated in apertures 234*a* and 234*b*.

Figure 2:
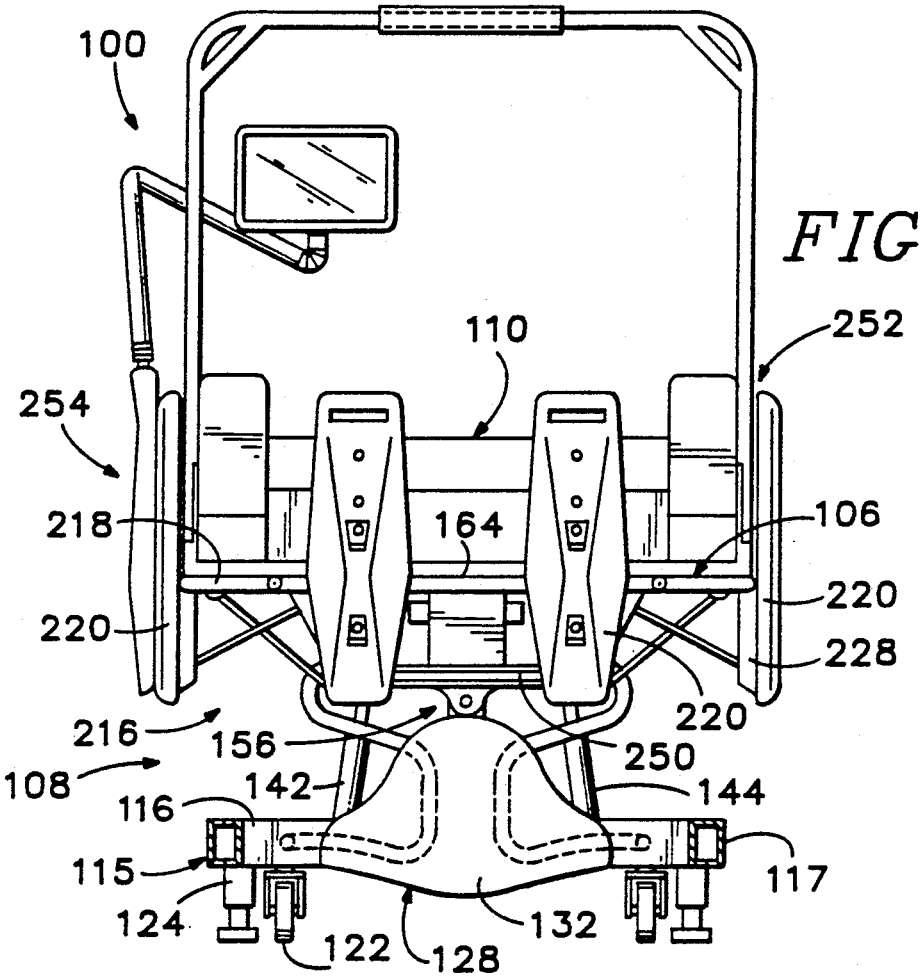
FIG. 2 is an end view taken along line 2—2 of FIG. 1.

As shown particularly in FIGS. 2 and 3, side restraint members 220 are also mounted on the foot and head portions of platform 106. These restraint members are held in position by guide members 228 which are held in position by an M-shaped brace 250. The two upper tips of the "M" shape are attached to the lower portion of guide members 228 similar to support member 232. The lower three points are attached to support plate 146 at the locations used otherwise to attach the hydraulic arms 210, 212, 214 and 214' between adjacent panels.

Auxiliary Equipment Support

Means are also provided for supporting peripheral and treatment equipment on the bed if required for a patient. These are provided primarily by either a structural support apparatus shown generally at 252 or a pendulum arm apparatus shown generally at 254. As shown in FIGS. 1 and 2 the structural support apparatus may contain, for example, apparatus for supporting a canopy 256 about the head of a patient. This might be useful where a patient needs to have privacy or a high oxygen atmosphere for breathing. Alternatively, it may include a structural member for supporting a weight 258 for use in applying traction forces to a patient. The pendulum arm apparatus is generally used for making equipment available to the patient. For instance, the apparatus 254 shown provides a monitoring screen 260 to the patient. This could be a private television, communication console for communicating with the nursing staff, or a control panel for controlling operation of system 100 itself.

Structural support apparatus 252 is described in further detail with reference to FIGS. 25–30. Apparatus 252 includes an L-shaped base plate 262 which is fixedly attached to panel 164 and extension 218 by appropriate fastening pins 264 and 266. A supporting arm 268 is sandwiched between and pivotable relative to the vertical extension of base plate 262 and side restraint member 220 about a pin 270. The lower surface 268*g* of support arm 268 is arcuate, having a radius of curvature about pin 270. Similarly the top surface 262*a* of plate 262 is also curved about the axis of pin 270.

Disposed circumferentially about pin 270 and radially inwardly from lower surface 268*g* are a plurality of apertures 272. A corresponding aperture 274 exists in restraint member 220 to hold a retaining pin 276 which extends through a selected one of apertures 272 and retaining member 220. It can thus be seen that arm 268 can take any of a variety of orientations relative to horizontal depending on which of apertures 272 pin 276 is positioned in. For instance, a near-horizontal orientation is shown in phantom lines in FIG. 1.

Extending downwardly from the top of arm 268 is a dovetail groove 268*a*. A plurality of adjustment apertures, such as aperture 268*b* are disposed in spaced locations along the general longitudinal axis of the arm. A cross arm 278 extends, in the position shown in FIG. 25, laterally inwardly from the top of arm 268. It includes a brace portion 278*a* which has an extension slidingly and matingly received in groove 268*a*, as particularly shown in FIG. 27. Cross arm 278 is adjustable relative to support arm 268 by the positioning of a connecting pin 280 which extends through aperture 268*b* and into a corresponding aperture in cross arm brace portion 278*a*.

Figure 28:
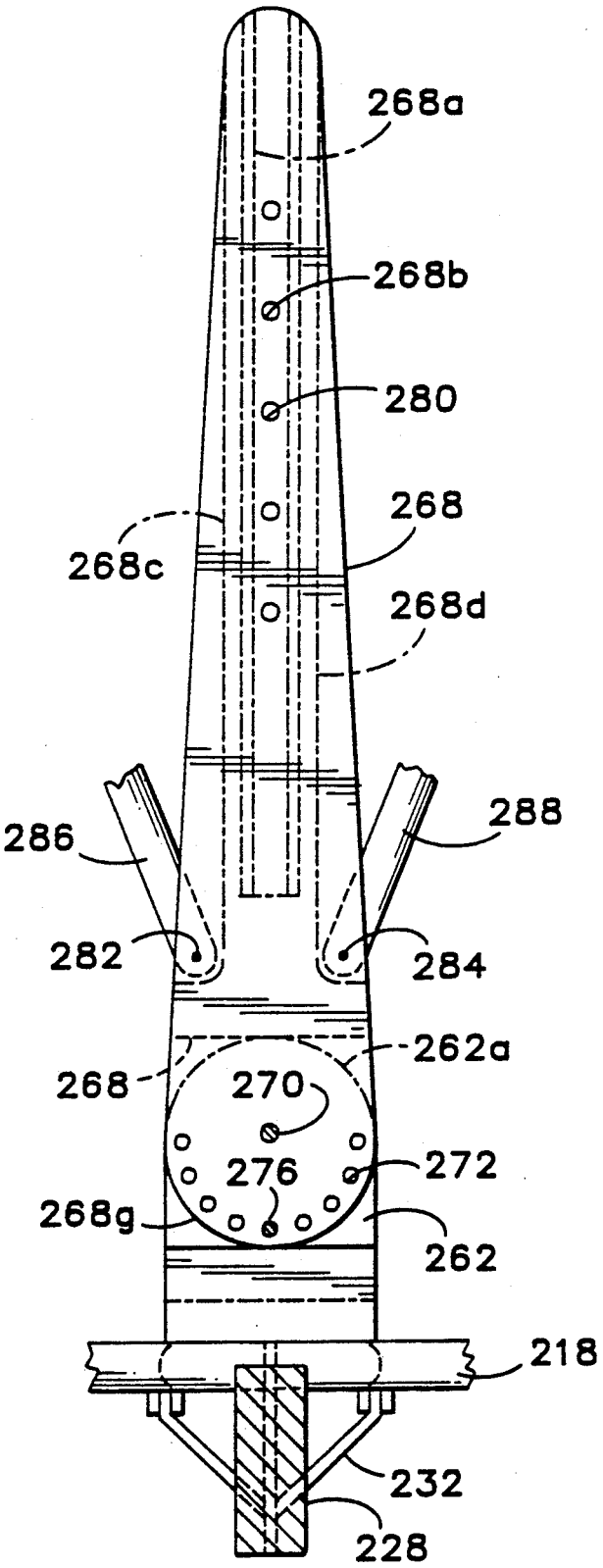
FIG. 28 is a cross-section taken along line 28—28 in FIG. 25.

A pair of channels 268*c* and 268*d* are disposed longitudinally in the edge margins of arm 268. In the lower regions of these channels an apertures 268*e* and 268*f*, respectively pass through the wall of arm 268. These apertures receive pins 282 and 284, respectively, for holding side arms 286 and 288, respectively. These arms are pivotable about the pins to provide lateral support relative to main support arm 268. In FIG. 28 side arms 286 and 288 are shown pivoted slightly outwardly from support arm 268. This is also the positions they have in FIG. 1 in which they are used to support canopy 256.

Each side arm 286 and 288 includes a base member 290 and 292, respectively, having a dovetail connection with a sliding portion 294 and 296, respectively. The sliding and base portions are held together, similar to other structures previously described with reference to system 100, by the use of connecting pins through selected apertures, not shown. Thus, the length of side arms 286 and 288 are adjustable to fit each desired application.

Figure 29:
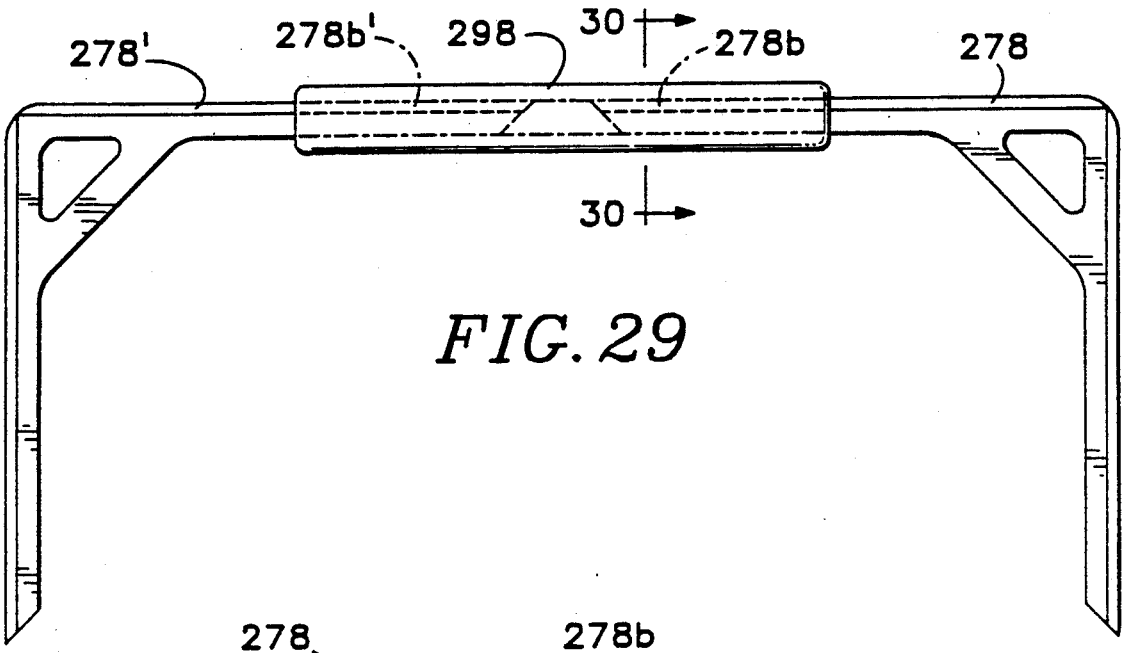
FIG. 29 is a fragmentary extension of the canopy support cross arm partially shown in FIG. 25.
Figure 30:
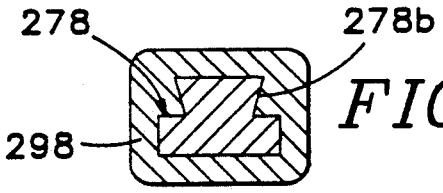
FIG. 30 is a cross-section taken along line 30—30 in FIG. 29.
Figure 26:
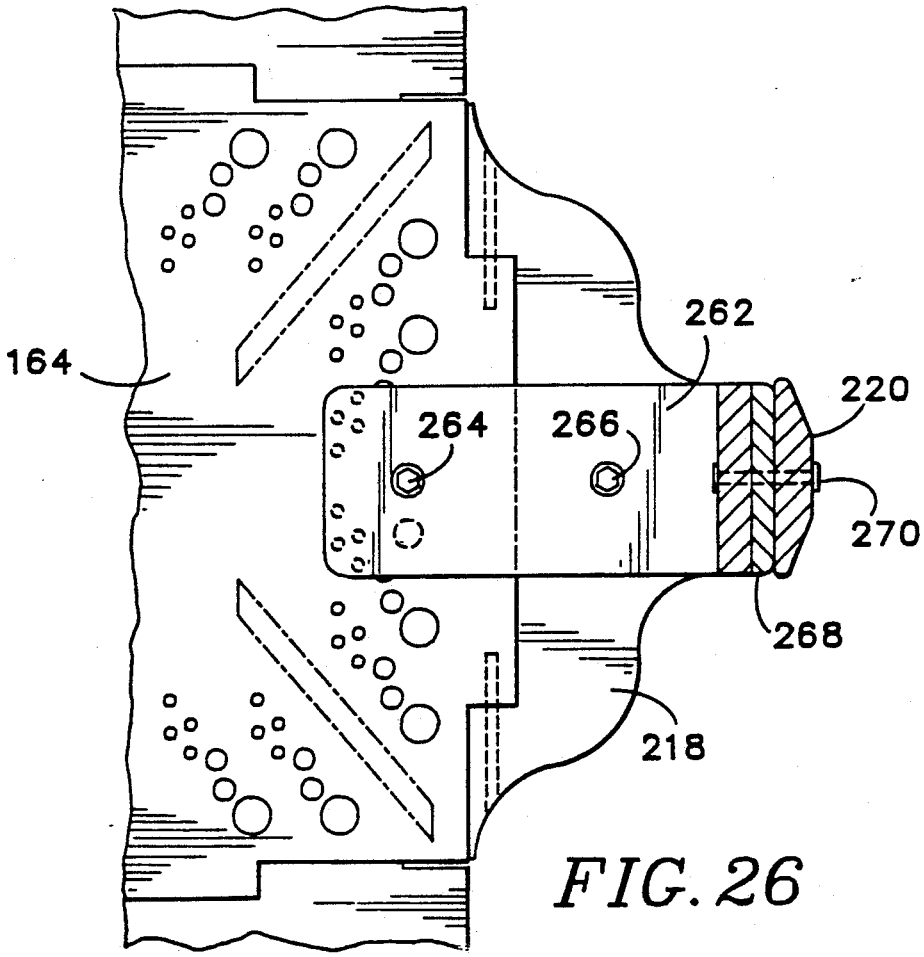
FIG. 26 is a cross-section taken along line 26—26 in FIG. 25.

FIGS. 29 and 30 illustrate the structure of connecting cross arms 278 and 278' in order to form a continuous bar for supporting canopy 256. In this case distal ends 278*b* and 278*b'* are adjacent each other with a sleeve 298 which fits over the two distal ends in a dovetail joint. Sleeve 298 makes the horizontal bar formed by the distal ends of the cross arms into a continuous horizontal member, as shown. This then will support any kind of a hanging attachment or a canopy, such as canopy 256. Alternatively, a unitary single continuous cross arm including cross arms 278 and 278' could also be used.

Figure 33:
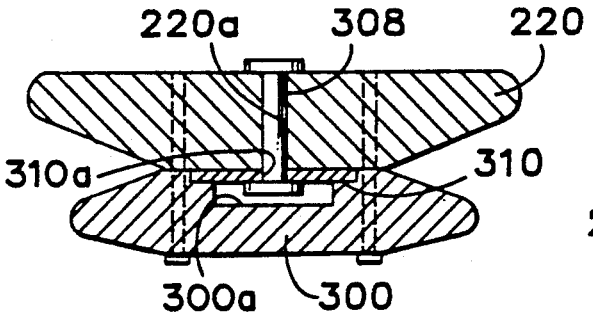
FIG. 33 is a cross-section taken along line 33—33 in FIG. 31.
Figure 32:
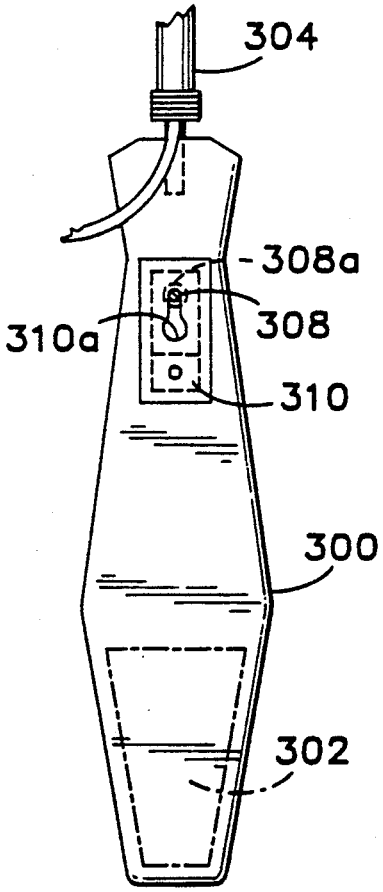
FIG. 32 is a view of the pendulum support arm taken along line 32—32 in FIG. 31.
Figure 31:
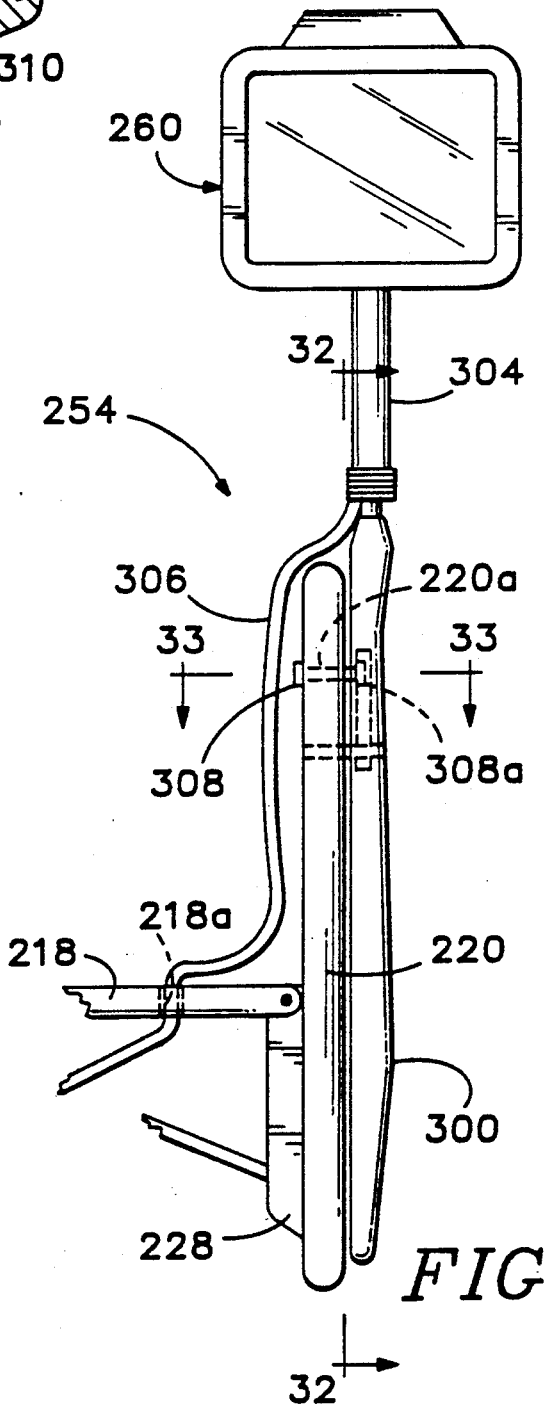
FIG. 31 is a side view of a pendulum support arm supported on a restraint panel of FIG. 1.

Referring now to FIGS. 31–33, pendulum arm apparatus 254 is shown in further detail. It includes a pendulum arm 300 which has a counter weight 302 disposed in a lower section and is made of a suitable high density material such as of lead. This weight is used as a counter weight to offset the weight of whatever equipment or apparatus is attached to the top of pendulum arm 300. In this case there is a neck 304 which is attached to the top of arm 300 for supporting monitor 260. A connecting cable or cord 306 passes from neck 304 externally of arm 300 and side restraint member 220. It passes down through an access aperture 218*a* in panel extension 218, as shown.

Pendulum arm 300 is preferably elongate and conforms with the shape of restraint member 220 although any functional shape can be used. A supporting pin 308 extends through an aperture 220*a* in the upper region of restraint member 220. Pin 308 extends outward the outer surface of member 220 and has an enlarged head 308*a*. A cavity 300*a* in the upper region of arm 300 is sized large enough to receive head 308*a* of pin 308 along a vertical distance, as shown.

A cover plate 310 is mounted over cavity 300*a* and has in it an inverted keyhole opening 310*a*. This opening is enlarged at its lower edge sufficiently to freely receive head 308*a*, but narrow at its upper portion to allow the neck of pin 308 to pass therethrough but to prevent passage of head 308*a*. Thus, pendulum arm 300 freely pivots about pin 308. With the combined weight of arm 300 and counter weight 302 being heavier than monitor 260, pendulum arm 300 maintains the position shown, thereby holding the monitor in an upright position.

The particular advantage of this structure is that even as platform 106 is varied in position as shown in FIGS. 12–16, the auxiliary equipment is maintained in an upright position. This is particularly shown in FIG. 15 which shows the monitor being maintained in an upright position even though platform 106 is substantially vertical. Certainly arm 300 could be fixed to restraint member 220 or in fact the peripheral equipment could be made to be attachable to the top of restraint member 220. So long as the equipment is adjustable in position relative to the restraint member, this also would provide an acceptable auxiliary equipment support. However, each time the orientation of platform 106 is adjusted, the position of the auxiliary equipment would also have to be adjusted.

Patient Support Inflation System

Referring now to FIG. 3, the patient is supported on inflatable mattress 112, forming part of cushioning system 110. The cushions or bladders in mattress 112 are inflated through an inflating apparatus 312 mounted below the cushions. Inflating apparatus 312 includes a controller 314 housed in equipment housing 114. Positive and negative air pressures are provided through a low pressure, high volume pneumatic system 315, as shown, from a turbine blower 317 to the platform via a pair of pneumatic hoses 316 and 318. The air pressures are considered positive and negative relative to the ambient pressure. Each panel 164 of platform 106 has mounted on its lower surface four sets of pairs of valve units 320 which are identical in structure and are mounted adjacent each other, as shown. A passageway bypass unit 322 is mounted between the four sets of valves. Between each of the panels a pair of further conducting hoses 324 and 326 are mounted. These conduct air from one set of valve units in one panel 164 to an adjacent set of valve units in an adjacent panel. Thus, the air supply is provided to all four panels of the platform shown in the preferred embodiment.

It will be understood that other means of applying inflating fluid to the bladders could be provided. For instance, instead of providing air at a negative pressure it could simply be controllably vented. Further, if standard pressures are used, simply providing a source having that pressure with direct connection to the bladders could be used. Other such variations are also possible.

Figure 34:
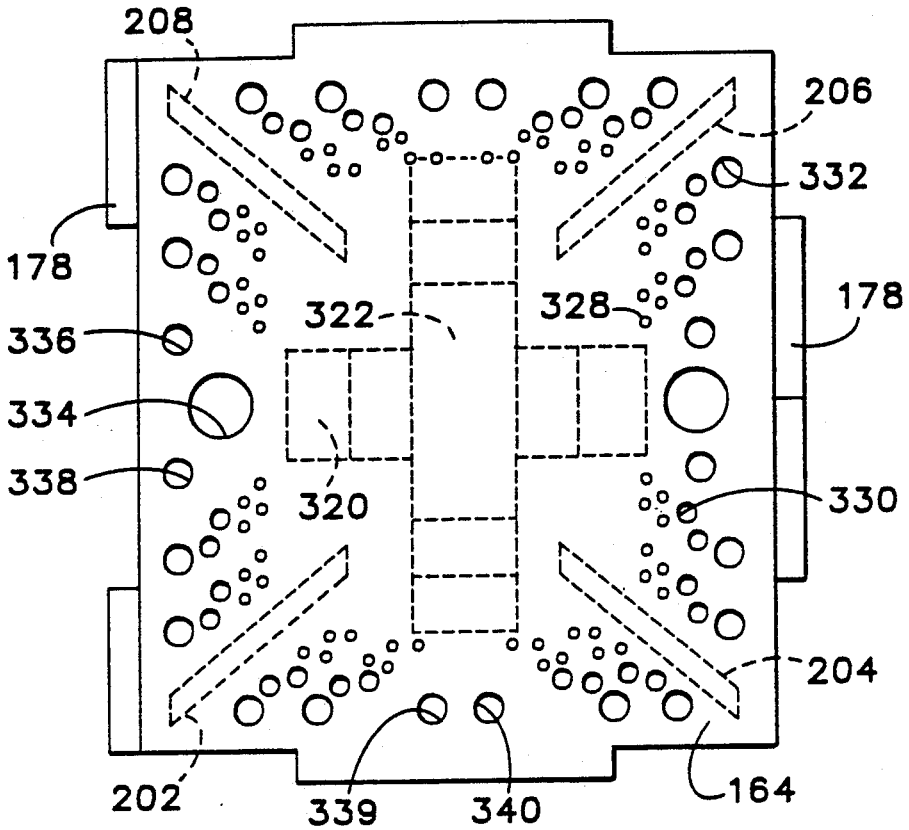
FIG. 34 is an enlarged partial top view of a platform showing a panel of FIG. 1.
Figure 35:
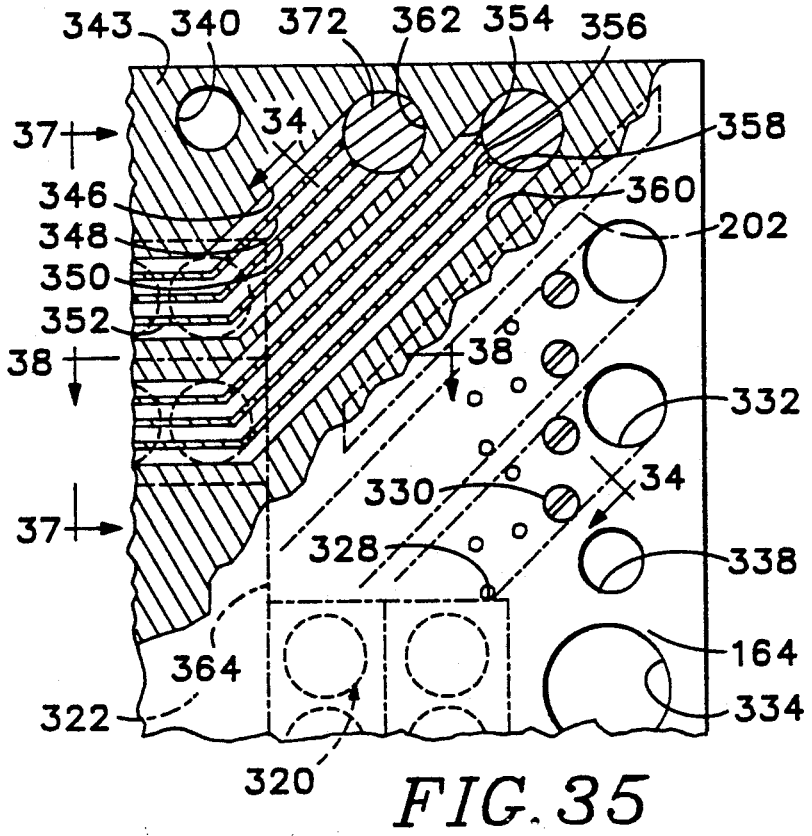
FIG. 35 is a further enlarged and partial cutaway view of approximately the upper right quarter of the panel of FIG. 34.

Each panel has a series of channels or ducts formed within it to convey air from the valve units to access openings for connection to individual cushions. This is particularly shown in FIGS. 34–40. FIG. 34 shows the top view of a panel 64 and various openings thereon. Included are sets of associated small openings 328, medium openings 330, and large openings 332. Each panel has also passing through it, at locations adjacent to the panel joints, a large drain opening 334, associated air supply opening 336 and water supply opening 338. These latter three openings have use in the sanitary system provided by the present invention and will be described further subsequently. Also, near each side edge of the panel are a pair of holes 339 and 340 which are used to provide access for auxiliary equipment and the like, discussed previously. These features are more clearly shown in FIG. 35 which also shows a partial cross-sectional view of the panel.

It can be seen that each panel 164 includes an upper layer 342, an intermediate layer 343 and a lower layer 344. Holes 328, 330 and 332 are in upper layer 342. In intermediate layer 343 are disposed four sets of generally parallel channels 346, 348, 350, 352, 354, 356, 358 and 360. Channels 346, 348, 350 and 352 comprise a set of channels which extend from communication with an enlarged opening 362, also in intermediate layer 343, to a position over a corresponding valve unit opening 364. Opening 362 is in communication and in alignment with a corresponding large hole 332 in upper layer 342. The holes 328, 330 and 332 are connected to a cushion with connecting tubes, such as a tube 368 extending from an intermediate hole 330 and a tube 370 extending from a small hole 328.

When the openings in the upper panel section are not used to connect to a cushion they are plugged, such as by plugs 372 in large holes 332 and enlarged openings 362. When plug 372 is in an enlarged opening, it seals the four associated channels so that the air pressure in them may be regulated independently.

For those openings that are not connected to cushions by tubes, a plug, such as plug 374 for a smaller hole and plug 376 for an intermediate hole are used to seal off the associated opening.

Figure 36:
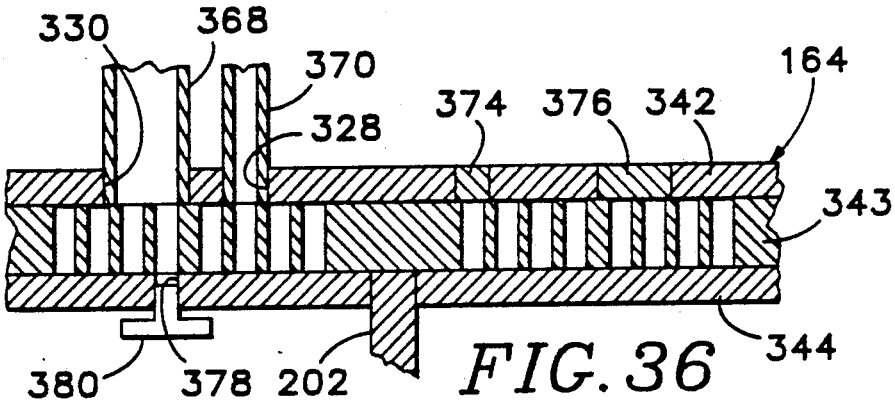
FIG. 36 is a cross-section taken along line 36—36 of FIG. 35.
Figure 39:
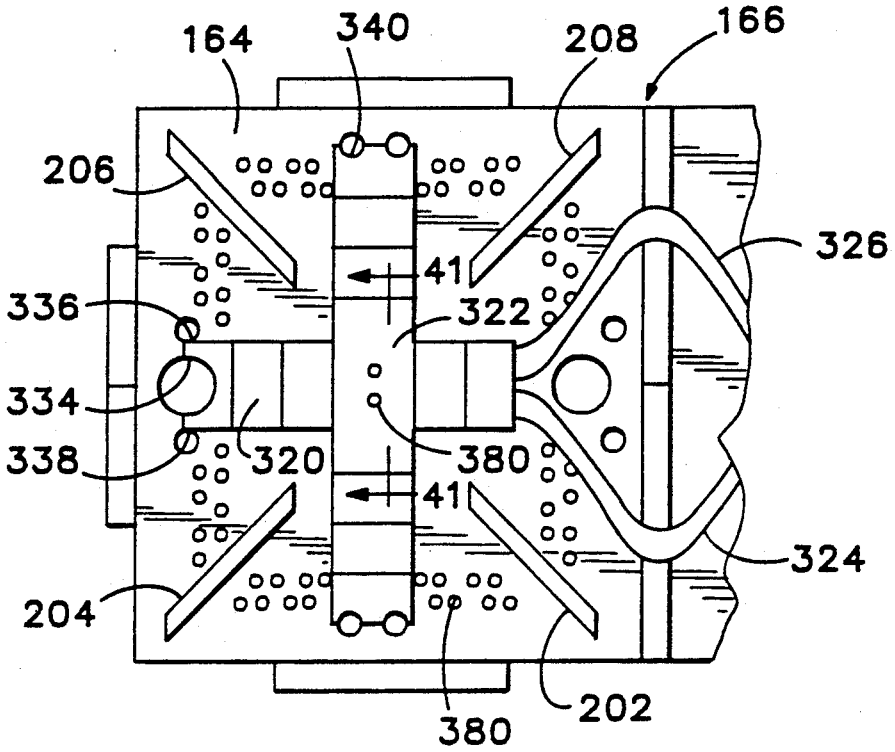
FIG. 39 is a bottom view of a portion of the platform of FIG. 1 taken along line 39—39 of that figure.
Figure 40:
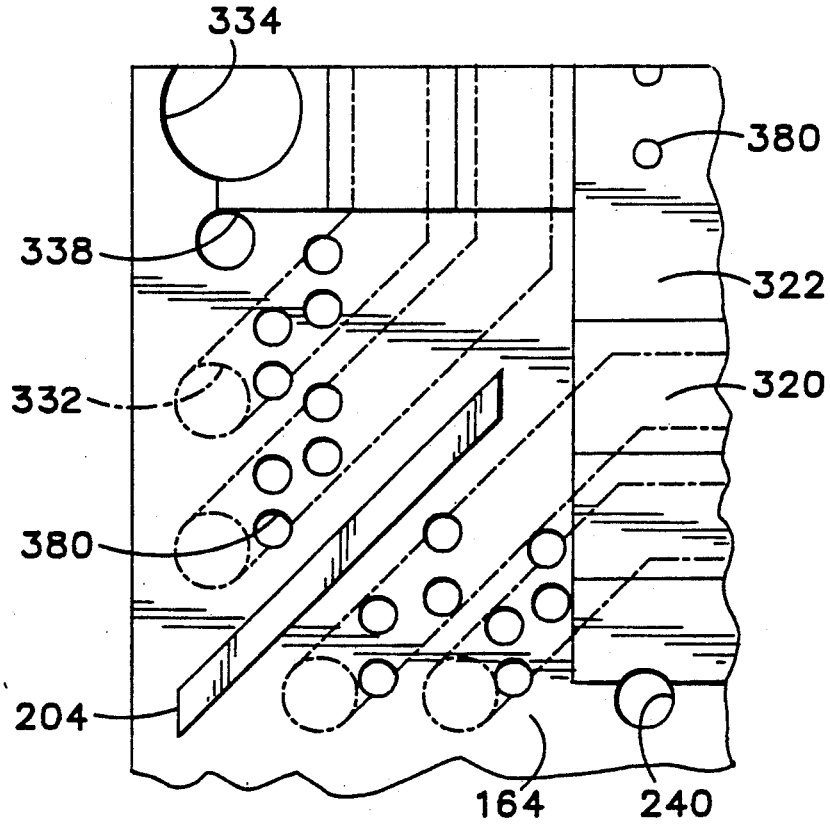
FIG. 40 is an enlarged view of approximately the lower left quarter of the panel of FIG. 39.

Referring now to FIG. 39, the underside of a panel 164 is shown. This figure shows the layout of the valve units, bypass unit and pneumatic hoses for a single panel. An enlarged section of the panel of FIG. 39 is shown in FIG. 40. Disposed through lower layer 344 (as shown in FIG. 36) of panel 164 are apertures 378 associated with each channel. Disposed in each aperture 378 is a pressure transducer 380, shown particularly in FIG. 36 as well as in FIG. 40. These transducers are used to define the air pressure contained within each cushion associated with each channel 346, 348, 350, 352, 354, 356, 358 and 360. If two adjacent channels feed a single cushion or if all four adjacent channels feed a single cushion, it is only necessary to have a single transducer 380 monitoring the pressure. It is also possible to have the transducer located in the bladders as appropriate and to use any pressure sensing apparatus desired. Thus, the apertures 378 associated with any channels having the same pressure can be filled with plugs, which plugs are not shown but are similar to plugs 374.

Figure 38:
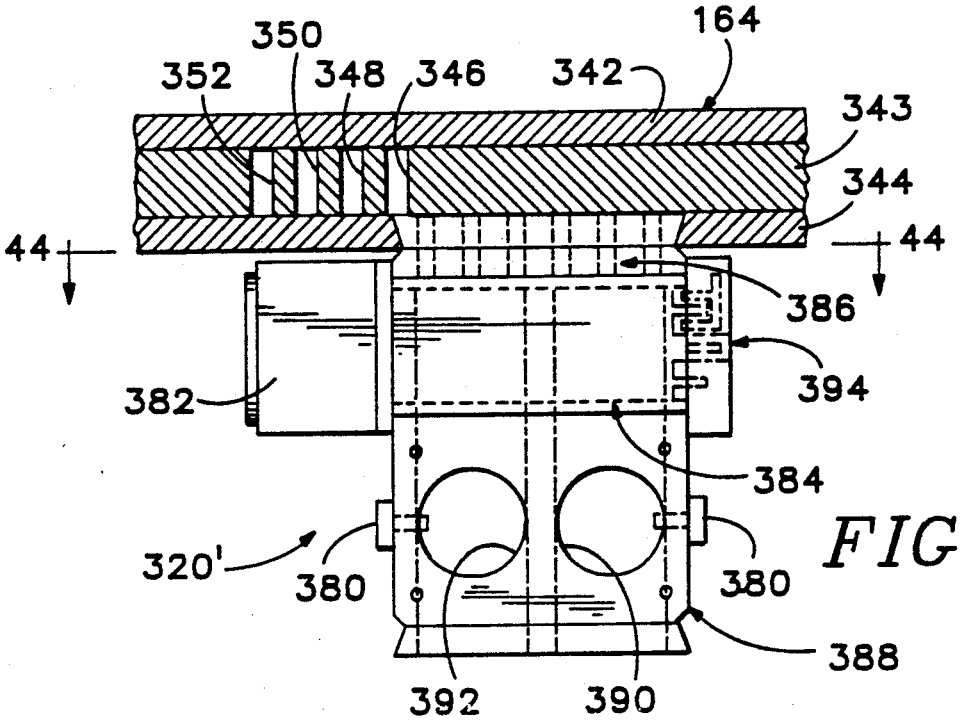
FIG. 38 is also a partial cross-section taken along line 38—38 in FIG. 35.

Additionally, two transducers 380 are mounted in the manifold of valve unit 320 to monitor both the positive and negative air pressures on the air supply side of the valves. These are shown in FIG. 38.

Figure 37:
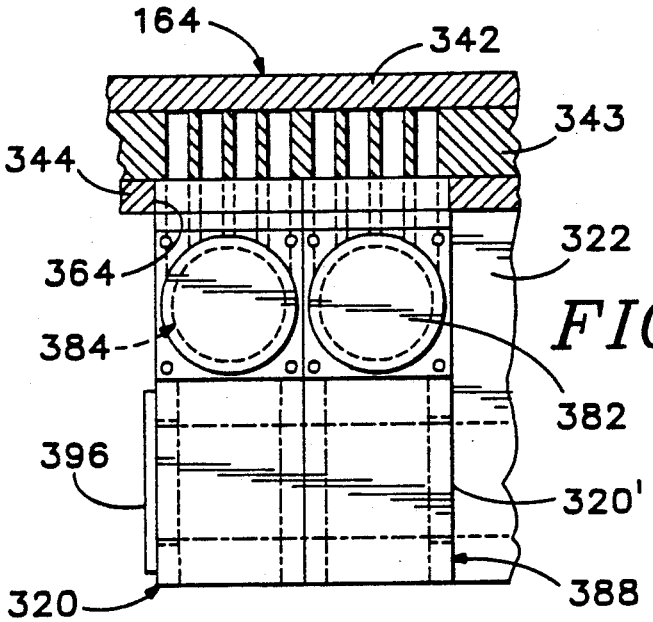
FIG. 37 is a partial cross-section taken along line 37—37 of FIG. 35.

A side view of a valve unit 320 is shown in FIG. 37. A valve unit 320' is shown in FIG. 38 as viewed from the right side of FIG. 37. Each valve unit includes a stepper motor 382, a valve core assembly 384, a channel coupling 386 and an air passageway assembly 388. Air passageway assembly 388 has first and second air pressure passageways 390 and 392. These two passageways are connected to the positive and negative air pressure supplies.

Disposed opposite of valve core assembly 384 from stepper motor 382 is a valve core position encoder 394. Encoder 394 is of a form similar to position defining apparatus 176 associated with joints 166, described previously.

Air passageway assemblies 388 are of standardized construction and are placed adjacent each other so that air passage through the passageways is provided to the several valve units associated with a given panel, and also throughout the platform. For each valve unit, such as unit 320 shown in FIG. 37, which is at the end of an air passageway line, plugs 396 are positioned in the ends of corresponding passageways 392 and 390 so that the air pressure, positive or negative, can be maintained within the passageways.

It will be noted, particularly as viewed in FIG. 38, that channel coupling 386 has a dovetail connection for sliding into position in valve unit opening 364. During installation, a bypass unit 322 is fixedly mounted in the position shown. Then each set of pairs of individual valve units 320 is placed in position next to bypass unit 322 by appropriate mounting means, such as by bolts or other mechanism, not shown. An opening is provided to allow the valve units to be placed against the panel and then slid in the dovetail grooves to a position against the bypass unit. The individual valve units are thus held in position in their relative positions adjacent other valve units and the bypass unit.

Figure 41:
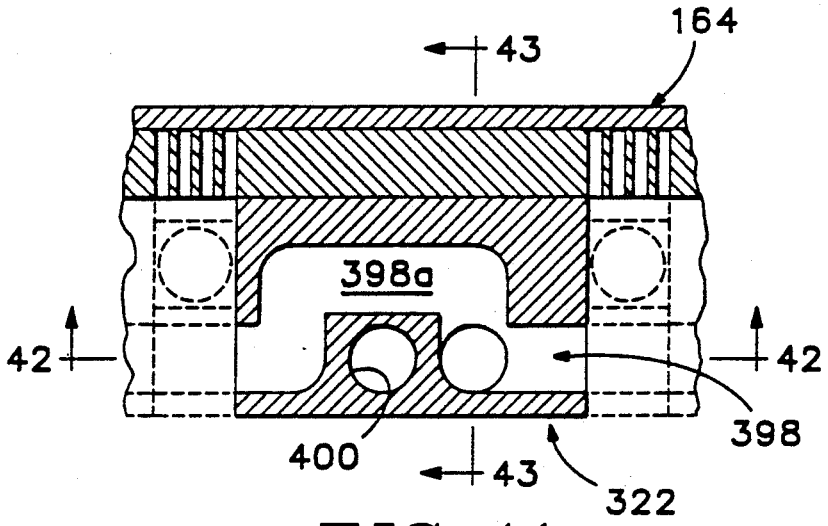
FIG. 41 is a cross-section of an air duct bypass unit taken along line 41—41 of FIG. 39.
Figure 42:
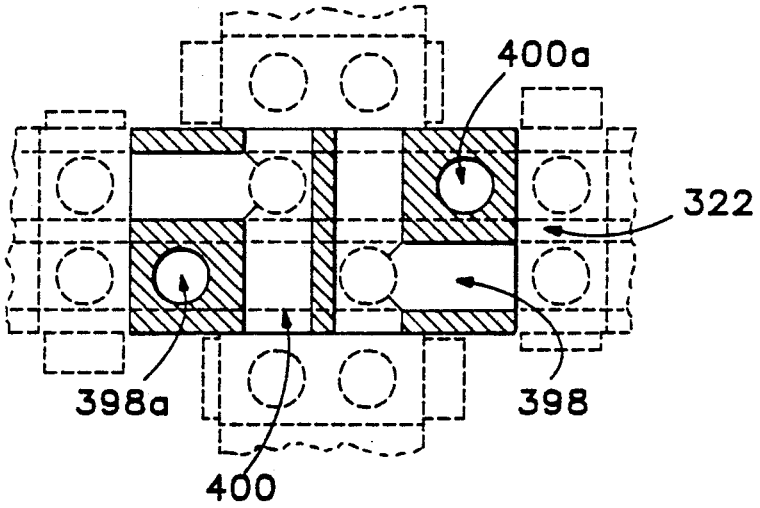
FIG. 42 is a cross-section taken along line 42—42 of FIG. 41.
Figure 43:
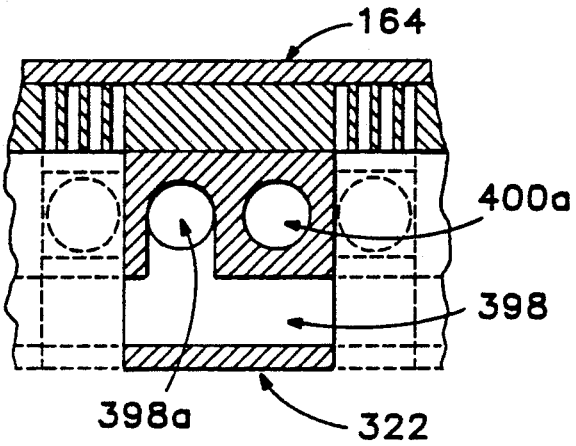
FIG. 43 is a cross-section taken along line 43—43 of FIG. 41.

Bypass unit 322 is shown more clearly in FIGS. 41–43. FIG. 41 is a cross-section taken along line 41–41 in FIG. 39. This cross-section shows the routing of air passageways in a crisscross fashion so that opposite valve units, which are positioned at right angles to the general longitudinal line of the platform can be provided with appropriate air pressure. It thus serves as an air routing duct which avoids crossing the two positive and negative air passageways.

Bypass unit 322 thus includes a first passageway 398 which has a bypass portion **398*a* which rises above a second passageway 400. FIG. 42 shows a cross-section view taken along line 42—42 in FIG. 41 and illustrates the position of the various passageways in the plane of that figure. It can be seen then that passageway 398 also forms a T intersection in the plane of FIG. 42. Passageway 400 has the same type of configuration as passageway 398, except that it is reversed. Thus, passageway 400 also has a bypass section 400*a* very similar to that of bypass section 398*a*, for bypassing passageway 398. It can be seen in FIG. 42 that because the passageways make right angle turns as well as continue in line, that this bypass structure is needed to maintain the integrity of the air passageways, both positive and negative. The air supplies are thus directed from one end of bypass unit 322** into three directions.

Figure 45:
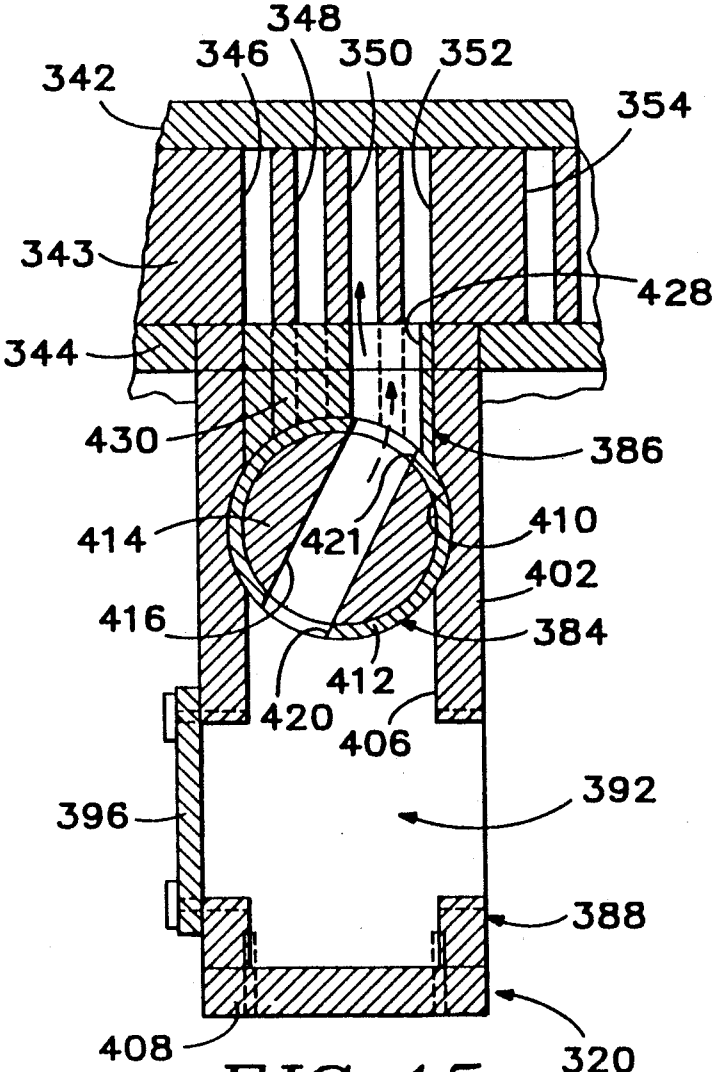
FIG. 45 is a cross-section of a valve unit taken from along line 45—45 of FIG. 44.

Referring now to FIGS. 44–55, the operation of valve units 320 is described in further detail. A housing 402 forms the body of valve unit 320 and defines within it passageway 392 of air passageway assembly 388. Extending upwardly through housing 402 are a pair of passageways 404 and 406 which form continuations of passageways 390 and 392. Housing 402 may be molded, or passageways 390, 392, 404 and 406 may be drilled through it. In this latter case, as shown in FIG. 45, a cap 408 is mounted on the lower end of housing 402 to seal off the ends of passageways 404 and 406.

Extending horizontally through housing 402 is an enlarged opening 410 which is a little wider than the passageways, such as passageway 406, to which it is orthogonal. Disposed within opening 410 is an interchangeable valve core assembly 384. As will be explained subsequently, this core assembly can have different configurations depending on the use for which the valve is to be made. In any event, assembly 384 includes an outer sleeve or bushing 412 which is frictionally inserted into opening 410 so that it does not move. Disposed within sleeve 412 is a rotatable core 414. Core 414 is rotated by stepper motor 382. Extending laterally through core 414 are four apertures or bores 416, 417, 418 and 419. These bores are positioned to selectively provide for communication between the channels in panel 164 and passageways 390 or 392. Further, sleeve 412 has within it pairs of coaxial holes, including holes 420 and 421 associated with bore 416, holes 422 and 423 associated with bore 417, holes 424 and 425 associated with bore 418, and holes 421 and 427 associated with bore 419. These bores and holes are positioned so that communication can be provided selectively between one of passageways 390 and 392 and one pair of channels in panel 164.

Other means may also be used to provide a valve aperture between the fluid sources and destinations. For instance parallel bores with a sliding gate with openings could be used equivalently. A separate shutter or gate for each bore could be used. Other arrangements are also possible.

Figure 44:
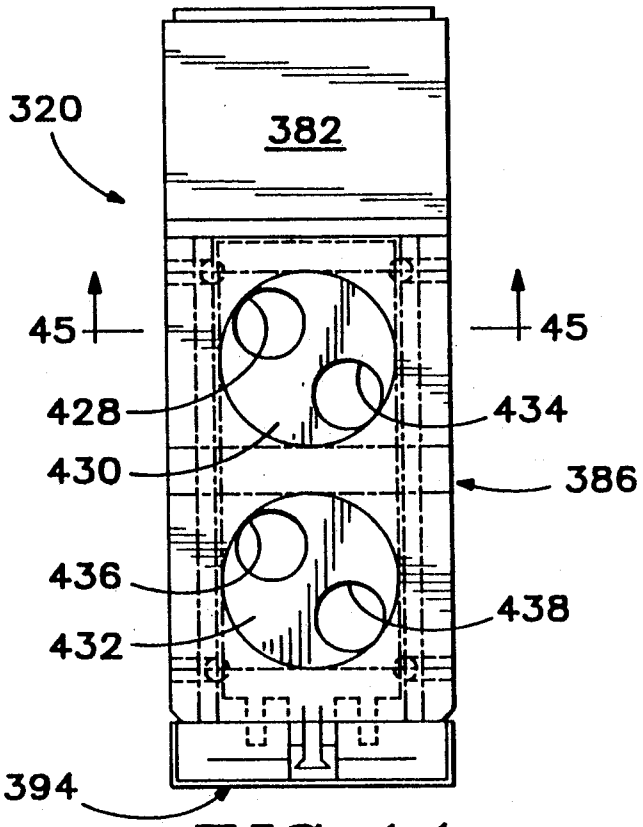
FIG. 44 is a top view of a valve unit taken along line 44—44 of FIG. 38 with associated panel structure removed.

In FIG. 45 it can be seen that bore 416 is in alignment with associated holes 420 and 421 in sleeve 412. With core 414 in this position, hole 421 communicates with a passageway 428 extending through a circular plug 430 forming part of channel coupling 386. Passageway 428 provides communication with the two channels in panel 164 shown in FIG. 45. As shown in FIG. 44, there also is a plug 432 associated with passageway 404. Further, plug 430 has a second passageway through it 434. Plug 432 has passageways 436 and 438. Each of passageways 428, 434, 436 and 438 provide air pressure to two associated channels in panel intermediate layer 343 of panel 164.

If desired, plugs 430 and 432 could be formed with slits or columns which align with the corresponding channels in panel 164. Such a plug would be universal in that any embodiment of the valve core assembly could be used with it so long as the size of the holes and bores in the core assembly corresponded with the spacing between channels.

Figure 46:
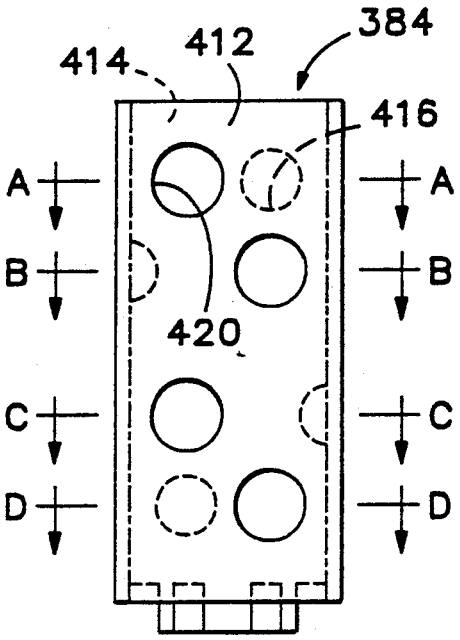
FIG. 46 is a top view of the valve core and sleeve assembly of the valve unit of FIG. 44.
Figure 47A:
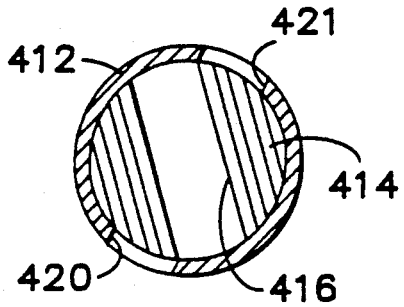
FIGS. 47A–47D through 51A—51D are cross-sections taken along lines A—A to D—D in FIG. 46 showing the valve core and sleeve assembly in five operative positions.
Figure 47B:
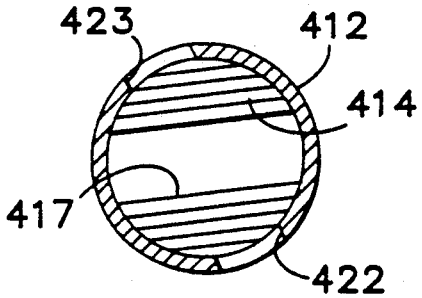
Figure 47C:
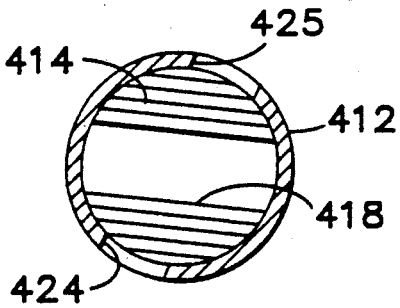
Figure 47D:
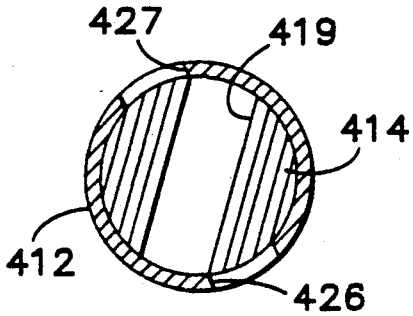
Figure 48A:
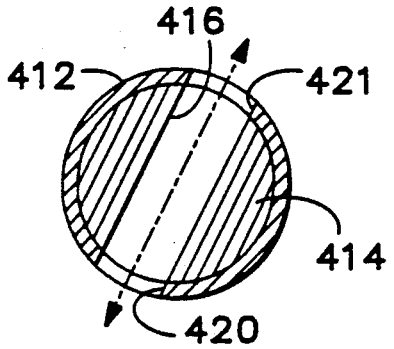
Figure 49A:
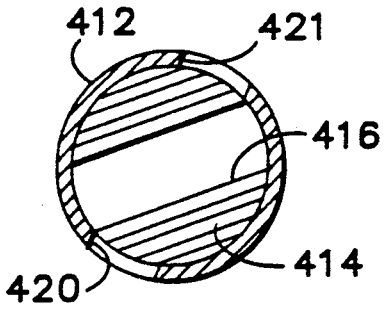
Figure 48B:
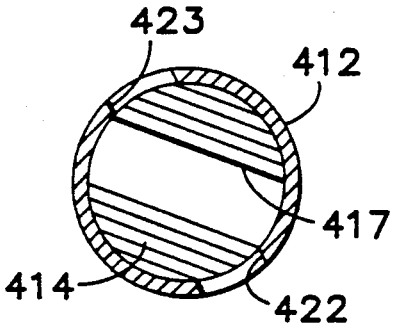
Figure 49B:
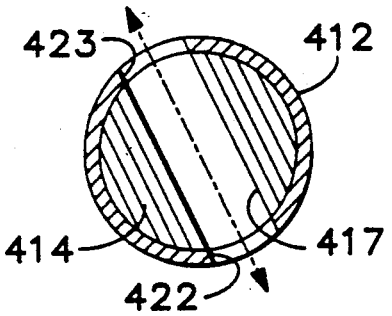
Figure 48C:
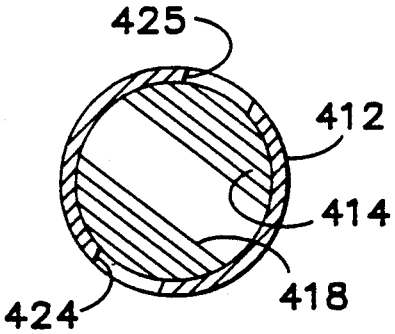
Figure 49C:
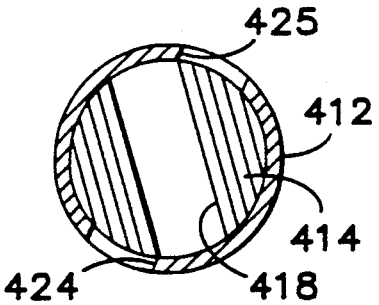
Figure 48D:
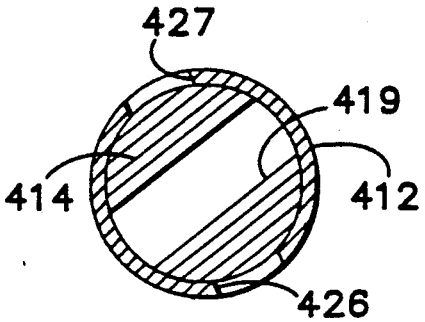
Figure 49D:
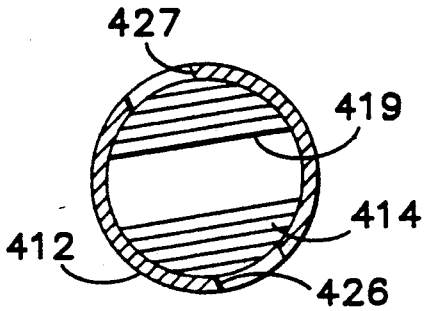
Figure 50A:
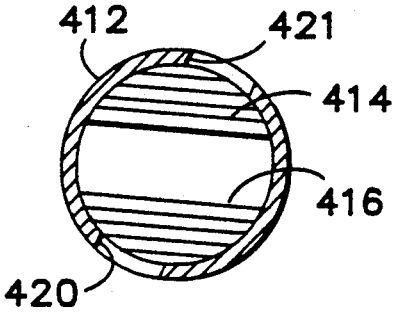
Figure 51A:
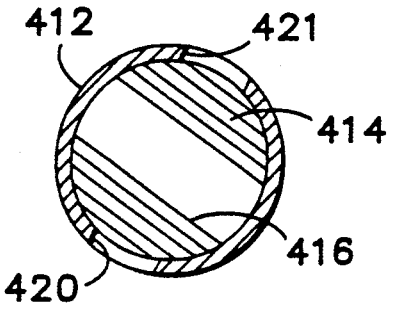
Figure 50B:
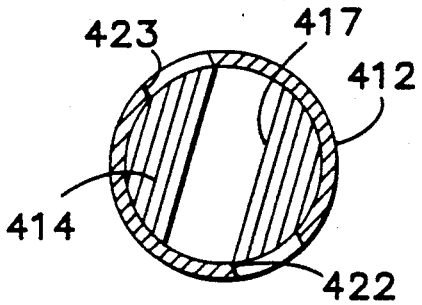
Figure 51B:
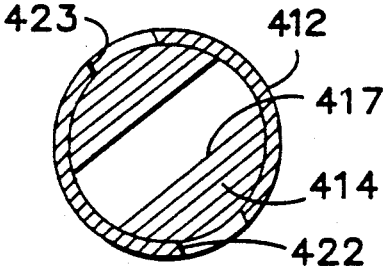
Figure 50C:
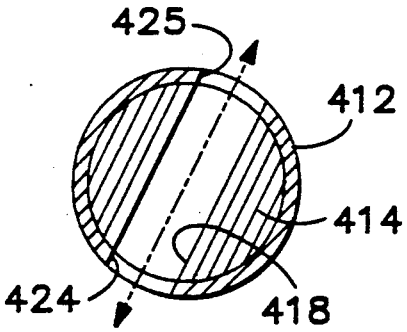
Figure 51C:
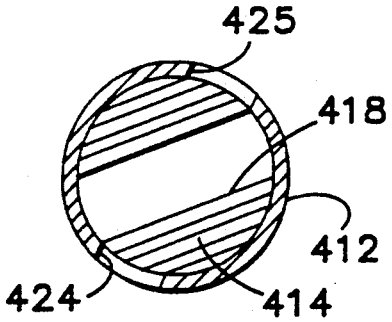
Figure 50D:
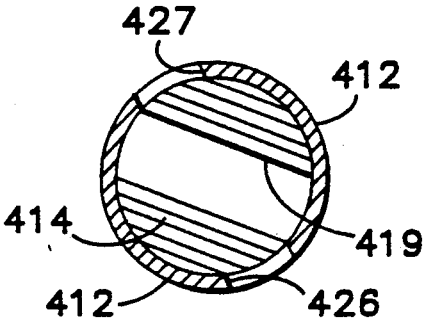
Figure 51D:
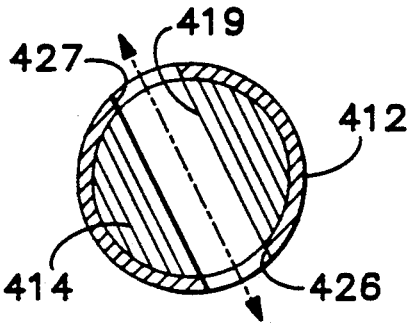

Referring now to FIG. 46, a simplified illustration of a core assembly 384 is shown. In solid lines is sleeve 412 with the core shown in dashed lines. With the core in the position shown, there is no passageway provided from outside of sleeve 412 through any of bores 416–419. This is what is referred to as a closed position for core 414. FIGS. 47A–47D illustrate in cross-section form the relative position of the holes and bores in the sleeve and core as taken along corresponding lines A—A through D—D of FIG. 46. It can be seen in these figures that there is no air passageway possible through core assembly 384.

FIGS. 48A–48D represent the positions of the various bores for a rotation of core 414 36° in a clockwise direction (as viewed in the figure). This aligns bore 416 with holes 420 and 421. This is the position also shown in FIG. 45. None of the other three bores 417, 418 or 419 are aligned with the associated holes in the sleeve. Thus a single passageway is provided to the panel channels associated with hole 421.

By rotating the core an additional 36° the positions of the respective bores are as shown in FIGS. 49A–49D. In these figures only bore 417 is in alignment with the associated holes of sleeve 412. This provides communication from the air supply associated with hole 422.

FIGS. 50A–50D and 51A–51D correspond to the relative positions of the core and the sleeve for successive increments of 36° of rotation. As can be seen, these provide for sequential alignment between bore 418 and holes 424 and 425 (FIGS. 50A–50D) and alignment between bore 419 and holes 426 and 427 (FIGS. 51A–51D).

Thus, there are five relative angular orientations of the core to the sleeve which provide for either a completely closed position or a selective communication between one of the air supplies and the respective channels in panel 164. As shown in FIG. 45 for hole 421, holes 421 and 425 are aligned with two of the channels in the panel whereas holes 423 and 427 are both aligned with the other two channels. Further, holes 421 and 423 are associated with a first air supply source and holes 425 and 427 are associated with the other air supply source. Thus, each pair of channels in the panel may be put in communication with either the positive or negative air supply, as desired by appropriate rotation of core 414 within sleeve 412.

The air pressure in individual cushions is monitored continuously. The cushions are selectively provided with positive and negative air supplies, as is required, to maintain them at the desired respective air pressures. The control system for controlling the manipulation of the core assemblies by stepper motors 382 associated with each valve unit will be discussed with reference to FIGS. 74–77. It can be seen though that through the use of valve assemblies or valve units 320 selective communication can be provided between the air supplies and corresponding ones of the four openings 328, the two intermediate openings 330 or the single enlarged opening 332. Thus, by the piggybacking of valve units in an orthogonal arrangement with the use of bypass unit 322 in each panel, all of the cushion supply holes on the upper surface of the panels can be monitored and maintained at a desired pressure.

The holes on the upper surface of panel 164 used to inflate a bladder or cushion preferably corresponds with the size of the cushion. That is a larger cushion requires a greater air flow and therefore is preferably connected to an enlarged air hole 332. Correspondingly, a small cushion can be inflated through one of the smaller air holes 328. Thus, a great deal of flexibility is provided by this feature of the invention. The capability is provided for using any arrangement of cushions desired on the bed and maintaining them at any desired pressures. Thus, the channels in panel 164 and associated valves provide a universal arrangement for connecting cushions to the air supply system. Standardization of manufacture is also provided. The arrangement of the cushions and pressures may be altered to fit different needs.

Figure 52:
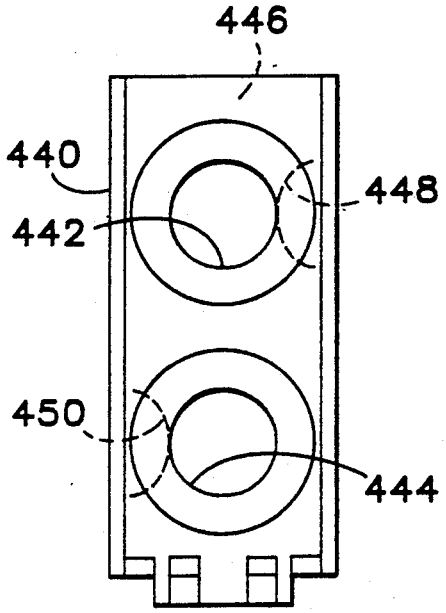
FIGS. 52—54 are views similar to FIG. 46 showing alternative embodiments of the valve core assembly.
Figure 53:
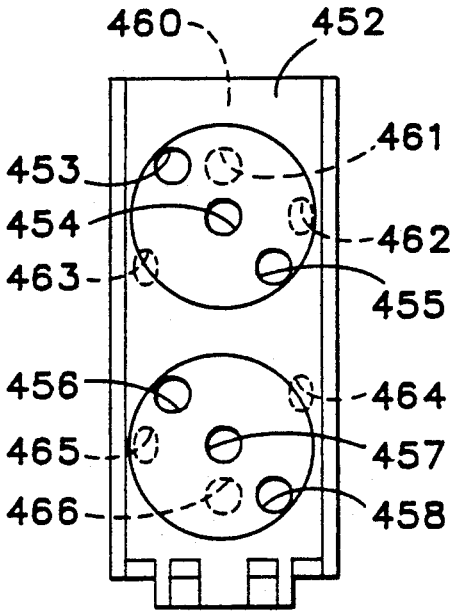
Figure 54:
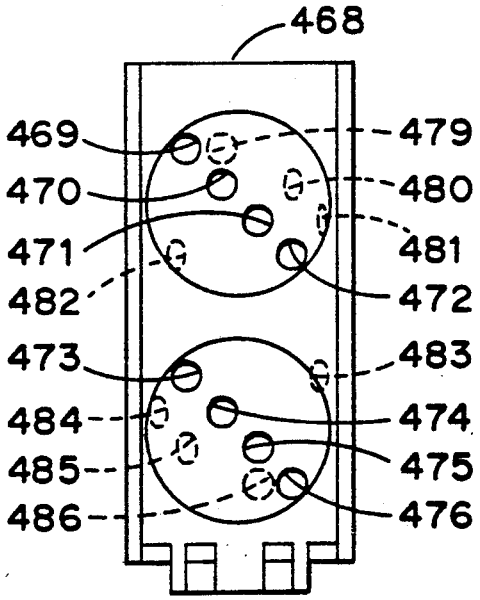

For example, different core embodiments are shown in FIGS. 52–54. In the embodiment of FIG. 52, a sleeve 440 has an upper opening 442 which is large enough to communicate simultaneously with two adjacent channels in the panel. Correspondingly, a lower opening 444 provides access of the channels to the second air source. The core 446 has a single similarly-sized bore 448 associated with hole 442 and a single bore 450 associated with hole 444.

FIG. 53 shows an embodiment wherein a sleeve 452 has three holes 453, 454 and 455 associated with the first air source and holes 456, 457 and 458 associated with the second air source.

A core 460 has corresponding bores 461, 462 and 463 associated with holes 453–455 and bores 464, 465 and 466 associated with holes 456–458, respectively. In this case rotations of the core relative to the sleeve are in increments of about 25°.

In a similar fashion a sleeve 468 shown in FIG. 54 has four upper holes 469–472 and four lower holes 473–476. The associated core 478 has corresponding bores 479–486. In this case, the core must be rotated in 20 degree increments to provide each of the selective settings so that only a single bore and hole align at any one time or none align.

Figure 55:
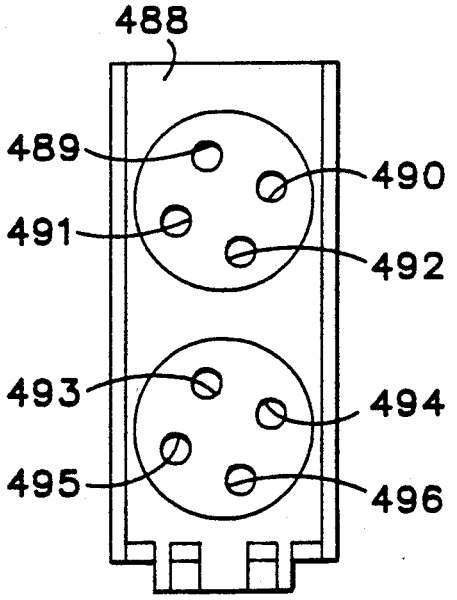
FIG. 55 is a view similar to FIG. 54 showing an alternative embodiment equivalent to that of FIG. 54.

It can be seen that the holes and bores in these embodiments have been provided so that the holes are in a step-wise orientation on the corresponding sleeve. These configurations can be changed while providing the same function for the core assembly. For instance, FIG. 55 shows an alternative arrangement to the sleeve of FIG. 54. In this case, a sleeve 488 has the corresponding holes 489–496 in a staggered arrangement which also requires the appropriate selective rotation of the core to provide for the same functional alignment between holes and bores. The associated stepper motor must be controlled in an appropriate fashion to provide for connection of the desired bore and hole for the particular settings. Certainly other configurations may also be provided.

Figure 56:
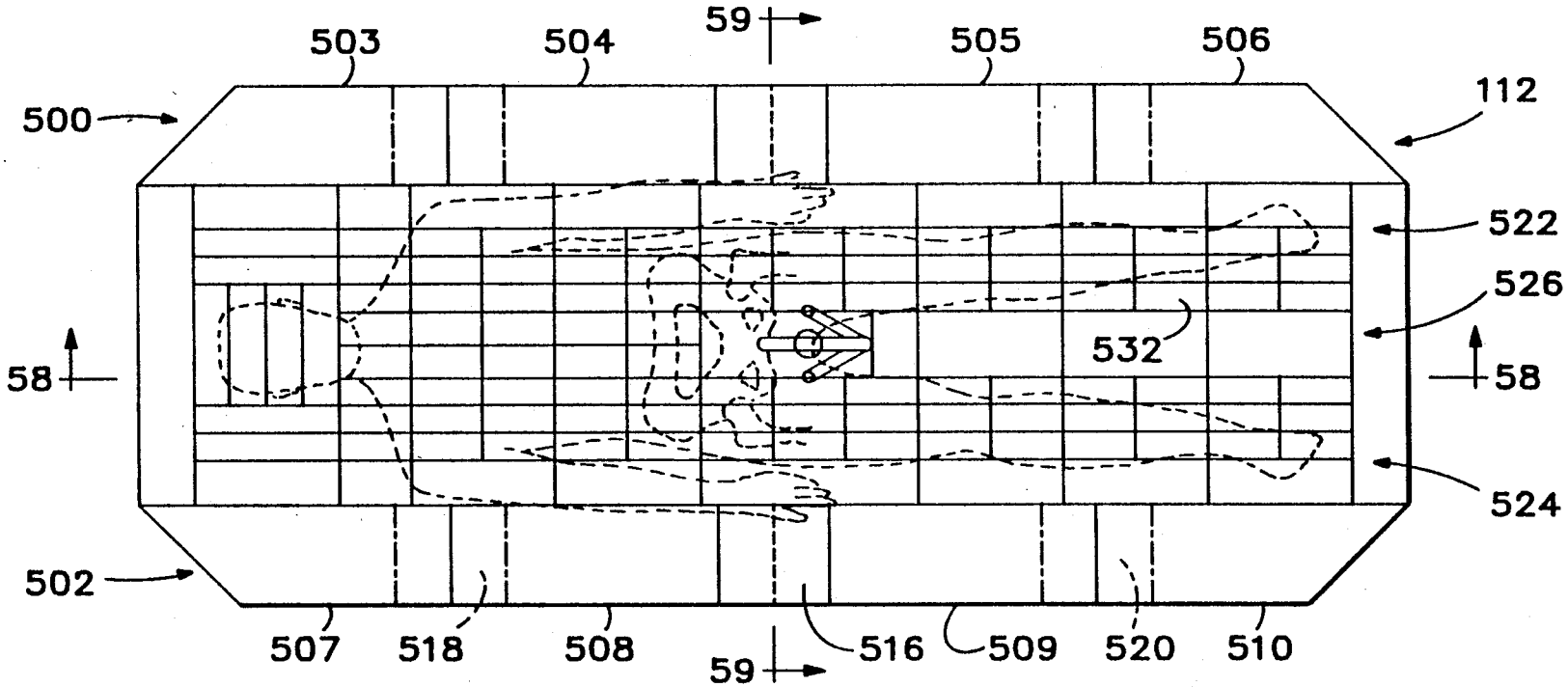
FIG. 56 is a top view of the mattress of FIG. 1.
Figure 57:
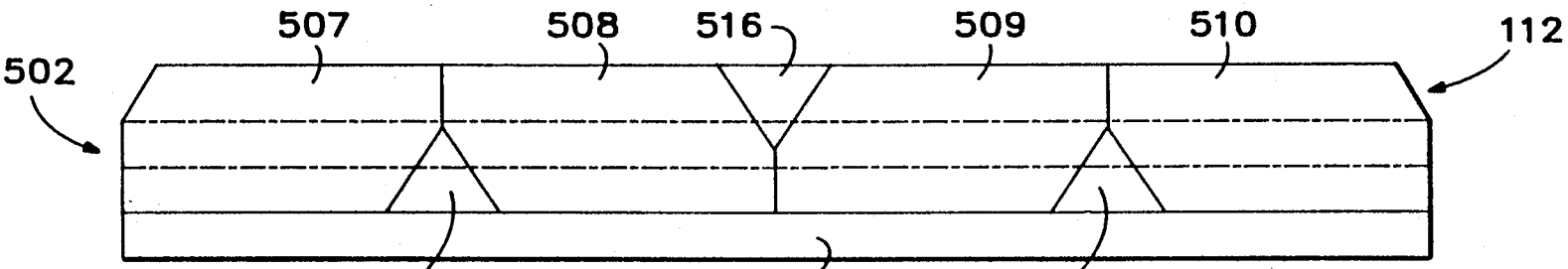
FIG. 57 is a side view of the mattress of FIG. 56.
Figure 58:
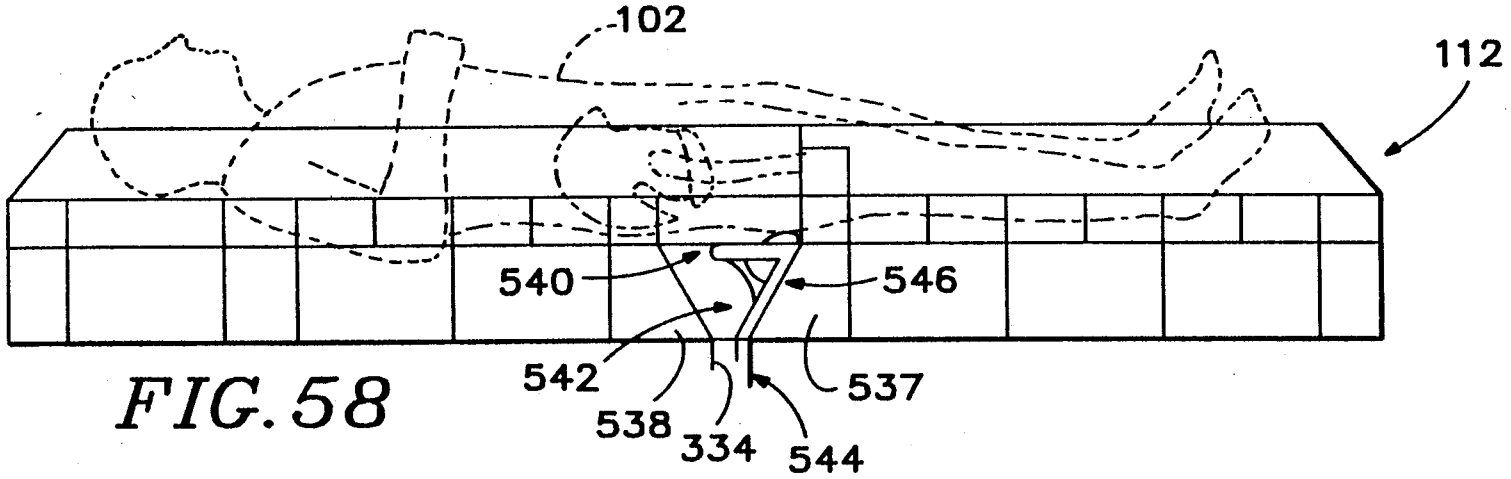
FIG. 58 is a cross-section taken along line 58—58 in FIG. 56.

FIGS. 56–58 illustrate an inflatable mattress shown generally at 112 forming a further portion of cushioning system 110. In this preferred embodiment, mattress 112 includes a substantial plurality of individual inflatable cushions. Disposed longitudinally along each side of mattress 112 are sets 500 and 502 of side restraining cushions, including individual cushions 503, 504, 505 and 506 forming set 500 and cushions 507–510 forming set 502. The side cushions are positioned on respective full length extending cushions 512 and 514.

In order to facilitate the bending of the bed into its various articulated formations, additional triangle-shaped cushions, as viewed from the side as shown in FIG. 57, are provided. For example a central and upper small cushion 516 can be deflated when the center of the bed is bent to correspond to the bending of a patient at the waist. Further, head and foot end triangle cushions 518 and 520 may correspondingly be deflated when those panels are bent for articulation in a way which would compress the triangle cushion. This facilitates manipulation of the bed while maintaining main side cushions 507–510 and 503–506 relatively fully inflated. Corresponding cushions also exist in association with cushion set 500. Further, when the side restraint panels are retracted, these cushions must be deflated so that the restraint member can pull in against the main panel of the bed. Cushion sets 500 and 502 are disposed above the panel extensions disposed along the sides of platform 106.

Although all of the cushions illustrating mattress 112 are shown in general rectangular form, it is understood that the pressure of these cushions is varied as is appropriate to suit the comfort and needs of a patient or individual being cared for. Further, these cushions are made of a plastic or other suitably resilient material so that the pressure can be varied and so that they conform to that of the body part which is resting on it or against it.

Inward from cushion sets 500 and 502 are supplemental lateral support cushion sets 522 and 524. These cushion sets are intended not to take the full weight of a patient, but rather are used to restrain and hold the patient within the main cushion section 526. These cushions are disposed in three vertical layers, including layers 528, 529 and 530. The upper layer 528 may be deflated when an attendant desires to gain closer access to a patient. Further, they may be left inflated during such time as an attendant is working on the patient while cushion sets 500 and 502 are deflated providing closer access to the patient.

Main cushion or mattress section 526 includes a substantial plurality of individual cushions. These cushions vary in density and location corresponding to the amount of weight which it is expected they will receive. Each of these individual little sections are approximately four inches long by two inches wide. An example of one of these cushions is cushion 532 disposed under the heel area of a patient lying thereon. An underlying cushion layer, formed of cushions such as cushions 535 and 536 shown in FIG. 58, is also selectively inflated and deflated when appropriate to obtain the desired pressure levels at the skin of the patient. Certainly any arrangement and size of cushions could be provided. However, the supporting air supply system described previously must be adequate to be able to provide controlled air pressure to the various individual cushions. Further, combinations of the individual cushions can be connected to the same air supply tube so that they are maintained at the same pressure. Thus, there is a reduced requirement for air supply access points.

Sanitation System

Figure 59:
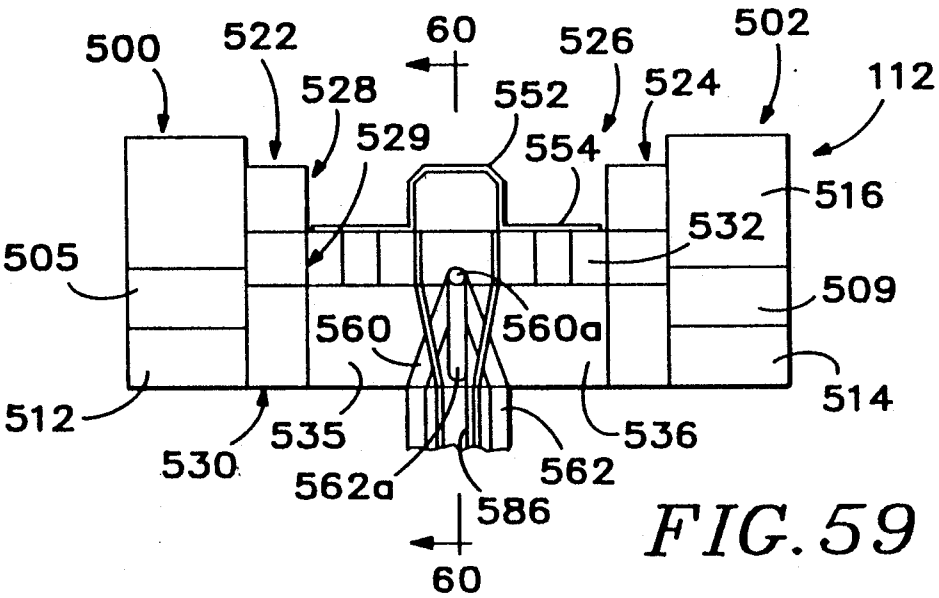
FIG. 59 is a cross-section taken along line 59—59 in FIG. 56 showing a sanitary system.

Disposed centrally of main support cushion region 526 is a sanitary disposal apparatus 534. This apparatus is shown from the side in FIG. 58 and in further detail in FIGS. 59–64. It will be understood that for patients who are capable of leaving the bed to take care of their sanitary needs, such a system can be replaced by an appropriate cushion. Sanitary system 534 is contained within side supporting cushions 532, 535 and 536 and downwardly and inwardly angled end cushions 537 and 538. Side cushions 535 and 536, as shown in FIG. 59 also provide for a narrowing or funnelling of the disposal region. These cushions thus define an enlarged upper deposit region 540 and a narrowed funnel region 542. Region 542 terminates in a passageway 544 which extends down through a waste hole 334 of the associated panel. An end deflector cushion 552 is disposed on the foot end of region 540 so that a relatively enclosed area defined by the patient's body and cushion 552 is formed.

Sanitary system 534 includes a plastic film or other suitable lining 554 which covers the inside of regions 540 and 542 as well as the surface area of the top of general cushion area 526 in the adjacent region. Liner 554 is disposable and extends down through aperture 334 in panel 164 to a terminal or coupling 556. Other means can also be used to protect the mattress. For instance a rigid insert or resilient member could be used. This coupling is disposed appropriately for connection to a coupling 557 of a receptacle or canister 558. Extending upwardly through the margin of coupling 556 outside of liner 554 is an air tube 560 and a warm water tube 562.

Air tube 560 extends upwardly adjacent cushion 536, and through liner 554 at a location (not shown) near its upper region to an open flap end **554*a*. When compressed air is forced into air tube 560, the air blows out of the flap end 554*a* and circulates inside of this region, to assist in drying the patient's skin and the upper region 540 of sanitary system 534**.

Water tube 562 also extends upwardly along cushion 536, through bag 554 at a location 564 and into region 540. Tube 562 terminates at an elongate arm **562*a* which is shown in a relaxed state in solid lines in FIG. 60. When water is forced into tube 562, end 562*a* stiffens, raising it to a horizontal position shown in dashed lines in the figure. A flexible webbing 566 limits the travel of arm 562*a* to the position shown. Webbing 566 could be replaced by a stop extending from liner 554** or other such apparatus.

The air and water can be provided by any apparatus that delivers them to the passageway and associated patient areas to provide suitable aeration and irrigation.

Figure 62:
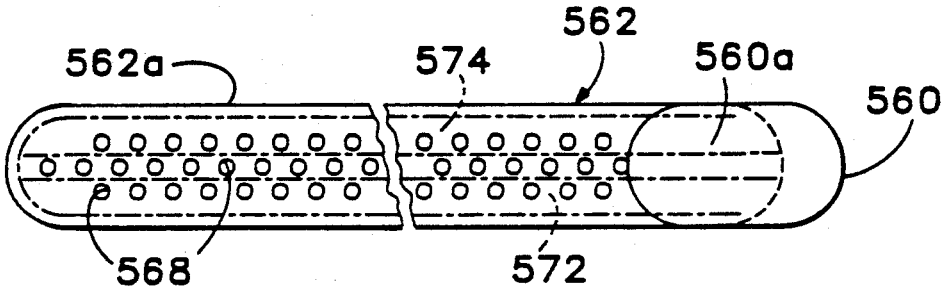
FIG. 62 is an enlarged view of the wash apparatus of FIG. 60.
Figure 63:
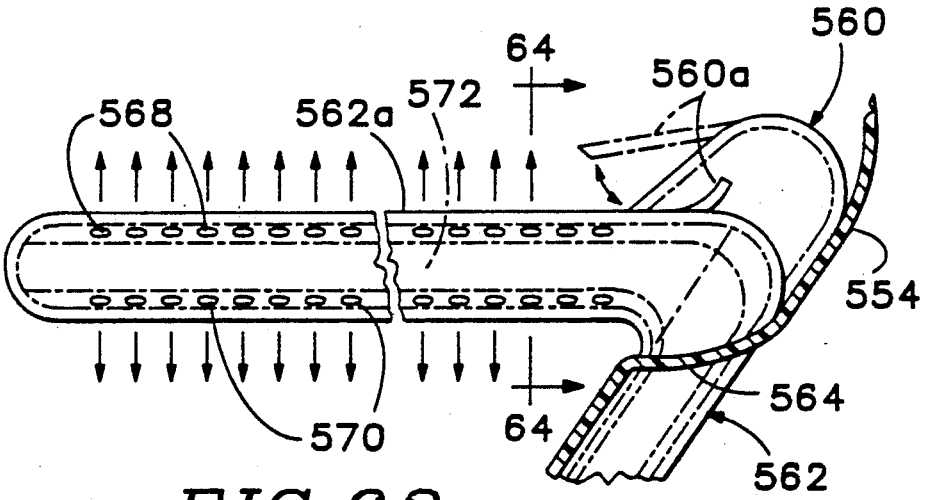
FIG. 63 is a top view of the apparatus of FIG. 62.
Figure 64:
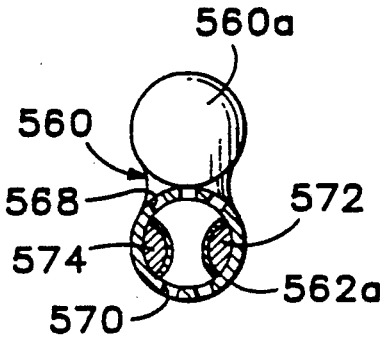
FIG. 64 is a cross-section taken along line 64—64 in FIG. 62.

FIGS. 62–64 illustrate in further detail the instruction of air tube flap end **560*a* and water tube arm 562*a*. FIG. 62 shows a side view of the flap end and water tube arm. FIG. 63 shows a top view of the view of FIG. 62. Water arm end 562*a* has a plurality of holes 568 distributed along the length of its upper surface. Similarly, there are a series of bottom holes 570 distributed along the length of its underside, as shown. Further, distributed along the inside lateral edges of arm 562*a* are a pair of oppositely disposed, generally rigid support members 572 and 574. These members extend the length of the arm and hold it in a linear orientation. It is preferable that these members be made of a relatively lightweight material, such as rubber or plastic. When water is forced into water tube 562 it pressurizes the tube causing the arm to extend from its relaxed position shown in FIG. 60 to the extended position shown in FIG. 62. Webbing 566** keeps it from extending beyond the horizontal position shown.

FIG. 62 illustrates the action of the flap end **560*a* of the air tube. When there is no air forced into the air tube the flap is in the lower position shown by the solid lines. When air is forced into the tube, the flap lifts up resulting in a jet of air expelling from under the flap, over water tube arm end 562*a*, and into region 540**.

Figure 60:
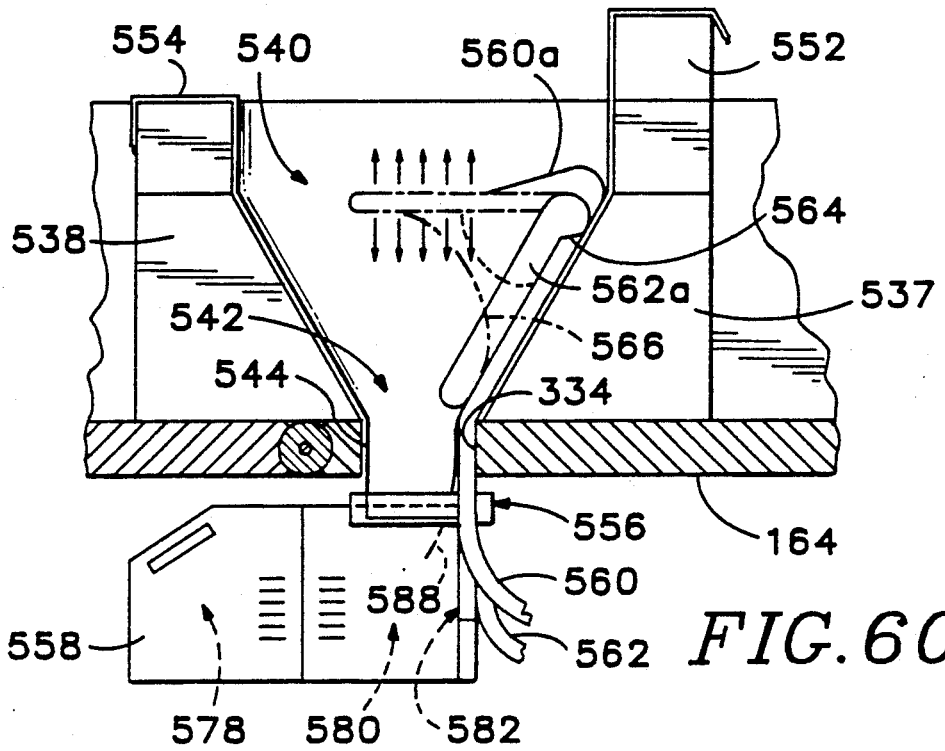
FIG. 60 is an enlarged cross-section taken along line 60—60 in FIG. 59.
Figure 61:
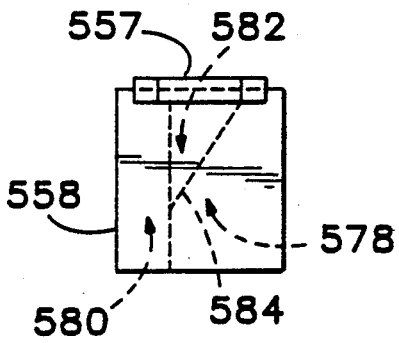
FIG. 61 is a view of the right side of the canister of FIG. 60.

Referring again to FIGS. 60 and 61, liner 554 at coupling 556 is connected to a canister 558 at corresponding and mating coupling 557. FIG. 61 shows the canister without liner 554 attached. Canister coupling 556 provides an opening to a first large chamber 578 which receives the bulk of the human wastes. There is a second, small chamber 580 disposed in the front region of the right side of canister 558, as shown in FIG. 60. Further, there is a narrow diversion channel 582 defined by a slanting plate 584, shown in FIG. 61. Diversion channel 582 is enclosed on both sides, open to the top through canister coupling 576, and open in the front to small chamber 580. This channel directs a urine sample from the patient into chamber 580. To facilitate this, a urine sample receipt tube 586 is mounted on the inside of liner 554 between the water and air tubes, as shown particularly in FIG. 59. This tube leads down to an open end in bag coupling 556. A flap of plastic 588 extends down beyond the upper opening of diversion channel 582 and below the end of tube 586. This assures that fecal matter and other unwanted debris will not enter the urine sample container 580. Air tube 560 and water tube 562 extend down the outside of liner 554 and pass through access holes 336 and 338 in panel 164, described previously.

It will be appreciated that other forms of waste receipt and urine sampling may be used. For instance a manual valve or damper could divert the appropriate wastes to each receptacle if delivered at different times. Further, the outlet of the liner could be coupled to a conventional sanitary system for discharge. Other arrangements are also possible.

Before the patient is put in the bed, liner 554 is placed within the disposal region defined by cushions 535, 536, 537 and 538. Coupling 556 is placed down through opening 334 in panel 164. Canister 558 is placed under the bed and connection is made between couplings 556 and 557. After the patient has relieved himself or herself, the attendant can soap the appropriate areas of the patient. Warm water is then sprayed into region 540 and against the associated areas of the patient's skin. After this rinsing operation, warm air is blown in through air tube 560 and out flap end 560*a*. This helps to flush residual water down into canister 558 and dries the patient.

After this cleansing operation is completed, canister 558 may be removed and its contents discarded. A replacement canister can then be inserted for the next procedure. Thus, liner 554 is reusable. It also is easily replaced. The patient is simply rolled to one side and the apparatus removed for disposal. A new liner 554 is inserted in its place. In this way, the patient's needs can be easily taken care of without substantially disturbing the patient. The patient's skin is cleansed and dried so that chafing and other skin problems should not arise.

Figure 65:
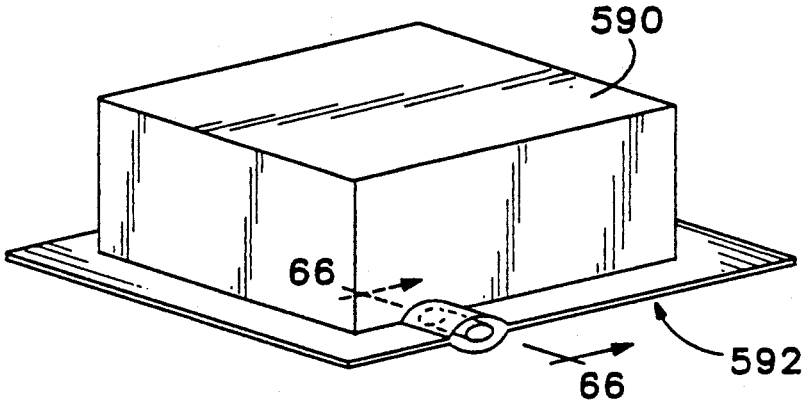
FIG. 65 is a simplified isometric view of a cushion used in the mattress of FIG. 56.
Figure 66:
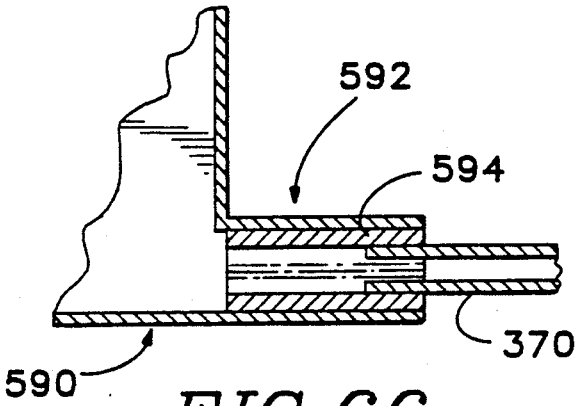
FIG. 66 is a cross-section taken along line 66—66 of FIG. 65.
Figure 70:
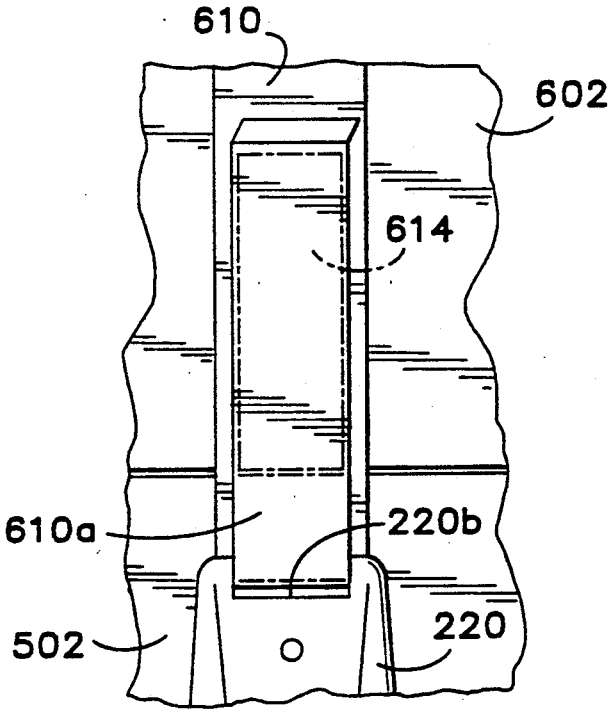
FIG. 70 is an enlarged side view of the attachment apparatus used on the restraint cushions of FIG. 67.
Figure 71:
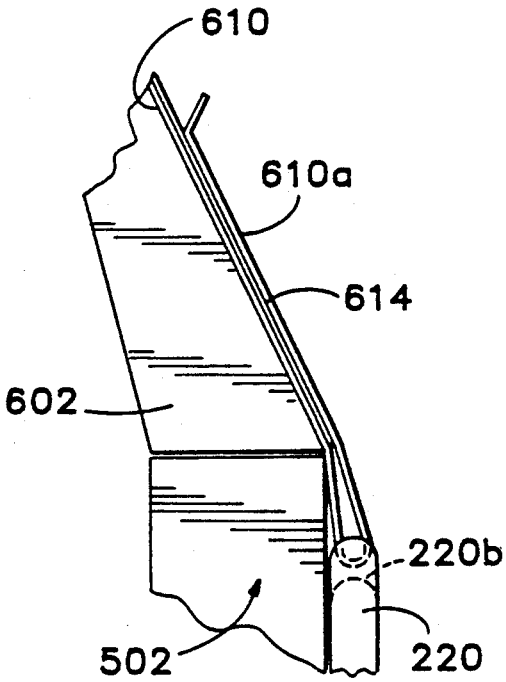
FIG. 71 is a side view of the apparatus of FIG. 70.

Referring now to FIGS. 65 and 66, a simplified cushion 590 is shown coupled to a connecting air tube, such as tube 368 or 370 mentioned earlier with reference to FIG. 36. Cushion 590, forming one of the cushions on mattress 112, is formed of an envelope in a desired shape. The cushion is made with a double flap 592 of material extending around the margins of one side of the cushion. This flap 592 is formed of extensions of appropriate sides of the cushion. Sealed between the two sides of material in flap region 592 is a generally round tube section 594 which extends from externally of the flap to the interior of cushion 590, as shown particularly in FIG. 66. A tube, such as tube 328 can then be directly connected to interior tube 594 to provide the necessary pressure regulation within cushion 590 as desired. It can be seen that this construction is very simple and provides for effective connection of the air hoses to the cushions.

During formation of a mattress 112, flaps 592 of each cushion are of course folded down so that they do not interfere with the stacking and orientation of adjacent cushions. Further, adjacent cushions are preferably held in position by attachment of appropriate self-attaching strips, such as are known commercially by the proprietary name Velcro. The application of appropriate air pressures to the cushions, also holds them in the desired configuration, since, when they are fully inflated, they fit snugly together as a single unit. When an individual cushion is deflated, for instance in order to remove the pressure from a particular area of the patient's body, then the other surrounding cushions are held in position by the self-attaching material.

Extraordinary Patient Restraint System

Figure 67:
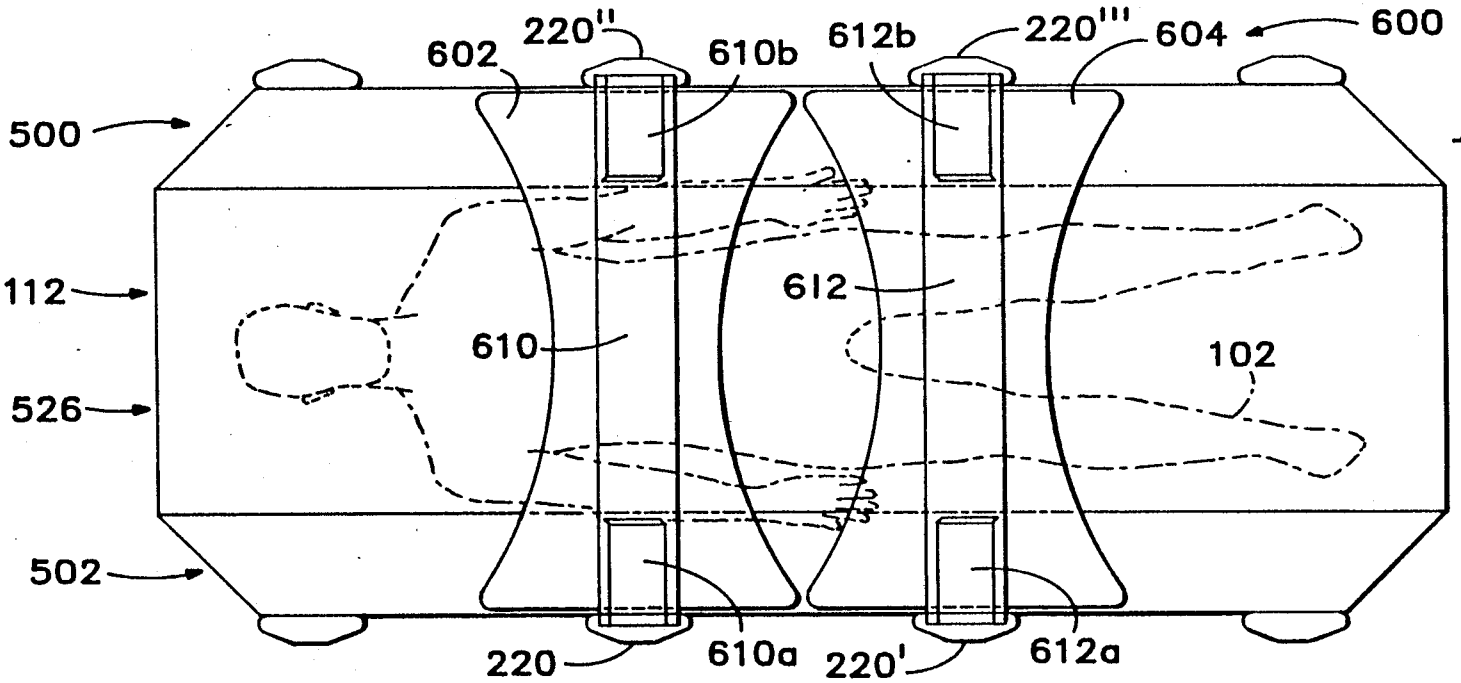
FIG. 67 is a simplified top view of the system of FIG. 1 with patient restraint cushions attached.
Figure 68:
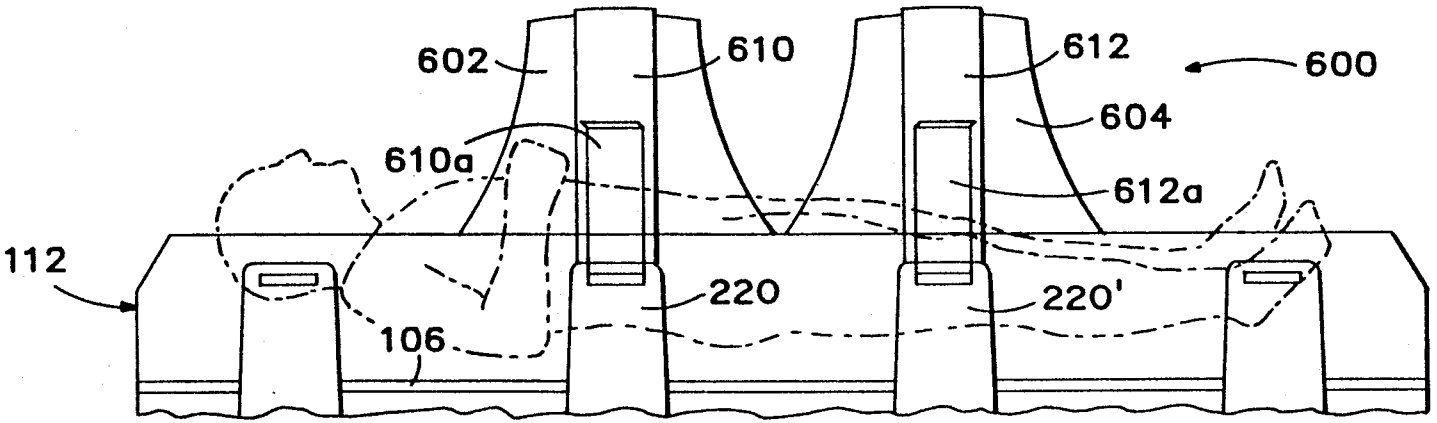
FIG. 68 is a side view of the apparatus of FIG. 67.
Figure 72:
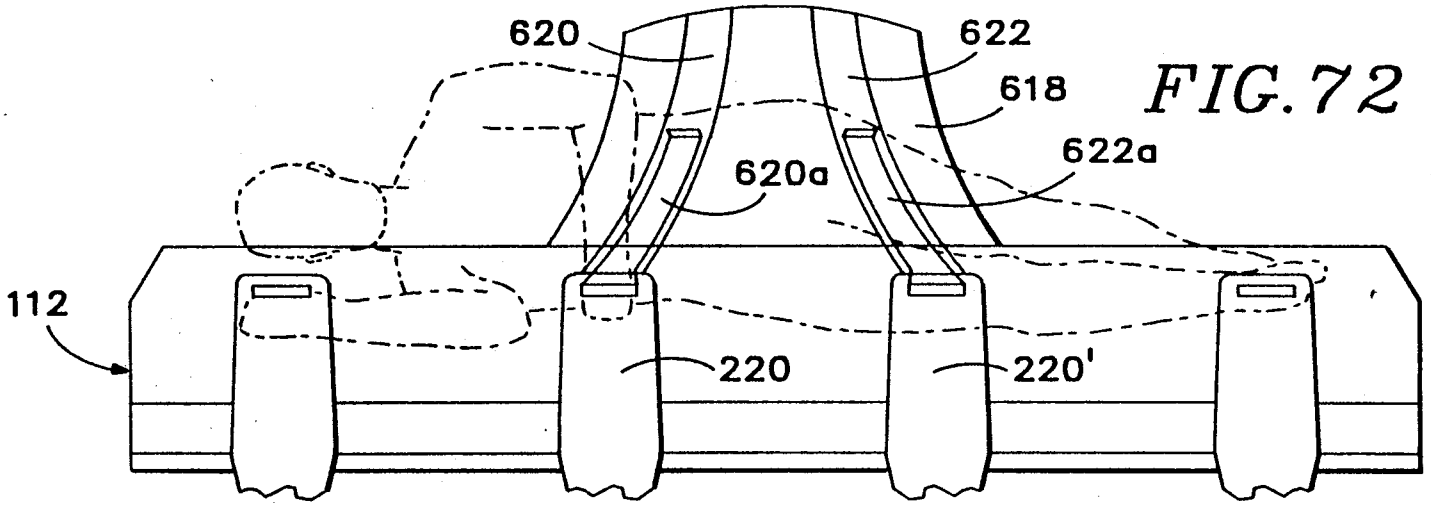
FIG. 72 is a side view similar to FIG. 68 showing an alternative embodiment of a restraint cushion.
Figure 73:
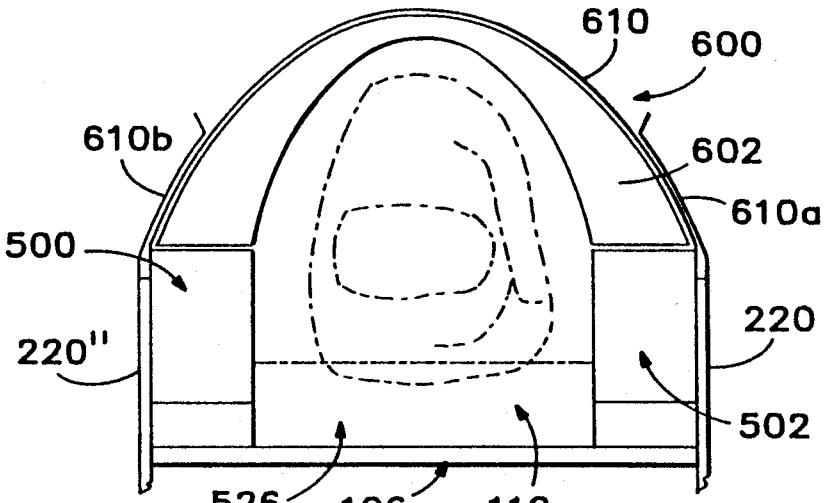
FIG. 73 is a head-end view of the apparatus of FIG. 72.
Figure 69:
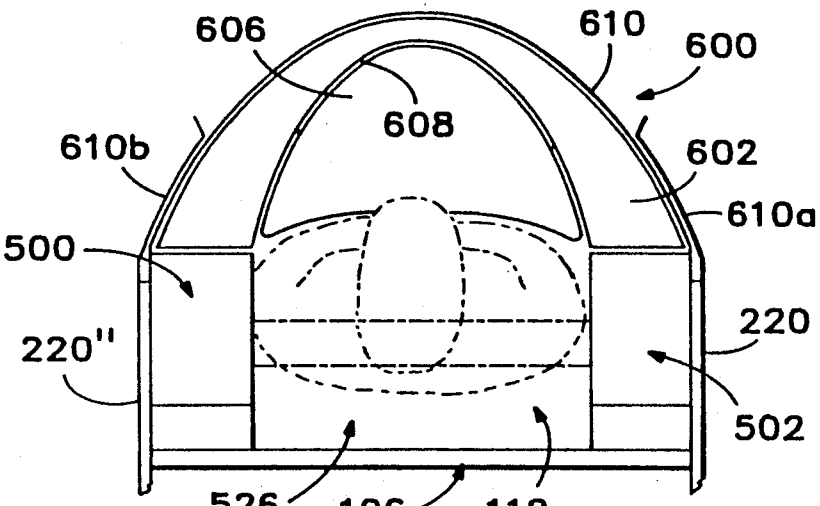
FIG. 69 is a head-end view of the apparatus of FIG. 67.

An extraordinary patient restraint system 600 is shown generally in FIGS. 67–73. FIGS. 67–69 show a first use of system 600 in which the patient is laying on his or her back. This system provides for substantially complete restraint of the patient within the bed without creating undue pressure against the patient in this configuration. In the embodiment shown in FIGS. 67–69, inflated restraint cushions 602 and 604 extend laterally from side restraint members 220 and 220' to the opposite corresponding restraint members 220'' and 220''', respectively. As shown in FIG. 69, cushions 602 and 604 are arc-shaped extending from lateral restraint cushions 502 and 500 up and over the patient. In FIG. 69 an interior, further restraining cushion 606 may also be placed within cushion 602 and/or 604 to hold the patient in a position lying flat on his or her back. These cushions are also held together by self-attaching material, such as strip 608 shown in FIG. 69. If it is not necessary to restrain the patient that extensively, cushion 606 can be removed, thereby allowing the patient to lay on his or her side, as shown in FIG. 73.

Cushions 602 and 604 are held in position on cushions 500 and 502 by straps 610 and 612, respectively, which extend over the cushions and through slits 220*b* in each of the associated side restraint members.

Each strip 610 extends down through slit 220*b* and has attaching ends 610*a* and 610*b*. Similarly, strip 612 has ends 612*a* and 612*b*. These attaching ends are attached to portions of the main strap by a self-attaching material 614. It is preferable that straps 610 and 612 be fixedly attached to the corresponding cushions 602 and 604, such as by appropriate adhesive or, alternatively, by a material like material 614. It will thus be appreciated with the easy mounting provided by strap attaching ends 610*a* and 610*b* and 612*a* and 612*b* that a patient can easily be strapped into the restraining system 600. The restraint cushions can also be removed very quickly and easily when immediate access to the patient is desired. Other arrangements such as belt and buckle or the like could also be used.

An alternative embodiment to system 600 described with reference to FIGS. 67–69 is shown in FIG. 72. This is a system 616 which provides for patient restraint across the mid region of the patient and requires a single enlarged restraint cushion 618 which is structured similar to that described for cushion 602 and 604, except that it is longer than either of those cushions. Further, it attaches to two side restraint members 220 and 220' on each side of the bed so that this cushion is held in place very strongly, by appropriate straps 620 and 622 which have attaching ends, such as ends 620*a* and 622*a* shown in the figure. These ends attach just like attaching ends 610*a* and 610*b*. If desired, an inner restraining cushion similar to cushion 606 described previously could also be used in this system.

Although not shown, it is preferable that the restraining cushions be coupled to pneumatic system 315 for quick inflation and deflation. Foam cushions could also be used.

Cushioning Control System

Figure 74:
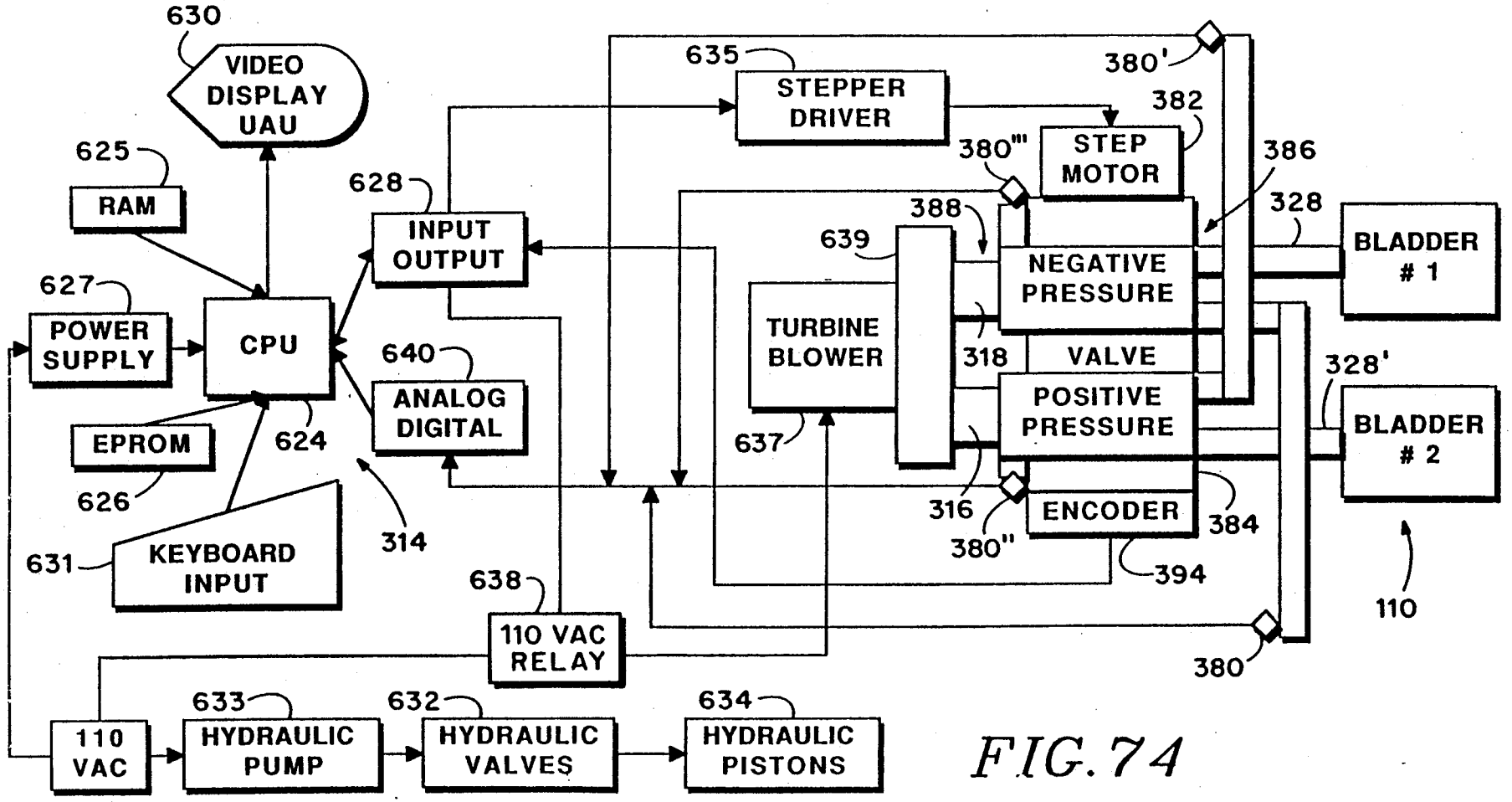
FIG. 74 is a block diagram of the control system of the patient support system of FIG. 1.

FIG. 74 illustrates the hardware associated with system 100 which includes controller 314 for cushioning system 110. A central processor unit (CPU) 624 is coupled to a random access memory (RAM) 625 for storing data. A programmable read only memory (EPROM) 626 stores the control program for CPU 624. Power is supplied by a power supply 627. A display 630 coupled to CPU 624 is used to monitor the system. Parameters and variables are input on a keyboard 631. The control for supporting apparatus 108 is provided by a hydraulic valve 632 through an input/output (I/O) interface 628. This valve couples a hydraulic pump 633 to pistons 634 associated with the various hydraulic support arms described previously.

Each stepper motor 382 is driven by a stepper driver 635 coupled to the CPU through I/O 628. The encoders 394 associated with valve assemblies 384 are coupled to bus 629 through a digital input or register 636.

An air pressure turbine 637 is connected to 110 A.C. voltage through opto/relay 638. The turbine drives air through an inlet/exhaust valve 639 to provide an inlet or positive pressure through a conduit such as tube 316, described previously. The negative or exhaust air passes through a conduit or tube such as tube 318. If air passes through the fabric of mattress 112 against the patient's skin, an appropriate heater and/or dehumidifier may be provided on the inlet tube side to condition the air prior to introduction into the mattress. As mentioned previously, the inlet and exhaust air is fed through air passageway assembly 388, through valve core assembly 384, and into the channels in panel 164 through interface region 386. From there they pass through tubes such as tube 328 and 328' into individual bladders or cushions.

The pressure transducers 380 and 380' which are positioned in the channels in panel 164 generate signals which are fed back through an analog to digital converter 640 which then relays the information to CPU 624. Similarly, the outputs from pressure transducers 380'' and 380''' which are sensing the inlet and exhaust air pressures in assembly 388 also feed through converter 640 to CPU 624. Thus, the pressure inside the bladders and the pressure being fed to the bladders on the turbine side of the valves are constantly monitored to maintain them at desirable levels. Force-sensing resistors can be added to the patient-contact surfaces of the bladders for calibrating the transducers.

Figure 75:
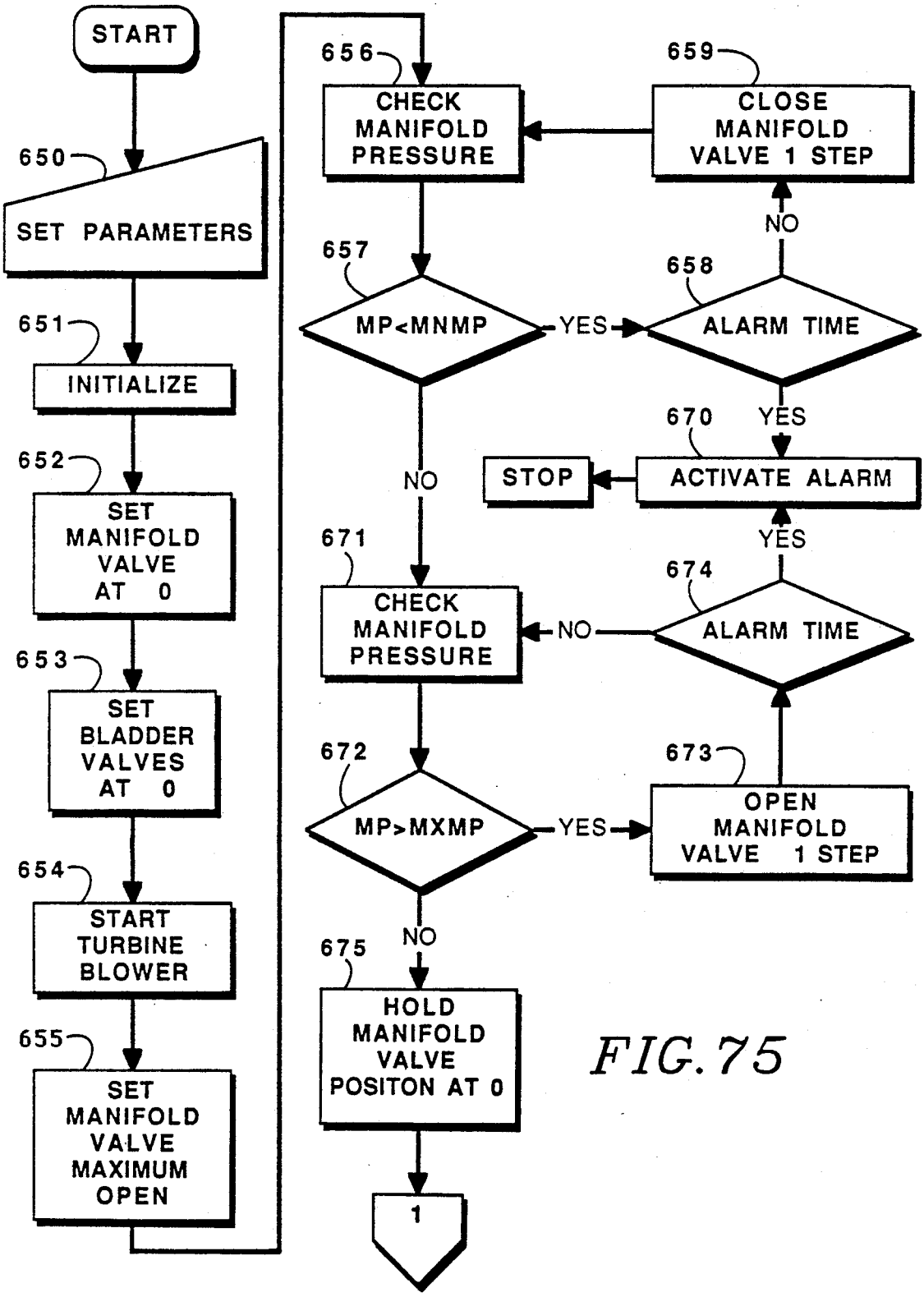
FIGS. 75–77 are flow charts describing operation of the control system of FIG. 74.
Figure 76:
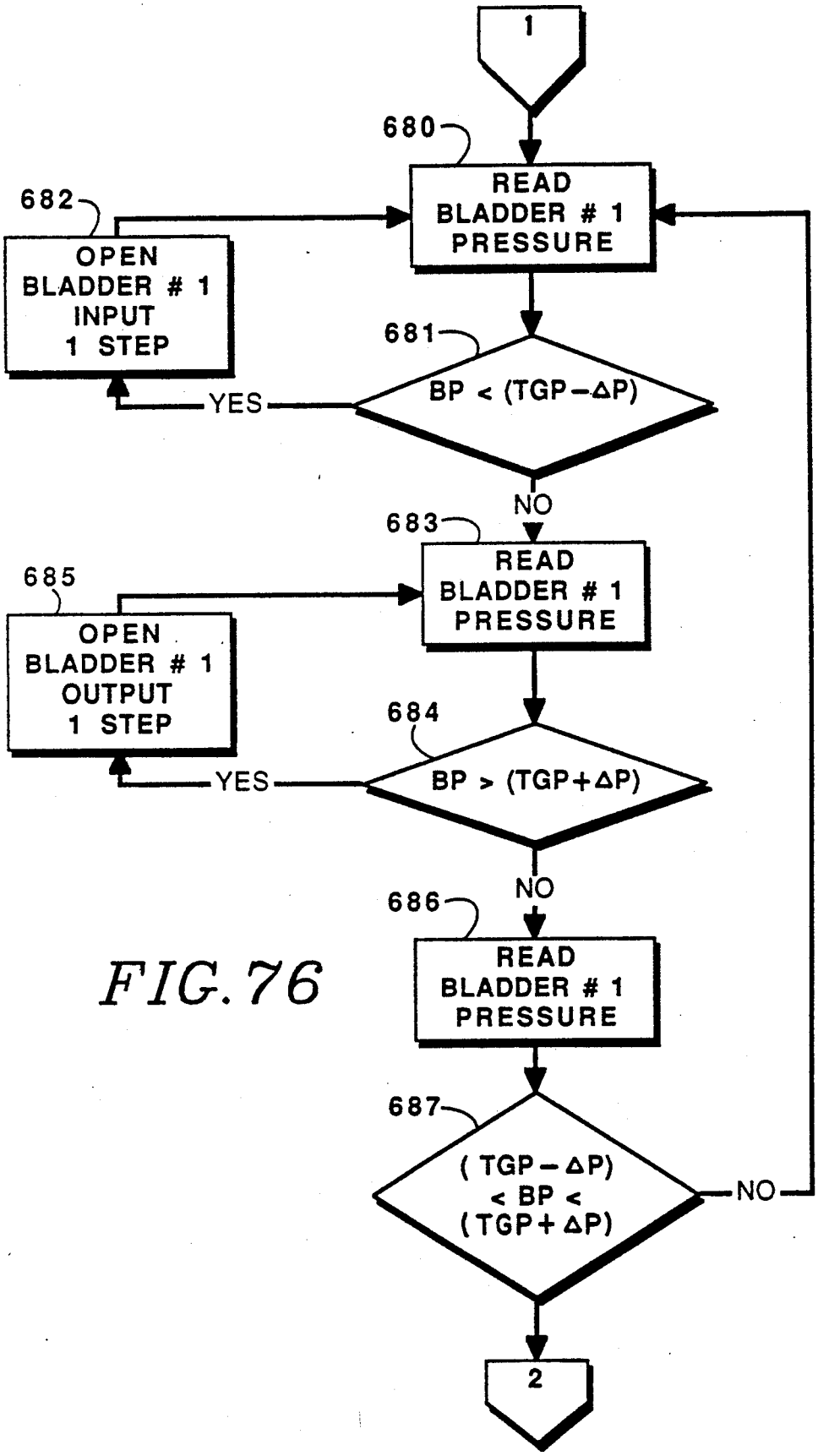
Figure 77:
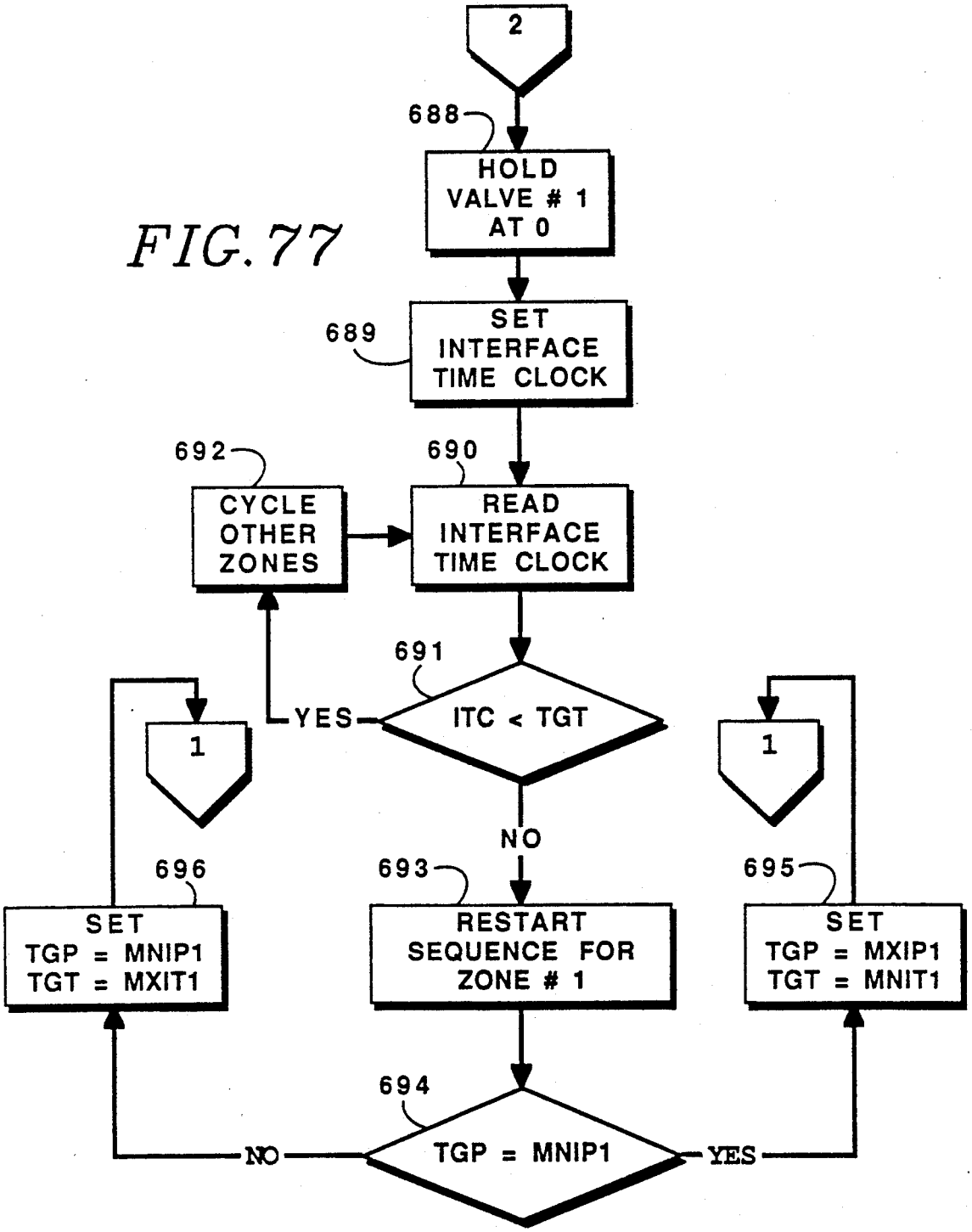

The software associated with CPU 624 which controls the manipulation of pressure in the individual bladders or cushions, is shown in FIGS. 75–77. In particular, FIG. 75 shows the initialization phase of operation of support system controller 314. FIGS. 76 and 77 then illustrate the control of the pressure over a predetermined period of time within a single zone of bladders within cushion 110.

Referring first to FIG. 75, the program is started at block 650 by setting parameters and variables for the system, such as the minimum and maximum manifold pressures, the size of the valve core orifices used, the time allowed before an alarm situation is to be sounded during initialization, the volume of the individual bladders and the maximum and minimum interface pressures and times. For each pressure period of the cycle a predetermined time is set so that the pressure is maintained for a desired duration.

The system is then initialized by setting variables appropriate during operation of the cycles at their initial values in a block 651. Accordingly, the manifold valve is set at a zero position and all of the encoders associated with the various bladder valve assemblies throughout the support system are also set at zero position to prevent any air from being put into or taken from the individual bladders. These activities occur in blocks 652 and 653. In block 654 the turbine is started. Once started the manifold valve is opened at block 655.

The manifold pressure is then checked at block 656 and compared to the minimum desired manifold pressure at a decision block 657. If the pressure is below the minimum then a determination is made at block 658 as to whether the time before an alarm condition has expired. If it has not then the manifold valve is closed at block 659 by an incremental amount so that the manifold pressure increases. If the alarm time has elapsed then the alarm is activated at block 670 and the system brought to a stop.

Once the manifold pressure exceeds the minimum manifold pressure the manifold pressure is again checked in a block 671 and a determination made at block 672 as to whether the maximum manifold pressure is exceeded. If it is, the manifold valve is incremented at block 673 to decrease the pressure. Again the alarm time condition is evaluated at decision block 674. If the alarm time has passed then the alarm is activated as indicated previously by block 670 and the system stopped. Otherwise the manifold pressure is again checked in block 671. This loop continues until the manifold pressure reaches the maximum pressure. The desired manifold pressure is now reached and the valve is held at position zero to maintain this pressure at block 675.

The system is now ready to manipulate the air pressure in the individual bladders based on zones of bladders within mattress 112. This procedure is described in the flow chart of FIGS. 76 and 77. The bladders in mattress 112 are divided into zones determined primarily by the individual valves which feed them. However, a plurality of valves may be controlled within a single zone or different bladders may be controlled if they are inflated via separate channels within panel 164 from those of the other bladders serviced by the same valve.

The pressure in a first set of bladders making up an exemplary zone 1 is performed at a block 680. This bladder pressure is then compared to an input target pressure minus a delta pressure. This delta pressure provides for an acceptable range of pressures relative to the target pressure. If the bladder pressure is less than this value as determined at decision block 681 the bladder input is opened incrementally to increase the pressure in the bladder at block 682. Once the bladder pressure reaches this minimum level for this portion of the cycle the bladder pressure is again read at a block 683. This time the system determines at a decision block 684 whether the bladder pressure exceeds what might be considered the maximum pressure within the acceptable range (the target pressure plus the delta pressure). If the pressure exceeds this maximum pressure then at block 685 the output for that bladder is opened to decrement the pressure within it. This loop continues until the bladder pressure is reduced below the maximum for the range.

Again at block 686 the pressure is measured. At a test block 687 the pressure is compared to the maximum and minimum pressures relative to the target pressure to determine if it now has reached the intermediate pressure range. If it has not, then the full adjustment cycle is repeated beginning with block 680 until the bladder pressure is within the desired range. Once it is, the valve position is held at zero so that the pressure does not change within that bladder as indicated at box 688 (FIG. 77). The interface time clock for zone 1 is then set at block 689 based on the input values. The interface time which has elapsed is read at block 690 and a decision made at block 691 as to whether the interface time clock is less than or equal to the target time for this cycle and pressure. If it is less than the target time, then the various other zones and bladders are evaluated through a repeat of procedures similar to that described for this zone as indicated generally by a block 692.

This cycle continues until the elapsed time as indicated by the interface time clock is greater than or equal to the target time. If it is then this phase of the cycle is terminated. A block 693 restarts the sequence again for zone 1. This is accomplished by determining whether the target pressure presently used as indicated at block 69 is equal to the minimum interface pressure for that zone. If it is equal to the minimum, that indicates that the last phase of the cycle was done at the minimum pressure and that the maximum pressure should now be used. Thus, at block 695 the target pressure is set equal to the maximum interface pressure for that zone and the target time is set equal to the minimum interface time. This interface time is indicated as being minimum only in that it relates to the time set for the maximum pressure.

If the target pressure is not equal to the minimum interface pressure at block 694 then in fact the target pressure is set to this minimum value and a corresponding target time is set to the corresponding maximum interface time for that zone. Then the system returns to block 680 (FIG. 76) to readjust the bladder pressure to bring it within the acceptable range for the new values of target pressure and this is held for a duration based on the new target time while other adjustments are made for the bladders in other zones throughout cushion mattress 110.

It can be seen in this system that any combination of times and pressures can be used for any desired combination of zones of bladders as is appropriate to fit a given situation. It is anticipated that the basic system would be operated between manifold pressures of approximately ±250 mm Hg relative to atmospheric pressure and skin interface pressures of 0 to 160 mm Hg. These high pressures, when applied to a particular portion of the body surface, prevent interstitial blood flow. They are maintained for less than one-half hour, after which it is substantially completely relieved, thereby allowing full blood flow.

This procedure is equivalent to what happens when a healthy individual is sitting or laying in bed. When enough pressure is maintained sufficiently long on a body part, discomfort develops. The person completely changes position to totally relieve that area. In system 100, the pressure is relieved by increasing the pressure in nearby zones so that sufficient general support is provided to totally relieve that area and thereby relieve any buildup pressure that may exist adjacent to affected bone locations. That is, the pressure is relieved from all zones which support the part of the body supporting the weight applied by an affected bone. For instance, the pressure under one side of a buttocks could be very high for a designated minimum period of time. After that time, it is completely relieved by providing support with the other buttocks, the upper leg and the lower back region. Thus, the pressure associated with the bone in that side is completely relieved.

This cycling of pressure from very high to very low values continues in a coordinated procedure for all portions of the body. Circulation in any location is not terminated for more than an acceptable period of time after which it is fully relieved to thereby allow full circulation.

Further, in the instance of an existing bed sore, it is desirable that there be no pressure at all until the wound is able to heal sufficiently to support body weight.

This preferred embodiment provides a way of providing and controlling bladder pressures which allows a variety of pressures to be used so long as they are between the minimum and maximum source pressures. If standard pressures are provided, control would be by simple valving between the two sources. One of the sources could simply be venting to the air. With a fast feedback system and controlled valving, valves could be connected continuously to the sources until the desired pressure is reached. Thus, various mechanical and control designs can be used.

SUMMARY

It will be appreciated from a review of the preceding detailed disclosure that the present invention and its various features and aspects provide a substantially complete patient support system which is able to position a patient in a wide variety of positions. Further, the cushioning system may be divided into a multiplicity of individual bladders or cushions which may be individually or generally controlled so that the effect of pressure on the body can be completely controlled. Extended pressures on the body may be prevented, thereby preventing bed sores. It also allows for maintaining an individual region without pressure to allow for complete healing of an existing bed sore before it is required for support of the patient.

Further, extraordinary restraint systems, sanitary systems, lateral patient restraint systems, and auxiliary and accessory equipment support apparatus are provided which create a single unitary system which provides all of the support needs of a great variety of patients and patient treatments.

It will therefore be appreciated, particularly by those skilled in the art, that although the invention has been described with reference to a single preferred embodiment, there may be substantial changes made in the design of the preferred embodiment without parting from the spirit and scope of the invention as defined by the claims.

I claim:

1. A patient support system comprising:

a base frame supportable relative to a floor;

an elongate platform extending along a longitudinal axis and relative to a platform plane generally parallel to the plane of the torso of a patient disposed in a supine or prone position relative to said platform along said longitudinal axis; and means for supporting said platform relative to said base frame comprising means defining three axes of pivoting of said platform relative to said frame, characterized in that none of said three axes are perpendicular to said platform plane, and on each axis there exists a first point that is closest to a first of the other axes and a second point, spaced from the first point, that is closest to the second of the other axes, and means for pivoting said platform independently about each of said three axes for varying the pitch, roll and distance of said platform relative to said base frame.

2. A system according to claim 1 wherein said pivoting means moves the longitudinal axis of said platform about a first of said axes in a plane, whereby the pitch of said platform is varied directly by pivoting about said first axis.

3. A system according to claim 2 wherein said first axis is substantially perpendicular to said plane of longitudinal axis movement, whereby pivoting about said first axis varies only the pitch of said platform.

4. A system according to claim 2 wherein a second and third of said axes intersect said plane of longitudinal axis movement at a point, whereby movement of said first axis about said point of intersection is provided by pivoting about said second and third axes.

5. A system according to claim 4 wherein said means defining said three axes comprises universal joint means posed between said base frame and said platform, said pivoting means pivots said universal joint means about said first axis, and said point of intersection of said second and third axes is at said universal joint means.

6. A system according to claim 5 further comprising means defining a fourth axis parallel to said first axis and spaced from said universal joint means, and wherein said pivoting means further pivots said universal joint means and said first axis about said fourth axis, thereby moving said platform along said longitudinal axis.

7. A system according to claim 5 wherein said pivoting means further comprises a pair of adjustable-length arms extending between said frame and said platform spaced from said universal joint means, and means for varying the lengths of said arms independently for pivoting said platform independently about each of said second and third axes.

8. A system according to claim 1 further comprising a mattress disposed on said platform for supporting a patient lying thereon, said mattress comprising a plurality of sets of inflatable bladders, a first set comprising at least one bladder having a width less than the width of said mattress and a length less than the length of said mattress, said one bladder being associated with a first body part supportable substantially completely by said one bladder when the bladders in said first set are maintained at a first pressure and supportable substantially completely by at least one bladder in another set when the bladders in said first set are maintained at a second pressure substantially less than the pressure in the bladders of the other set;

means for applying fluid to said bladders at said first and second pressures; and control means for controlling the application of said pressures selectively at said first and second pressures for first and second periods of time, respectively, such that said first body part is alternately supported substantially directly on said first set of bladders and supported substantially indirectly by adjacent body parts supported on other sets of bladders.

9. A system according to claim 1 wherein said platform comprises a plurality of mutually relatively movable panels, each panel being generally disposed in a plane and having opposite edges with each pair of adjacent panels having associated adjacent opposite edges, an adjustable-length panel arm coupled at opposite panel arm ends to associated adjacent panels, lever arm means for attaching each end of said panel arm to said associated panels at positions spaced predetermined distances from the planes of said associated panels, each of said lever arm means attaching to said associated panel at positions on said associated panel between said opposite edges of said associated panel and spaced apart at least the respective predetermined distances, and means for adjusting the length of said panel arm.

10. A system according to claim 9 wherein each of said lever arm means is attached to said associated panel at positions spaced apart, laterally relative to the longitudinal axis of said platform, at least the respective predetermined distance.

11. A system according to claim 10 wherein each of said lever arm means is attached further to said associated panel at positions spaced apart, in a direction paralleling the longitudinal axis of said platform, at least the respective predetermined distance.

12. A system according to claim 11 wherein each of said lever arm means comprises a brace plate suspended below said associated panel the predetermined distance, and support members attaching said brace plate to said associated panel at said spaced positions.

13. A system according to claim 9 wherein said supporting means includes a first supporting member posed between said base frame and a first panel, and a second supporting member posed between said base frame and a second panel different than said first panel.

14. A system according to claim 13 wherein said first supporting member comprises a universal joint means and said second supporting member comprises a pair of adjustable length support arms.

15. A patient support system comprising:

a base frame supportable relative to a floor;

an elongate platform sized to support thereon a person disposed along a longitudinal axis extending the length of said platform; and means for supporting said platform relative to said base frame comprising means defining first and second parallel and spaced apart, generally horizontal axes extending nonparallel to the longitudinal axis of said platform, and means for pivoting said platform independently about each of said first and second axes, whereby the distance between said platform and each of said axes is adjustable, said pivoting means comprising universal joint means interposed between said base frame and said platform, and first and second adjustable-length support arms extending from spaced locations on said base frame to said universal joint means, said first and second support arms respectively being pivotable relative to said base frame about said first and second parallel axes.

16. A system according to claim 15 wherein said platform comprises a plurality of mutually relatively movable panels, each panel being generally disposed in a plane, and means for moving a first of said panels relative to an adjacent one of said panels, said supporting means supporting said first panel relative to said base frame exclusively on said universal joint means.

17. A system according to claim 16 wherein said supporting means further comprises a support member posed between said base frame and a second panel different than said first panel.

18. A system according to claim 15 further comprising a mattress disposed on said platform for supporting a patient lying thereon, said mattress comprising a plurality of sets of inflatable bladders, a first set comprising at least one bladder having a width less than the width of said mattress and a length less than the length of said mattress, said one bladder being associated with a first body part supportable substantially completely by said one bladder when the bladders in said first set are maintained at a first pressure and supportable substantially completely by at least one bladder in another set when the bladders in said first set are maintained at a second pressure substantially less than the pressure in the bladders of the other set;

means for applying fluid to said bladders at said first and second pressures; and control means for controlling the application of said pressures selectively at said first and second pressures for first and second periods of time, respectively, such that said first body part is alternately supported substantially directly on said first set of bladders and supported substantially indirectly by adjacent body parts supported on other sets of bladders.

19. A system according to claim 18 wherein said panels have opposite edges, with each pair of adjacent panels having associated adjacent opposite edges, and said moving means comprises an adjustable-length panel arm coupled at opposite panel arm ends to associated adjacent panels, lever arm means for attaching both ends of said panel arms to said associated panels at positions between said opposite edges of said associated panel and spaced respective predetermined distances from the planes of each of said associated panels, each lever arm means being attached to said associated panel at positions on said associated panel spaced apart at least the predetermined distance, and means for adjusting the length of said panel arm.

20. A system according to claim 19 wherein each of said lever arm means is attached to said associated panel at positions spaced apart, laterally relative to the longitudinal axis of said platform, at least the respective predetermined distance.

21. A system according to claim 20 wherein each of said lever arm means is attached further to said associated panel at positions spaced apart, in a direction paralleling the longitudinal axis of said platform, at least the respective predetermined distance.

22. A system according to claim 21 wherein each of said lever arm means comprises a brace plate suspended below said associated panel the predetermined distance, and support members attaching said brace plate to said associated panel at said spaced positions.

23. A patient support system comprising:

a base frame supportable on a floor;

a platform sized to support a person lying thereon, said platform comprising a plurality of mutually relatively movable panels hingedly attached in series to each other, each panel being generally disposed in a plane and having opposite edges, with each pair of adjacent panels having associated adjacent opposite edges, an adjustable-length panel arm coupled at opposite panel arm ends to associated adjacent panels, lever arm means for attaching each end of said panel arms to said associated panels at positions spaced predetermined distances from the planes of said associated panels, each of said lever arm means attaching to said associated panel at positions between said opposite edges of said associated panel and spaced at least the respective predetermined distances apart; and means for supporting said platform above said base frame.

24. A system according to claim 23 wherein each of said lever arm means is attached to said associated panel at positions spaced apart, laterally relative to the longitudinal axis of the platform, at least the predetermined distance.

25. A system according to claim 24 wherein each of said lever arm means is attached further to said associated panel at positions spaced apart, in a direction paralleling the longitudinal axis of said platform, at least the predetermined distance.

26. A system according to claim 25 wherein said lever arm means comprises a plate suspended below the panel the predetermined distance, and support members attaching said plate to said panel at said spaced positions.

27. A patient support system comprising:

a base frame supportable on a floor;

an elongate platform sized to support a person lying thereon; and means for supporting said platform above said base frame comprising at least three support elements, each having opposite ends associated with said platform and said frame and being adjustable for varying the distance between said ends independently of said other support elements, wherein said respective ends of each of said support elements are coupled to said frame and platform in a nonrectilinear configuration.

28. A system according to claim 27 wherein said supporting means consists substantially only of said at least three support elements.

* * * * *